US007201209B2

(12) United States Patent
Nakao et al.

(10) Patent No.: US 7,201,209 B2
(45) **Date of Patent: *Apr. 10, 2007**

(54) METHOD AND APPARATUS FOR CASTING ALUMINUM BY CASTING MOLD

(75) Inventors: Yahuhiro Nakao, Sayama (JP); Hiroto Shoji, Sayama (JP); Kunitoshi Sugaya, Sayama (JP); Takashi Kato, Sayama (JP); Takaharu Echigo, Sayama (JP); Satoshi Matsuura, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/190,780

(22) Filed: Jul. 27, 2005

(65) Prior Publication Data

US 2005/0257911 A1 Nov. 24, 2005

Related U.S. Application Data

(63) Continuation of application No. 10/482,670, filed as application No. PCT/JP02/06731 on Jul. 3, 2002.

(30) Foreign Application Priority Data

| | | |
|---|---|---|
| Jul. 5, 2001 | (JP) | 2001-205345 |
| Aug. 3, 2001 | (JP) | 2001-236663 |
| Aug. 3, 2001 | (JP) | 2001-236710 |
| Aug. 3, 2001 | (JP) | 2001-236761 |
| Aug. 21, 2001 | (JP) | 2001-250614 |

(51) Int. Cl.
*B22D 27/18* (2006.01)

(52) U.S. Cl. ..... 164/56.1; 164/66.1; 164/67.1

(58) Field of Classification Search ..... 164/55.1–58.1, 164/66.1, 67.1, 259
See application file for complete search history.

(56) References Cited

U.S. PATENT DOCUMENTS

| | | | | |
|---|---|---|---|---|
| 5,174,357 | A | 12/1992 | Allen | 164/340 |
| 6,786,272 | B2 | 9/2004 | Cowie et al. | 164/103 |
| 2005/0000672 | A1 | 1/2005 | Ban et al. | 164/56.1 |

FOREIGN PATENT DOCUMENTS

| | | |
|---|---|---|
| JP | 2000-280063 | 10/2000 |
| JP | 2000-280063 A | 10/2000 |
| JP | 2001-321921 A | 11/2001 |

*Primary Examiner*—Kuang Y. Lin
(74) *Attorney, Agent, or Firm*—Rankin, Hill, Porter & Clark LLP

(57) ABSTRACT

An aluminum casting process using a casting mold in which after the cavity (25) is filled with an inert gas, magnesium is introduced into the cavity to have a magnesium layer (58*a*) deposited on the cavity wall. Then, nitrogen gas is introduced into the cavity to form magnesium nitride (58*b*) on the surface of the magnesium layer after the cavity wall is heated to a specific temperature. Then, molten aluminum is supplied to have an aluminum casting molded, while the surface of the molten aluminum (39) is reduced with magnesium nitride. This makes it possible to form magnesium nitride within a short time and decrease the amount of nitrogen gas as required.

13 Claims, 54 Drawing Sheets

METHOD AND APPARATUS FOR CASTING ALUMINUM BY CASTING MOLD

TECHNICAL FIELD

This invention relates generally to an aluminum casting process using a casting mold and to an aluminum casting apparatus and, more particularly, to an aluminum casting process using a casting mold for molding an aluminum casting in a cavity of the mold by supplying molten aluminum thereinto and to an aluminum casting apparatus.

BACKGROUND ART

When molten aluminum is supplied into the cavity of a mold for aluminum casting, it is likely that an oxide film may form on the surface of the molten aluminum and increase the surface tension of the molten aluminum and lower its fluidity. When an oxide film has formed on the molten aluminum surface, therefore, it is difficult to maintain a good distribution of the molten aluminum.

Accordingly, JP-A-2000-280063 entitled Aluminum Casting Process is, for example, proposed as a casting process making it possible to maintain a good distribution of molten aluminum for aluminum casting. This art will now be described with reference to FIG. 57 hereof.

Nitrogen gas ($N_2$ gas) is first supplied from a nitrogen gas bottle 550 to fill the cavity 552 of a mold 551 for aluminum casting. Then, nitrogen gas is delivered to a storage tank 553 so that a powder of magnesium (Mg powder) in the storage tank 553 may be delivered into a heating oven 555 with nitrogen gas.

The magnesium powder is sublimated in the heating oven 555 and the sublimated magnesium is reacted with nitrogen gas to form a gaseous magnesium-nitrogen compound ($Mg_3N_2$).

The magnesium-nitrogen compound is introduced into the cavity 552 of the mold 551 through a pipeline 556 so that the introduced magnesium-nitrogen compound may be deposited on the wall of the cavity 552.

Then, molten aluminum 557 is supplied into the cavity 552. The supplied molten aluminum 557 is reacted with the magnesium-nitrogen compound, so that oxygen may be removed from the oxide on the surface of the molten aluminum 557.

As a result, it is possible to prevent the formation of any oxide film on the surface of the molten aluminum 557 and restrain any increase in the surface tension of the molten aluminum 557. Accordingly, it is possible to maintain a good distribution of the molten aluminum 557 in the cavity 552 and thereby produce an aluminum casting of high quality.

Description will now be made in detail of a step for the formation of the magnesium-nitrogen compound mentioned above and a step for the pouring of the molten aluminum.

Description will first be made of the step for the formation of the magnesium-nitrogen compound. The magnesium powder is sublimated in the heating oven 555 and the sublimated magnesium is reacted with nitrogen gas in the heating oven 555. As the sublimated magnesium is floating in the heating oven 555, nitrogen gas adheres to the whole surfaces of the magnesium and forms the magnesium-nitrogen compound on the whole surfaces.

Reference is now made to FIG. 58 for the description of the step for the pouring of the molten aluminum in the aluminum casting process.

FIG. 58 shows that the molten aluminum 557 has been supplied into the cavity 552 after the deposition of a layer 559 of the magnesium-nitrogen compound on the wall of the cavity 552.

When the molten aluminum 557 has been supplied into the cavity 552, its surface 557*a* contacts the surface 559*a* of the magnesium-nitrogen compound layer 559, and oxygen is removed from an oxide 557*b* formed on the surface 557*a* of the molten aluminum 557.

The contact of the surface 557*a* of the molten aluminum 557 with the surface 559*a* of the magnesium-nitrogen compound layer 559 makes it possible to remove oxygen from the oxide 557*b* formed on the surface 557*a* of the molten aluminum 557.

It, therefore, follows that it is sufficient for only the surface 559*a* of the magnesium-nitrogen compound layer 559 contacted by the surface 557*a* of the molten aluminum 557 to exist for removing oxygen from the oxide 557*b* formed on the surface 557*a* of the molten aluminum 557.

Nitrogen gas, however, adheres to the entire surface of the magnesium, since the formation of the magnesium-nitrogen compound is carried out with magnesium floating in the heating oven 555, as explained with reference to FIG. 57. Accordingly, the magnesium-nitrogen compound is formed on the entire outer surface of the magnesium. The deposition of the magnesium-nitrogen compound on the wall of the cavity 552 forms the magnesium-nitrogen compound layer 559 having a thickness t as shown in FIG. 58.

Thus, an excessive magnesium-nitrogen compound layer 559 is deposited on the wall of the cavity 552, and the formation of the magnesium-nitrogen compound layer 559 takes a long time making it difficult to achieve high productivity.

In addition, the formation of the excessive magnesium-nitrogen compound layer 559 means the use of a large amount of nitrogen gas making it difficult to achieve a reduction of cost.

Moreover, the casting process according to the publication mentioned above is a process that includes the step of filling the cavity 552 with nitrogen gas, while air still remains in the cavity 552, before the step of forming the magnesium-nitrogen compound layer 559 on the wall of the cavity 552.

As a result, it is difficult to have air released smoothly from the cavity 552, and the creation of a nitrogen gas atmosphere in the cavity 552 take a long time making it difficult to achieve high productivity.

There is an aluminum casting having a portion of small thickness, and the known aluminum casting process shown in FIG. 57 may find it difficult to maintain a good distribution of molten aluminum in the cavity when molding an aluminum casting having a portion of small thickness.

Therefore, it is necessary to employ a somewhat prolonged pouring time for molten aluminum in order to ensure a full distribution of the molten aluminum through the whole cavity. Accordingly, the molding of an aluminum casting requires a prolonged cycle time that lowers productivity.

DISCLOSURE OF THE INVENTION

According to a first aspect of this invention, there is provided an aluminum casting process using a casting mold, comprising the step of filling the cavity of a closed mold with an inert gas, the step of introducing gaseous magnesium into the inert gas-filled cavity to have magnesium deposited on the wall of the cavity, the step of heating the mold to heat the magnesium-deposited cavity wall to a specific temperature, the step of introducing nitrogen gas into the cavity to have magnesium nitride formed on the cavity wall, and the step of supplying molten aluminum into the cavity in which the magnesium nitride has been formed, to mold an aluminum casting in the cavity, while reducing the surface of the molten aluminum with the magnesium nitride.

The formation of magnesium nitride is started by depositing magnesium on the cavity wall to form a magnesium layer thereon, and after the cavity wall is, then, heated, nitrogen gas is introduced into the cavity to form magnesium nitride on the surface of the magnesium layer.

As a result, it is possible to form magnesium nitride on only the surface of the magnesium layer and thereby shorten the time required for the formation of magnesium nitride. Accordingly, it is possible to achieve an improved productivity for an aluminum casting.

Moreover, it is possible to reduce the amount of nitrogen gas that is used, since it is sufficient to form magnesium nitride on only the surface of the magnesium layer. Accordingly, it is possible to keep down the cost of an aluminum casting.

According to this invention, the cavity wall is heated by a cartridge heater embedded in the mold. A cartridge heater is a heater which is held in a cartridge and is easy to embed in the mold.

It is usual to think of heating the whole mold as a method of heating its cavity wall. A large amount of heat energy is, however, required for heating the whole mold. Moreover, the method in which the whole mold is heated takes a long time to heat the cavity wall to a specific temperature.

According to this invention, therefore, the cartridge heater embedded in the mold is used to heat the cavity wall. The cartridge heater embedded in the mold makes it possible to heat the cavity wall by heating only a part of the mold.

Accordingly, it is possible to reduce heat energy for heating the cavity wall to a specific temperature. Moreover, it is possible to heat the cavity wall to a specific temperature within a relatively short time, since it is sufficient to heat only the necessary part of the mold. Therefore, it is possible to achieve an improved productivity for an aluminum casting.

According to this invention, moreover, the heating of the cavity wall is the heating of only its portion corresponding to a casting portion of small thickness. Generally, molten aluminum can be poured smoothly into a cavity when the cavity is a large space in a case of pouring molten aluminum into a cavity. When the cavity is a narrow space, however, molten aluminum hardly flows smoothly.

According to this invention, therefore, heating is done only of any cavity portion that is a narrow space, or that corresponds to a casting portion of small thickness. The heating of the cavity portion corresponding to a casting portion of small thickness makes it possible to form magnesium nitride in the magnesium layer on that portion. When molten aluminum has reached any cavity portion corresponding to a casting portion of small thickness, molten aluminum has its surface brought into contact with magnesium nitride. It is likely that an oxide has formed on the surface of molten aluminum, but even if such is the case, oxygen can be removed from any such oxide as a result of the reaction of the oxide with magnesium nitride. Thus, it is possible to prevent the formation of any oxide film on the surface of molten aluminum and thereby restrain any increase in surface tension of molten aluminum. Accordingly, it is possible to maintain a good distribution of molten aluminum even in any cavity portion corresponding to a casting portion of small thickness. As a result, it is possible to achieve a shortened process for molding an aluminum casting and thereby an improved productivity. Moreover, it is possible to reduce the amount of nitrogen to a still more extent, since it is only any portion corresponding to a casting portion of small thickness that is heated and have magnesium nitride formed thereon. Accordingly, it is possible to keep down the cost of any aluminum casting.

According to this invention, moreover, the temperature of the cavity wall is detected by a thermocouple embedded in the mold. A thermocouple is a device made of two different metals joined to form a closed circuit so that a temperature difference between the two junctions may develop an electromotive force. The detection of the cavity wall temperature by a thermocouple makes it possible to set the cavity wall temperature more accurately at a specific level. As a result, it is possible to have magnesium nitride formed efficiently in the magnesium layer. Accordingly, it is possible to achieve a shortened process for molding an aluminum casting and thereby an improved productivity.

According to this invention, the thermocouple is installed in a cavity portion corresponding to a casting portion of small thickness to detect the temperature of the portion. In any cavity portion corresponding to a casting portion of small thickness, the cavity has a narrow space through which molten aluminum fails to flow smoothly. According to this invention, therefore, the temperature of any cavity portion corresponding to a casting portion of small thickness is detected by the thermocouple, so that magnesium nitride may be formed efficiently on the magnesium layer in any cavity portion corresponding to a casting portion of small thickness. It is, thus, possible to remove oxygen from any oxide on the surface of molten aluminum and prevent the formation of any oxide film on the surface of molten aluminum in any cavity portion corresponding to a casting portion of small thickness by bringing the surface of molten aluminum into contact with magnesium nitride. Accordingly, it is possible to achieve a shortened process of improved productivity for molding an aluminum casting, since it is possible to maintain a good distribution of molten aluminum in any cavity portion corresponding to a casting portion of small thickness.

According to a second aspect of this invention, there is provided an aluminum casting process using a casting mold, comprising the step of filling the cavity of a closed mold with an inert gas, the step of introducing gaseous magnesium into the inert gas-filled cavity to have magnesium deposited on the wall of the cavity, the step of introducing heated nitrogen gas into the magnesium-deposited cavity to have magnesium nitride formed on the cavity wall, and the step of supplying molten aluminum into the cavity in which the magnesium nitride has been formed, to mold an aluminum casting in the cavity, while reducing the surface of the molten aluminum with the magnesium nitride.

The formation of magnesium nitride is started by depositing magnesium on the cavity wall to form a magnesium layer thereon, and nitrogen gas is introduced into the cavity to form magnesium nitride on the surface of the magnesium layer. As a result, it is possible to form magnesium nitride on only the surface of the magnesium layer and thereby shorten the time required for the formation of magnesium nitride. Accordingly, it is possible to achieve an improved productivity for an aluminum casting. Moreover, it is possible to reduce the amount of nitrogen gas that is used, since it is sufficient to form magnesium nitride on only the surface of the magnesium layer. Accordingly, it is possible to keep down the cost of an aluminum casting. Moreover, nitrogen gas is heated and heated nitrogen gas is used for forming magnesium nitride. The heated nitrogen gas makes it possible to form magnesium nitride efficiently. Accordingly, it is possible to achieve an improved productivity for any aluminum casting.

According to this invention, the temperature T (° C.) of gas in the cavity and the pressure (atmosphere) in the cavity are so selected as to maintain their relationship $T \geqq (130 \times P+270)$. As the temperature T (° C.) of gas in the cavity and the pressure P (atmosphere) in the cavity are relatively easy to determine based on their relationship $T \geqq (130 \times P+270)$, it is possible to perform the adjustment of equipment within a short time. It is apparent from their relationship $T \geqq (130 \times P+270)$ that when the pressure P in the cavity is, for example, 1 atmosphere, the temperature T of gas in the cavity may be set at 400° C. or above for forming magnesium nitride.

According to a third aspect of this invention, there is provided an aluminum casting apparatus for molding an aluminum casting in the cavity of a casting mold by supplying molten aluminum into the cavity, the apparatus comprising an air discharging portion for discharging air from the cavity, an inert gas introducing portion for introducing an inert gas into the cavity from which air has been discharged, a magnesium introducing portion for introducing gaseous magnesium into the cavity into which an inert gas has been introduced, a nitrogen gas introducing portion for introducing heated nitrogen gas into the cavity into which gaseous magnesium has been introduced, and a control portion for controlling the air discharging, inert gas introducing, magnesium introducing and nitrogen gas introducing portions separately to regulate the cavity to a specific pressure.

The aluminum casting apparatus includes the air discharging, inert gas introducing, magnesium introducing and nitrogen gas introducing portions and the control portion controls those portions to regulate the cavity to a specific pressure. The regulation of the cavity to a specific pressure by the control portion makes it possible to deposit magnesium efficiently on the wall of the cavity and form magnesium nitride efficiently on the surface of the deposited magnesium layer. Therefore, it is possible to carry out the formation of the magnesium-nitrogen compound in a short time and thereby achieve an improved productivity. Moreover, the formation of magnesium nitride on only the surface of the magnesium layer makes it possible to avoid the formation of magnesium nitride in the inside of the magnesium layer. As a result, it is possible to reduce the amount of nitrogen gas used and thereby the relevant cost.

According to this invention, the position where the air discharging portion meets the cavity and the position where the inert gas introducing portion meets the cavity are situated in a mutually opposite relation. The mutually opposite situation of the position where the air discharging portion meets the cavity and the position where the inert gas introducing portion meets the cavity enables the inert gas supplied into the cavity to direct the air in the cavity efficiently toward the air discharging portion. It is, therefore, possible to discharge the air from the cavity efficiently through a discharging passage and thereby purge the cavity with an inert gas atmosphere within a short time and achieve an improved productivity.

According to this invention, moreover, the control portion is adapted to control the air discharging, inert gas introducing, magnesium introducing and nitrogen gas introducing portions individually. The individual control of the air discharging, inert gas introducing, magnesium introducing and nitrogen gas introducing portions by the control portion facilitates the regulation of the environment in the cavity in accordance with the conditions for the deposition of the magnesium layer and the conditions for the formation of magnesium nitride. The easy setting of the conditions for the deposition of the magnesium layer and the conditions for the formation of magnesium nitride makes it possible to carry out the deposition of the magnesium layer and the formation of magnesium nitride in a short time. Accordingly, it is possible to achieve an improved productivity for any aluminum casting.

According to this invention, moreover, the magnesium introducing portion includes a sublimating device for sublimating magnesium to form gaseous magnesium, while the nitrogen gas introducing portion includes a heating device for heating nitrogen gas, and the control portion controls the sublimating and heating devices to regulate their temperatures. The control of the sublimating and heating devices by the control portion enables the sublimating device to sublimate magnesium efficiently and the heating device to heat nitrogen gas efficiently. This makes it possible to deposit the magnesium layer efficiently and form magnesium nitride efficiently. Moreover, the deposition of the magnesium layer and the formation of magnesium nitride in a short time make it possible to achieve an improved productivity for any aluminum casting.

According to a fourth aspect of this invention, there is provided an aluminum casting process using a casting mold, comprising the step of filling the cavity of a closed mold with an inert gas, while discharging air from the cavity, to establish a first pressure in the cavity, the step of introducing gaseous magnesium into the cavity to deposit magnesium on the wall of the cavity and establish a second pressure in the cavity, the step of introducing heated nitrogen gas into the cavity to form magnesium nitride on the wall of the cavity and establish a third pressure in the cavity, and the step of supplying molten aluminum into the cavity to mold an aluminum casting in the cavity, while reducing the surface of the molten aluminum with the magnesium nitride.

Air is discharged from the cavity when the cavity is filled with an inert gas. This makes it possible to purge the cavity with an inert gas atmosphere in a short time and achieve an improved productivity.

The formation of magnesium nitride is started by depositing magnesium on the cavity wall to form a magnesium layer thereon, and nitrogen gas is introduced into the cavity to form magnesium nitride on the surface of the magnesium layer. This makes it possible to form magnesium nitride on only the surface of the magnesium layer and thereby shorten the time required for the formation of magnesium nitride and achieve an improved productivity. Moreover, it is possible to reduce the amount of nitrogen gas used and the relevant cost, since it is sufficient to form magnesium nitride on only the surface of the magnesium layer. Moreover, nitrogen gas is heated and heated nitrogen gas is used for forming magnesium nitride. The heated nitrogen gas makes it possible to form magnesium nitride efficiently and achieve an improved productivity.

The cavity is regulated to a first pressure when an inert gas atmosphere is created in it. Such regulation of the cavity pressure makes it possible to prevent efficiently any invasion of air from outside into the cavity and alter the inside of the cavity efficiently to an inert gas atmosphere.

The cavity is regulated to a second pressure when magnesium is deposited on the cavity wall. Such regulation of the cavity pressure makes it possible to establish the conditions facilitating the deposition of magnesium in the cavity and deposit magnesium efficiently.

The cavity is regulated to a third pressure when magnesium nitride is formed. Such regulation of the cavity pressure makes it possible to establish the conditions facilitating the formation of magnesium nitride in the cavity and form magnesium nitride efficiently. The regulation of the cavity to a third pressure also makes it possible to charge the cavity with molten aluminum efficiently. The regulation of the cavity pressure to the first pressure, second pressure and third pressure P for various steps of the process makes it possible to carry out aluminum casting treatment efficiently and achieve an improved productivity.

According to this invention, moreover, the first to third pressures are all so selected as not to exceed the atmospheric pressure. For the deposition of magnesium on the wall of the cavity, it is necessary to lower the temperature of the cavity wall to the specific temperature causing the deposition of magnesium. According to this invention, the second pressure in the cavity, not exceeding the atmospheric pressure, makes it easy to regulate the temperature of the cavity wall to the specific temperature. As a result, it is relatively easy to have magnesium deposited on the cavity wall. For the formation of magnesium nitride, it is necessary to select the third pressure and the temperature of gas in the cavity to specific values. According to this invention, therefore, the third pressure in the cavity is so selected as not to exceed the atmospheric pressure, so that it may be easy to regulate the temperature of gas in the cavity to the temperature at which magnesium nitride is formed. As a result, it is relatively easy to have magnesium nitride formed on the cavity wall. The third pressure not exceeding the atmospheric pressure, moreover, makes it possible to charge the cavity with molten aluminum smoothly and thereby achieve an improved productivity. The first pressure, as well as the second pressure, not exceeding the atmospheric pressure, makes it possible to reduce or eliminate any difference between the first and second pressures and thereby change from the first to the second pressure within a short time. As a result, it is possible to reduce the time lag caused by any change from the first to the second pressure and thereby achieve an improved productivity.

According to this invention, the third pressure P and the temperature T of gas in the cavity are so selected as to maintain their relationship $P \leqq (T-270)/130$. As the third pressure P and the temperature T of gas in the cavity are relatively easy to determine based on their relationship $P \leqq (T-270)/130$, it is possible to perform the adjustment of equipment in accordance with the aluminum casting steps within a short time and achieve an improved productivity. It is apparent from their relationship $P \leqq (T-270)/130$ that when the temperature T of gas in the cavity is, for example, 283° C., the third pressure P may be set at 0.1 atmosphere or below for forming magnesium nitride.

According to this invention, the first and second pressures may both be an atmospheric pressure, while the third pressure is a negative pressure lower than the atmospheric pressure. The first pressure set at the atmospheric level enables the pressure of the cavity to be equal to that of the open atmosphere. It is possible to prevent any invasion of air from the open atmosphere into the cavity still more reliably when an inert gas atmosphere is created in the cavity. The second pressure set at the atmospheric level makes it possible to prevent any invasion of air from the open atmosphere into the cavity still more reliably when magnesium is deposited on the cavity wall. Thus, the first and second pressures set both at the atmospheric level make it possible to have magnesium nitride formed on the cavity wall still more efficiently, since it is possible to prevent any invasion of air into the cavity still more reliably. As any invasion of air into the cavity is prevented, it is also possible to restrain the formation of any oxide on the surface of molten aluminum when the molten aluminum is supplied into the cavity. Moreover, the third pressure set at a negative pressure makes it possible to charge the cavity with molten aluminum still more smoothly. Thus, the first and second pressures set at the atmospheric pressure and the third pressure set at a negative pressure lower than the atmospheric pressure make it possible to perform aluminum casting treatment efficiently and achieve an improved productivity.

According to a fifth aspect of this invention, there is provided an aluminum casting process including filling the cavity of a closed mold with nitrogen gas and magnesium gas and pouring molten aluminum into the cavity, wherein the nitrogen and magnesium gases in the cavity are reacted with each other by the heat of the poured molten aluminum to form a solid magnesium-nitrogen compound, while the formation of the magnesium-nitrogen compound creates a reduced pressure in the cavity, and the aluminum-nitrogen compound removes any oxide film formed on the surface of the molten aluminum.

The nitrogen and magnesium gases in the cavity are reacted with each other by the heat of the molten aluminum to form a solid magnesium-nitrogen compound. The solidifying reaction of the gases in the cavity enables a reduction of the gases in the cavity. The creation of a reduced pressure in the cavity makes it possible to introduce molten aluminum efficiently into the whole area of the cavity. Moreover, the magnesium-nitrogen compound as formed serves to remove any oxide formed on the surface of the molten aluminum. It is, thus, possible to prevent the formation of any oxide film on the surface of the molten aluminum and thereby restrain any increase in surface tension of the molten aluminum. The restrained surface tension of the molten aluminum makes it possible to maintain a good distribution of the molten aluminum in the cavity. As a good distribution of molten aluminum is maintained by the removal of any oxide from its surface, and moreover as the creation of a reduced pressure in the cavity makes it easy to introduce molten aluminum into the whole area of the cavity, it is possible to achieve a still better distribution of molten aluminum. Accordingly, it is possible to achieve a shortened cycle time for the casting steps and thereby an improved productivity.

According to this invention, the cavity may be purged with an inert gas before it is filled with nitrogen and magnesium gases. If the cavity is filled with an inert gas before it is filled with nitrogen and magnesium gases, an inert gas atmosphere is created in the cavity to replace the air in the cavity with an inert gas. This makes it possible to remove oxygen from the cavity and thereby prevent the formation of any oxide or oxide film on the surface of molten aluminum when molten aluminum is poured. Accordingly, as it is possible to maintain a still better distribution of molten aluminum, it is possible to achieve a shortened cycle time for molding any aluminum casting and thereby an improved productivity.

According to this invention, moreover, the pouring temperature of molten aluminum is set at 600 to 750° C. If the molten aluminum temperature is lower than 600° C., the nitrogen and magnesium gases fail to react well. The molten aluminum temperature is, therefore, set at 600° C. or above, so that the nitrogen and magnesium gases may react well. If the molten aluminum temperature exceeds 750° C., the solidification of molten aluminum in the cavity takes a long time making it difficult to achieve high productivity. A high molten aluminum temperature is, moreover, likely to lower the durability of the mold. The molten aluminum temperature is, therefore, set at 750° C. or below to obtain a shortened solidifying time. This makes it possible to achieve a shortened cycle time for molding any aluminum casting and thereby a still improved productivity. The molten aluminum temperature set at 750° C. or below enables an improvement in the durability of the mold.

According to this invention, moreover, the pouring temperature of molten aluminum is detected by a temperature sensor and the molten aluminum is controlled to a selected pouring temperature based upon information as detected by the temperature sensor. This makes it possible to control the pouring temperature of molten aluminum reliably with a small amount of time and labor and thereby achieve an improved productivity.

BEST MODE FOR CARRYING OUT THE INVENTION

Figure 1:
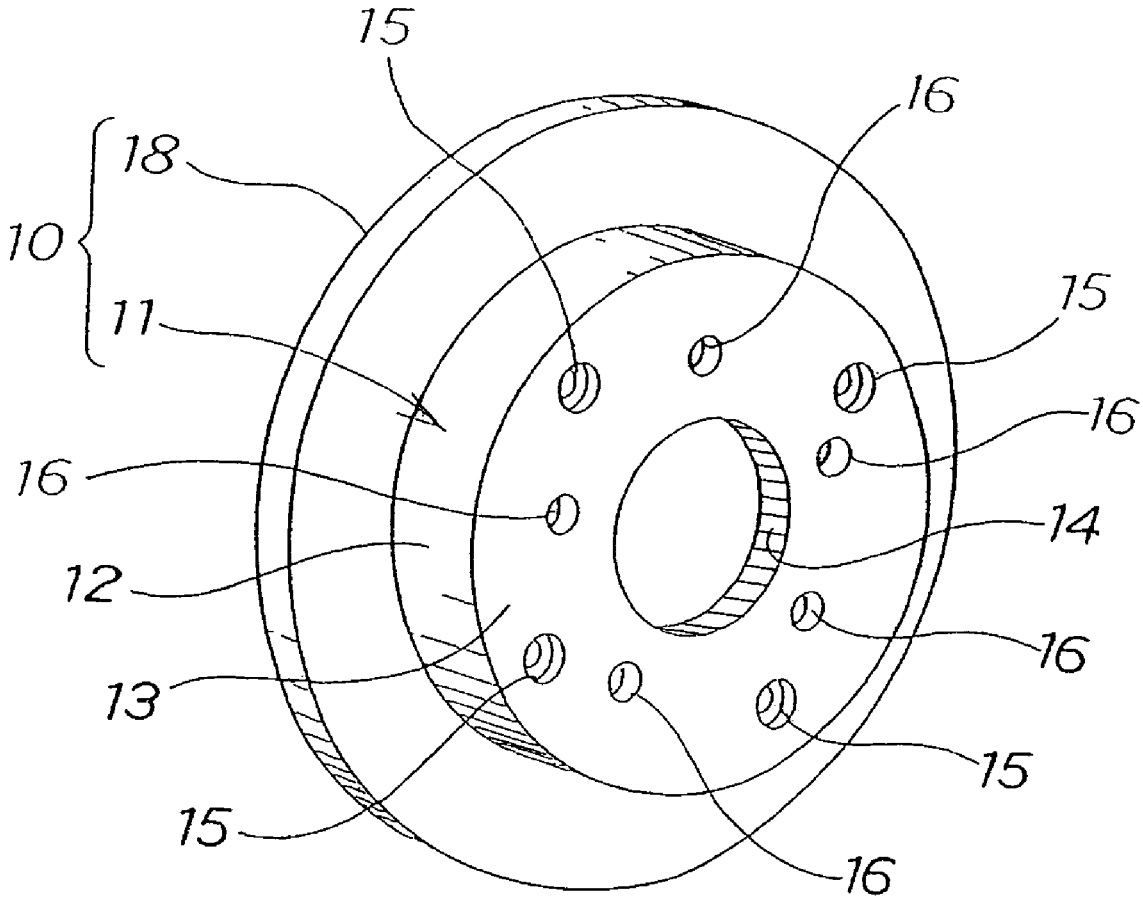
FIG. 1 is a perspective view of a disk rotor (brake disk) as molded by an aluminum casting process (first embodiment) using a casting mold and embodying this invention.

FIG. 1 is a perspective view of a disk rotor (brake disk) as molded by an aluminum casting process (first embodiment) using a casting mold and embodying this invention. The disk rotor (brake disk) 10 is a component member made of aluminum and having a cylindrical hub portion 11 and a circular disk portion 18 formed integrally with the hub portion 11.

The hub portion 11 has a lid 13 formed integrally with the outer end of its peripheral wall 12 and the lid 13 has an opening 14 formed in its center and bolt holes 15 and stud holes 16 formed around the opening 14. Bolts not shown can be inserted through the bolt holes 15 to secure the disk rotor 10 to a drive shaft (not shown). The stud holes 16 are the holes in which studs not shown are press fitted to secure a wheel to the disk rotor 10.

Figure 2:
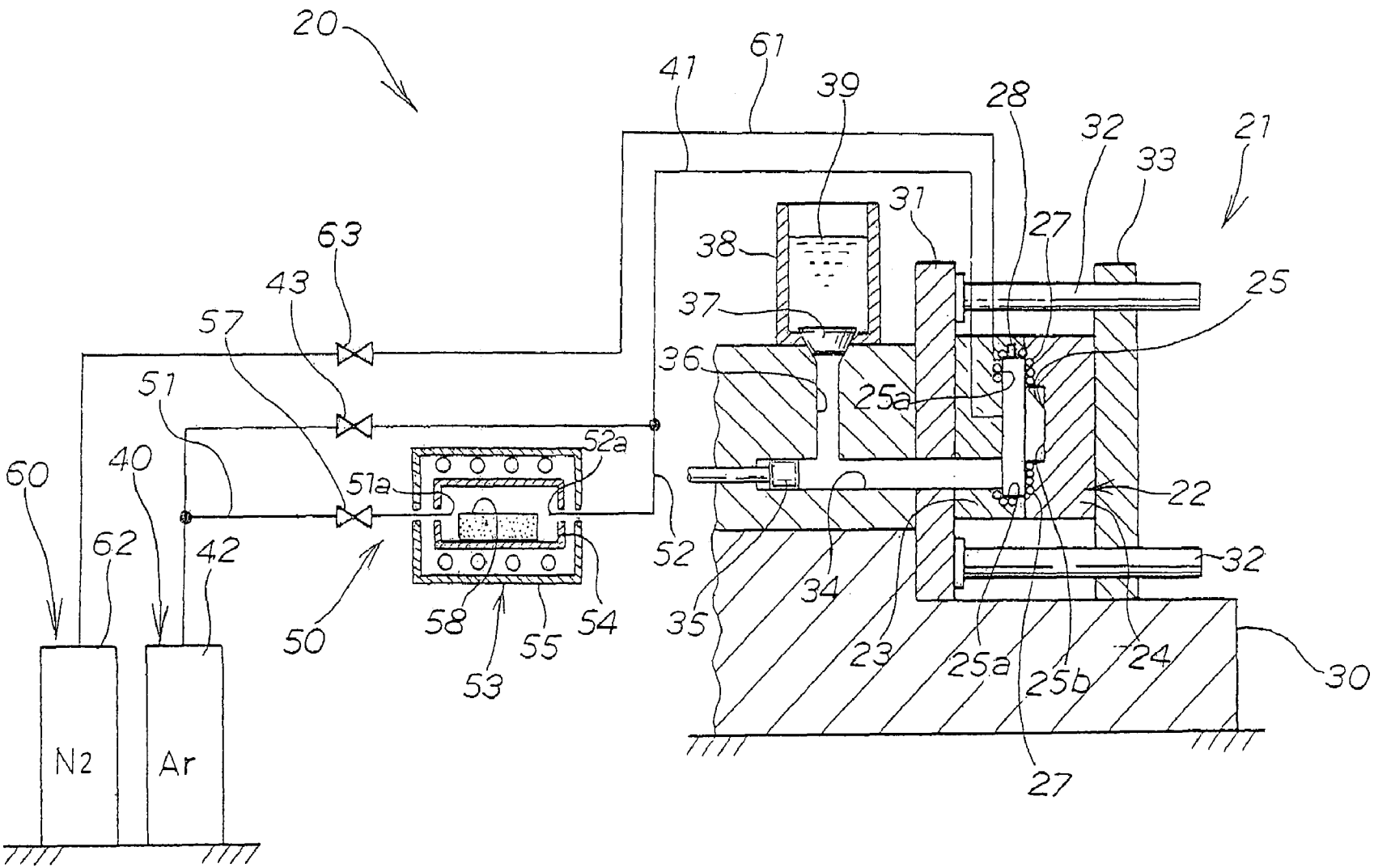
FIG. 2 is an overall diagram showing an aluminum casting apparatus for carrying out the aluminum casting process (first embodiment) using a casting mold and embodying this invention.

FIG. 2 is an overall diagram showing an aluminum casting apparatus for carrying out the aluminum casting process (first embodiment) using a casting mold and embodying this invention. The aluminum casting apparatus 20 has a casting apparatus proper 21 having a casting mold 22, an inert gas introducing portion 40 for introducing argon (Ar) gas (inert (rare) gas) into the cavity 25 defined in the casting mold 22, a magnesium introducing portion 50 for introducing gaseous magnesium (Mg) into the cavity 25 into which the inert gas has been introduced, and a nitrogen gas introducing portion 60 for introducing nitrogen ($N_2$) gas into the cavity 25 into which the gaseous magnesium has been introduced. The casting apparatus proper 21 includes a fixed plate 31 secured to a base 30, the casting mold 22 has a stationary member 23 secured to the fixed plate 31, guide rods 32 are secured to the fixed plate 31 and support a movable plate 33, and the casting mold 22 has a movable member 24 secured to the movable plate 33. A sprue runner 34 opening to the cavity 25 is formed in the stationary member 23 of the mold and the base 30 and holds a movable plunger 35 therein. A sprue 36 is formed vertically from the sprue runner 34 and has an upper end closed by a tenon 37, while a pouring tank 38 capable of communicating with the sprue 36 is situated above it. The stationary and movable members 23 and 24 constitute the casting mold 22.

According to the aluminum casting apparatus 20, the movement of the movable plate 33 in the directions of arrows by a moving device (not shown) enables the movable member 24 of the mold to move between a mold closing position (shown) and a mold opening position. The movable member 24 held in its mold closing position enables the stationary and movable members 23 and 24 to form the cavity 25. After molten aluminum 39 is supplied into the cavity 25, it can be pressed by the plunger 35 to mold an aluminum casting in the cavity 25. Moreover, the casting apparatus proper 21 includes a heater (cartridge heater) 27 embedded in the casting mold 22 along an area 25*a* of the wall of the cavity 25 corresponding to the circular disk portion 18 (portion of small thickness) shown in FIG. 1, or along the outer peripheries of the stationary and movable members 23 and 24. This makes it possible to heat the area 25*a* corresponding to the disk portion 18 (portion of small thickness) to a specific temperature (for example, at least 400° C.).

Heating the whole casting mold 22 may be thought of as a method of heating the wall area 25*a* of the cavity 25 to a specific temperature. Heating the whole casting mold 22, however, requires a large amount of heat energy. Moreover, it takes a lot of time to heat the area 25*a* to a specific temperature by heating the whole casting mold 22. On the other hand, the heater (cartridge heater) embedded in the casting mold 22 can heat the specific area 25*a* to a specific temperature by heating only the necessary part of the casting mold 22. Accordingly, it is possible to reduce the heat energy required for heating the specific area 25*a* to a specific temperature. Moreover, it is possible to heat the specific area 25*a* to a specific temperature within a relatively short time, since it is sufficient to heat only the necessary part of the casting mold 22.

The casting apparatus proper 21 further includes a thermocouple 28 embedded in the area 25*a* corresponding to the disk portion 18 (portion of small thickness) and located in the tail end of the outer periphery of the stationary member 23 of the mold. This enables the thermocouple 28 to detect the area 25*a* corresponding to the circular disk portion 18 (portion of small thickness) of the disk rotor 10. The detection by the thermocouple 28 of the temperature of the area 25*a* corresponding to the disk portion 18 (portion of small thickness) makes it possible to set the temperature of the specific area 25*a* more accurately to a specific temperature. This makes it possible to form magnesium nitride 58*b* (shown in FIG. 8) efficiently on a magnesium layer 58*a*. Molten aluminum fails to flow smoothly particularly along the area 25*a* corresponding to the disk portion 18 (portion of small thickness) as the cavity has a narrow space therein. The temperature of the area 25*a* corresponding to the disk portion 18 (portion of small thickness) is, therefore, detected by the thermocouple 28. This makes it possible to form magnesium nitride 58*b* efficiently on the magnesium layer 58*a* in the area 25*a* corresponding to the disk portion 18 (portion of small thickness). The magnesium nitride 58*b* reduces any oxide on molten aluminum and thereby makes it possible to maintain a good distribution of molten aluminum.

The inert gas introducing portion 40 has an argon gas bottle 42 connected to the cavity 25 by an introducing passage 41 provided with an argon valve 43 midway. The argon valve 43 is a valve for switching the introducing passage 41 between its open and closed positions. The argon valve 43 enables argon to be introduced from the argon gas bottle 42 into the cavity 25 through the introducing passage 41 when it is switched to its open position.

The magnesium introducing portion 50 has a first magnesium introducing passage 51 and a second magnesium introducing passage 52 both connected with the introducing passage 41, a sublimating device 53 connected to the first and second magnesium introducing passages 51 and 52 and a magnesium valve 57 provided in the first magnesium introducing passage 51. The sublimating device 53 has a holding case 54 connected with the outlet end 51*a* of the first magnesium introducing passage 51 and the inlet end 52*a* of the second magnesium introducing passage 52 and a sublimating heater 55 surrounding the holding case 54. The sublimating heater 55 can heat the inside of the holding case 54 to a specific temperature (for example, at least 400° C.) and thereby sublimate a magnesium ingot (magnesium) 58 in the holding case 54 into a gaseous form. The magnesium valve 57 is a valve for switching the first magnesium introducing passage 51 between its open and closed positions. The magnesium valve 57 makes it possible to introduce argon gas from the argon gas bottle 42 into the holding case 54 through the first magnesium introducing passage 51 when it is switched to its open position, so that the introduced argon gas may direct gaseous magnesium into the cavity 25 through the second magnesium introducing passage 52 and the introducing passage 41.

The nitrogen gas introducing portion 60 has a nitrogen gas bottle 62 connected with the cavity 25 through a nitrogen introducing passage 61 provided with a nitrogen valve 63 midway. The nitrogen valve 63 is a valve for switching the nitrogen introducing passage 61 between its open and closed positions. The nitrogen valve 63 makes it possible to introduce nitrogen gas from the nitrogen gas bottle 62 into the cavity 25 through the nitrogen introducing passage 61 when it is switched to its open position.

Figure 3:
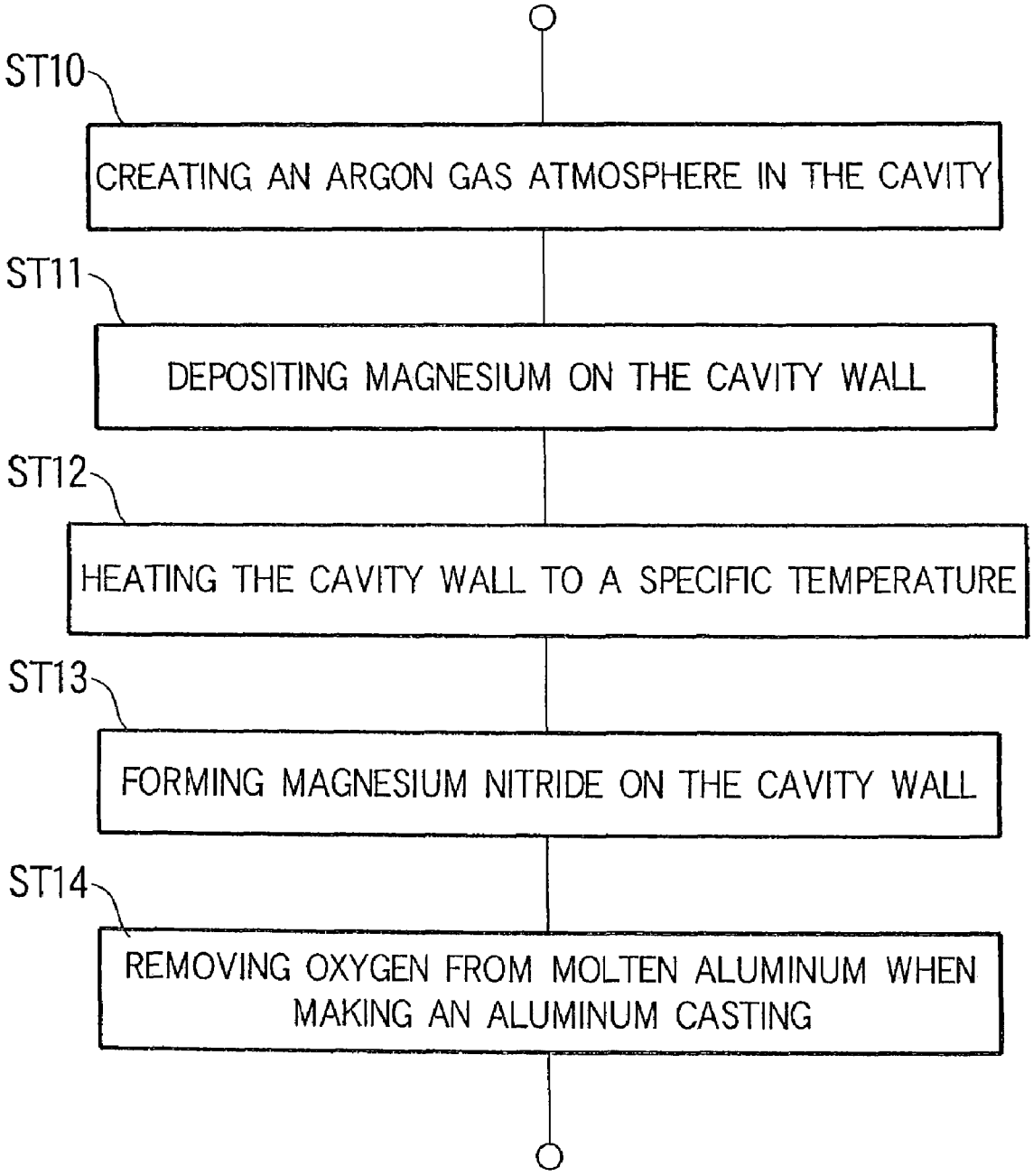
FIG. 3 is a flowchart explaining the aluminum casting process according to the first embodiment of this invention.

Description will now be made of an example in which the casting process according to the first embodiment of this invention is carried out by the aluminum casting apparatus 20. FIG. 3 is a flowchart explaining the aluminum casting process according to the first embodiment of this invention, in which each ST-- indicates Step No.

ST10: The cavity of a closed mold is filled with an inert gas.

ST11: Gaseous magnesium is introduced into the inert gas-filled cavity to have magnesium deposited on the cavity wall.

ST12: The mold is heated to heat the magnesium-deposited cavity wall to a specific temperature.

ST13: Nitrogen gas is introduced into the heated cavity to have magnesium nitride formed on the cavity wall.

ST14: Molten aluminum is supplied into the cavity in which magnesium nitride has been formed, to mold an aluminum casting in the cavity, while the surface of molten aluminum is reduced with magnesium nitride.

Figure 4:
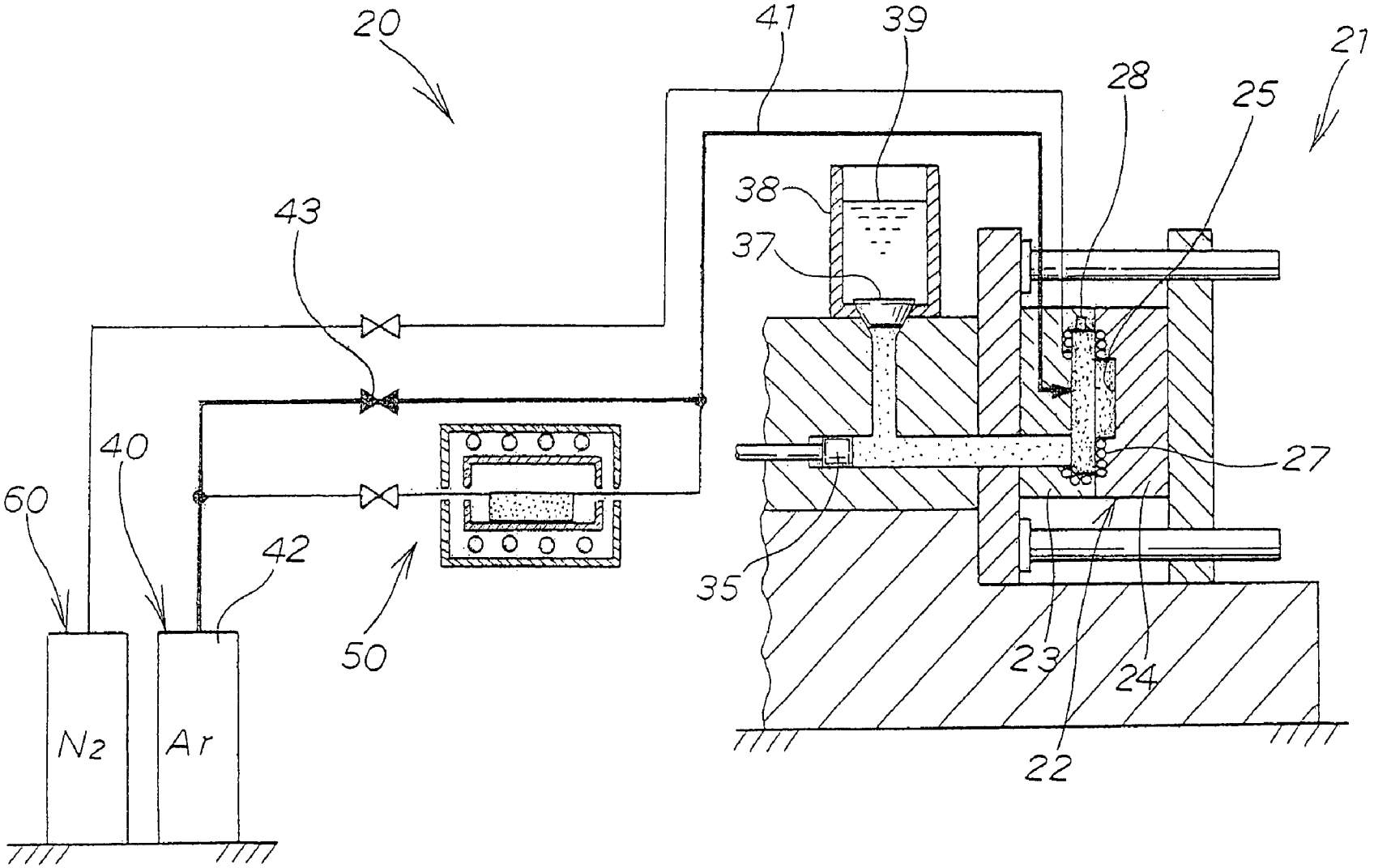
FIG. 4 is a diagram explaining an example in which an argon gas atmosphere is created in a cavity in the aluminum casting process according to the first embodiment of this invention.

Steps ST10 to ST14 of the aluminum casting process using a casting mold and embodying this invention will now be described in detail with reference to FIGS. 4 to 10. FIG. 4 is a diagram for explaining an example in which an argon gas atmosphere is created in the cavity in the aluminum casting process according to the first embodiment of this invention, and it shows ST10. The argon valve 43 is switched to its open position to introduce argon gas (shown in dots) from the argon gas bottle 42 into the cavity 25 through the introducing passage 41. The argon gas filling the cavity 25 expels air from the cavity 25 through, for example, any clearance between the stationary and movable members 23 and 24 of the mold. As a result, an argon gas atmosphere is created in the cavity 25. After an argon gas atmosphere is created in the cavity 25, the argon valve 43 is switched to its closed position.

Figure 5:
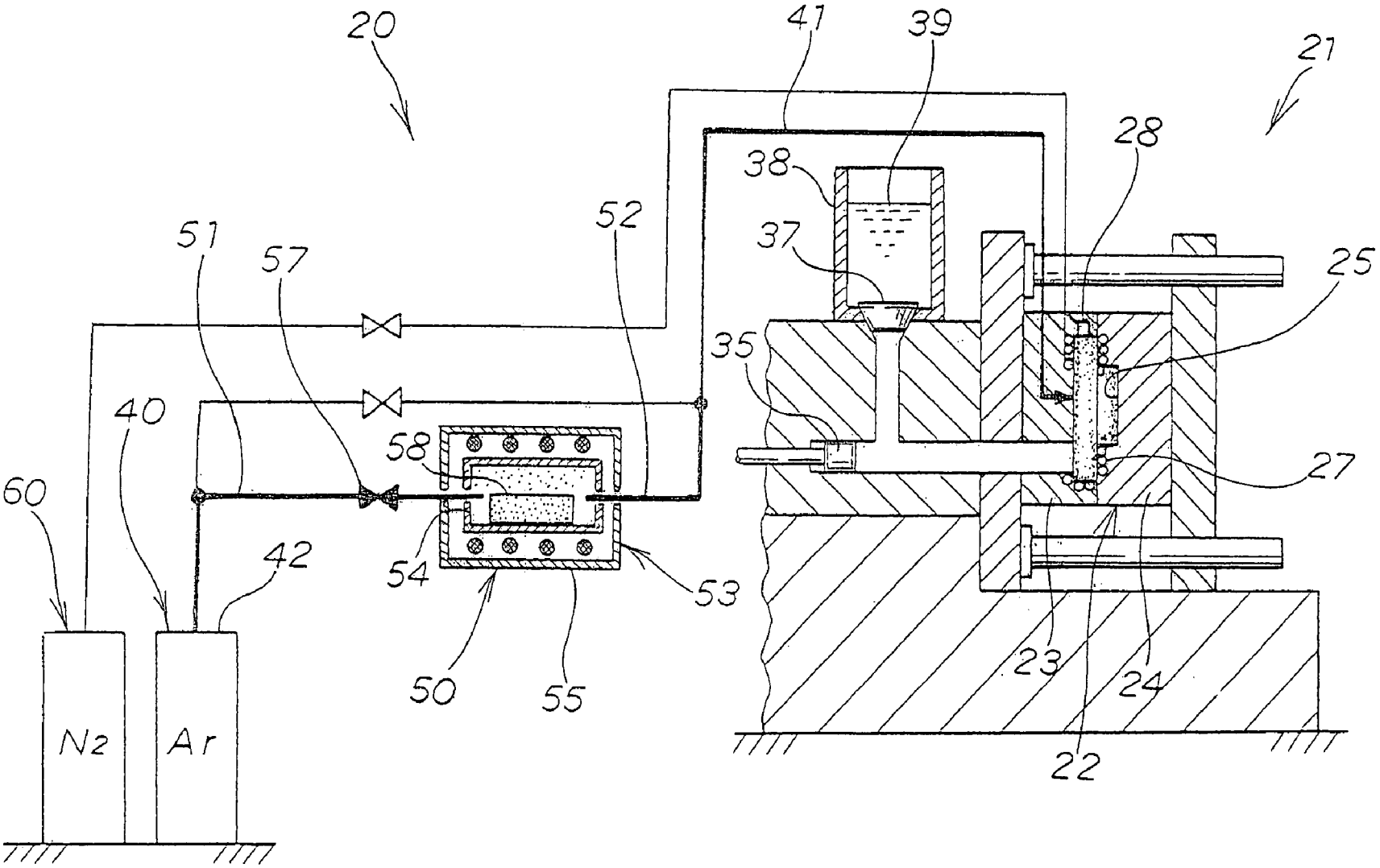
FIG. 5 is a diagram explaining an example in which gaseous magnesium is introduced into the cavity in the aluminum casting process according to the first embodiment of this invention.

FIG. 5 is a diagram for explaining an example in which gaseous magnesium is introduced into the cavity 25 in the aluminum casting process according to the first embodiment of this invention, and it shows ST11. The sublimating heater 55 in the sublimating device 53 is placed in operation to heat the inside of the holding case 54 to a specific temperature (for example, at least 400° C.). The heating of the inside of the holding case 54 causes the sublimation of the magnesium ingot 58 into a gaseous form. The gaseous magnesium in the holding case 54 is shown in dots. The magnesium valve 57 is switched to its open position so that argon gas may be introduced from the argon gas bottle 42 into the holding case 54 through the first magnesium introducing passage 51. The introduced argon gas causes gaseous magnesium (shown in dots) to be introduced into the cavity 25 through the second magnesium introducing passage 52 and the introducing passage 41. When gaseous magnesium is introduced into the cavity 25, the second magnesium introducing passage 52 and the introducing passage 41 are preferably heated so that no magnesium may be deposited in the second magnesium introducing passage 52 or the introducing passage 41.

Figure 6:
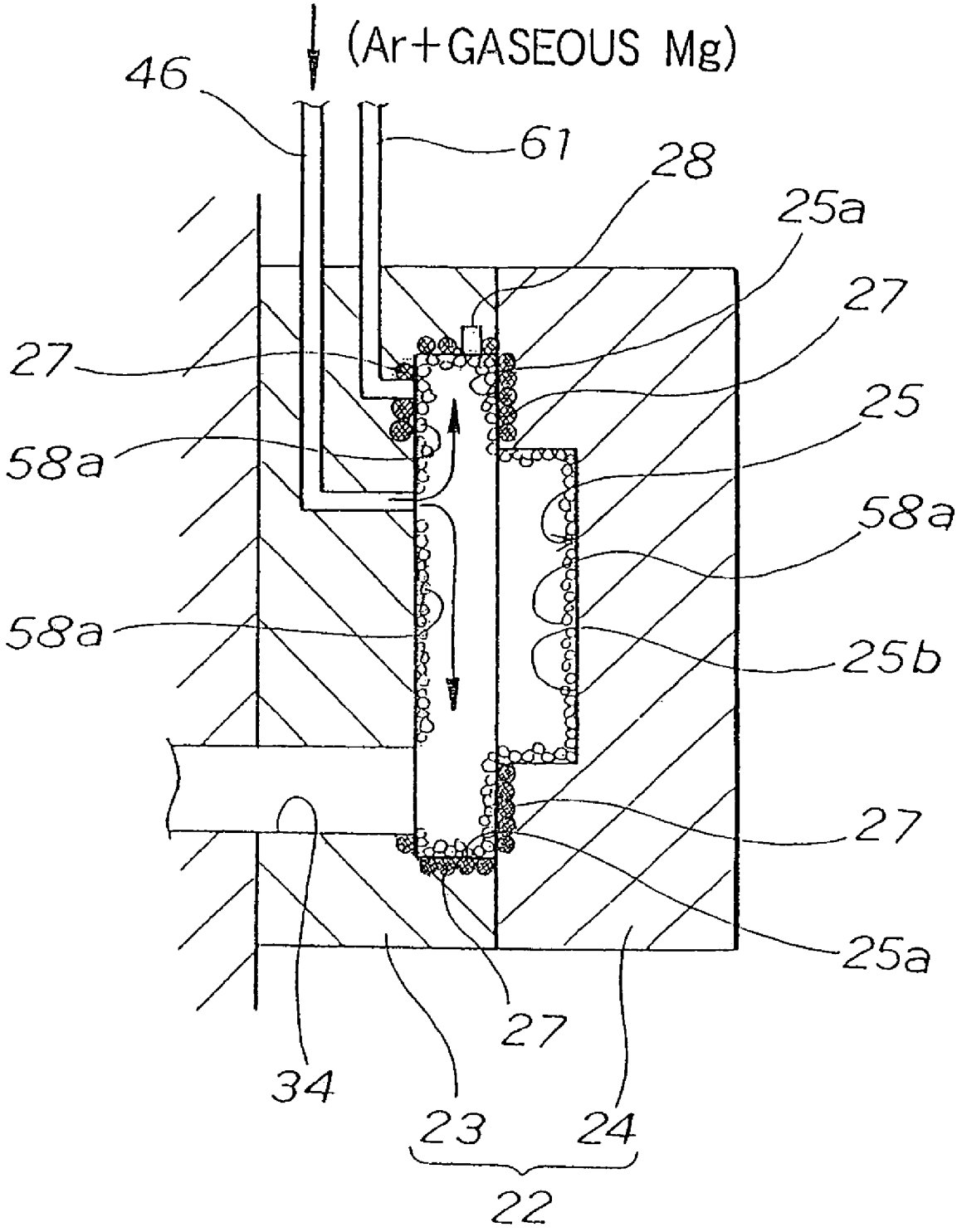
FIG. 6 is a diagram explaining an example in which the cavity wall is heated to a specific temperature after the deposition of magnesium in the aluminum casting process according to the first embodiment of this invention.

FIG. 6 is a diagram for explaining an example in which the cavity wall is heated to a specific temperature after the deposition of magnesium in the aluminum casting process according to the first embodiment of this invention, and it shows ST11 and the former half of ST12. The gaseous magnesium introduced into the cavity 25 as shown by arrows has its temperature lowered to 150 to 250° C. by contacting the wall of the cavity 25. Its drop in temperature to 150 to 250° C. causes gaseous magnesium to be deposited on the wall of the cavity 25. The deposited magnesium is called a magnesium layer 58*a*. After the deposition of the magnesium layer 58*a* on the wall of the cavity 25, the magnesium valve 57 (shown in FIG. 5) is switched to its closed position.

Description will now be made of the latter half of ST12. The heater (cartridge heater) 27 is heated after the magnesium layer 58*a* has been deposited on the wall of the cavity 25. It heats the area 25*a* (a part of the wall of the cavity 25) corresponding to the disk portion 18 (portion of small thickness) shown in FIG. 1. The temperature of the area 25*a* corresponding to the disk portion 18 (portion of small thickness) is detected by the thermocouple 28. When the temperature as detected by the thermocouple 28 has reached, for example, at least 400° C., the heater (cartridge heater) 27 is so controlled as to maintain that temperature.

Figure 7:
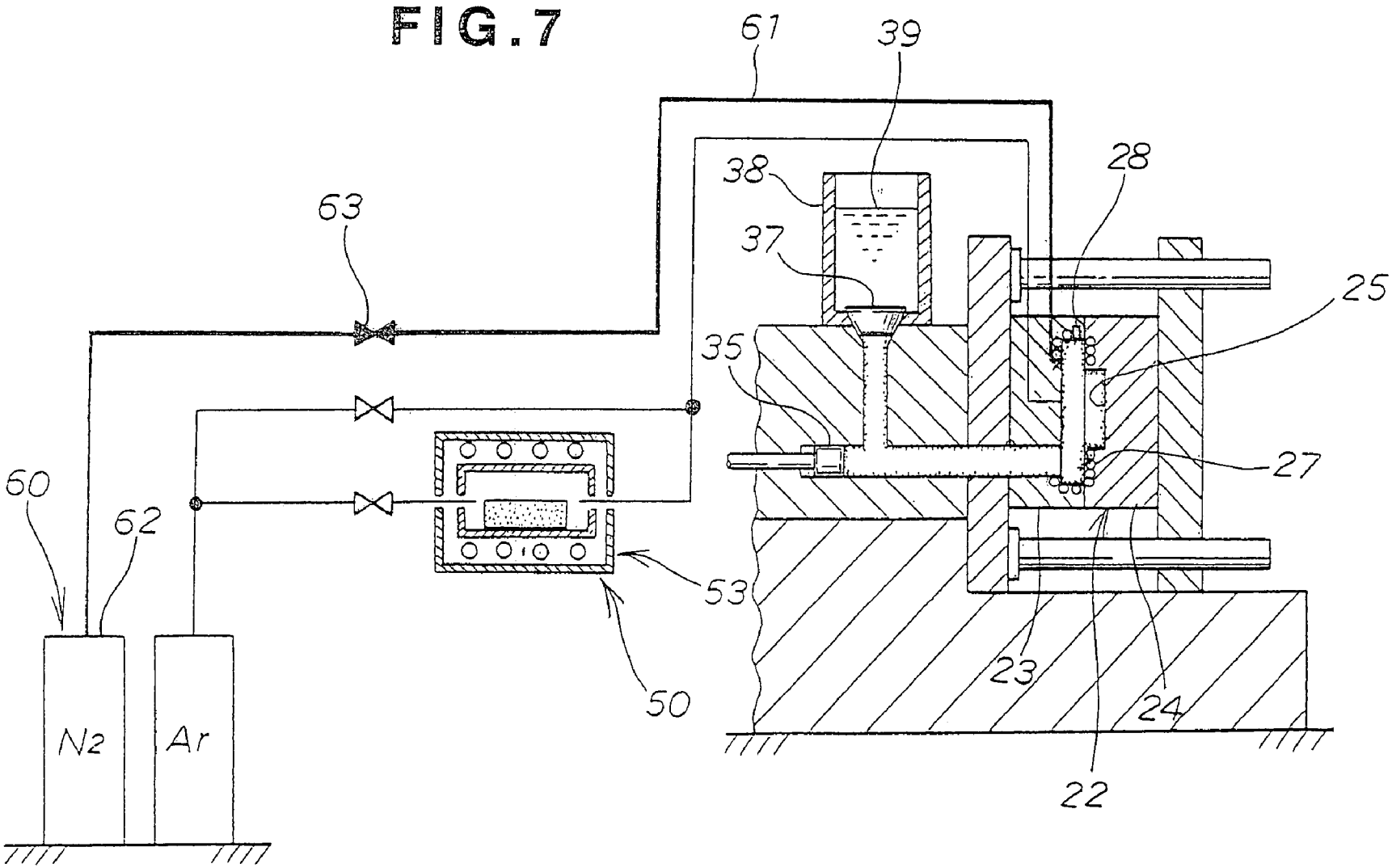
FIG. 7 is a diagram explaining an example in which nitrogen gas is introduced into the cavity in the aluminum casting process according to the first embodiment of this invention.

FIG. 7 is a diagram for explaining an example in which nitrogen gas is introduced into the cavity in the aluminum casting process according to the first embodiment of this invention, and it shows the former half of ST13. The nitrogen valve 63 in the nitrogen gas introducing portion 60 is switched to its open position. The nitrogen valve 63 switched to its open position allows nitrogen gas to flow from the nitrogen gas bottle 62 into the nitrogen introducing passage 61. As a result, nitrogen gas is introduced from the nitrogen gas bottle 62 into the cavity 25 through the nitrogen introducing passage 61.

Figure 8:
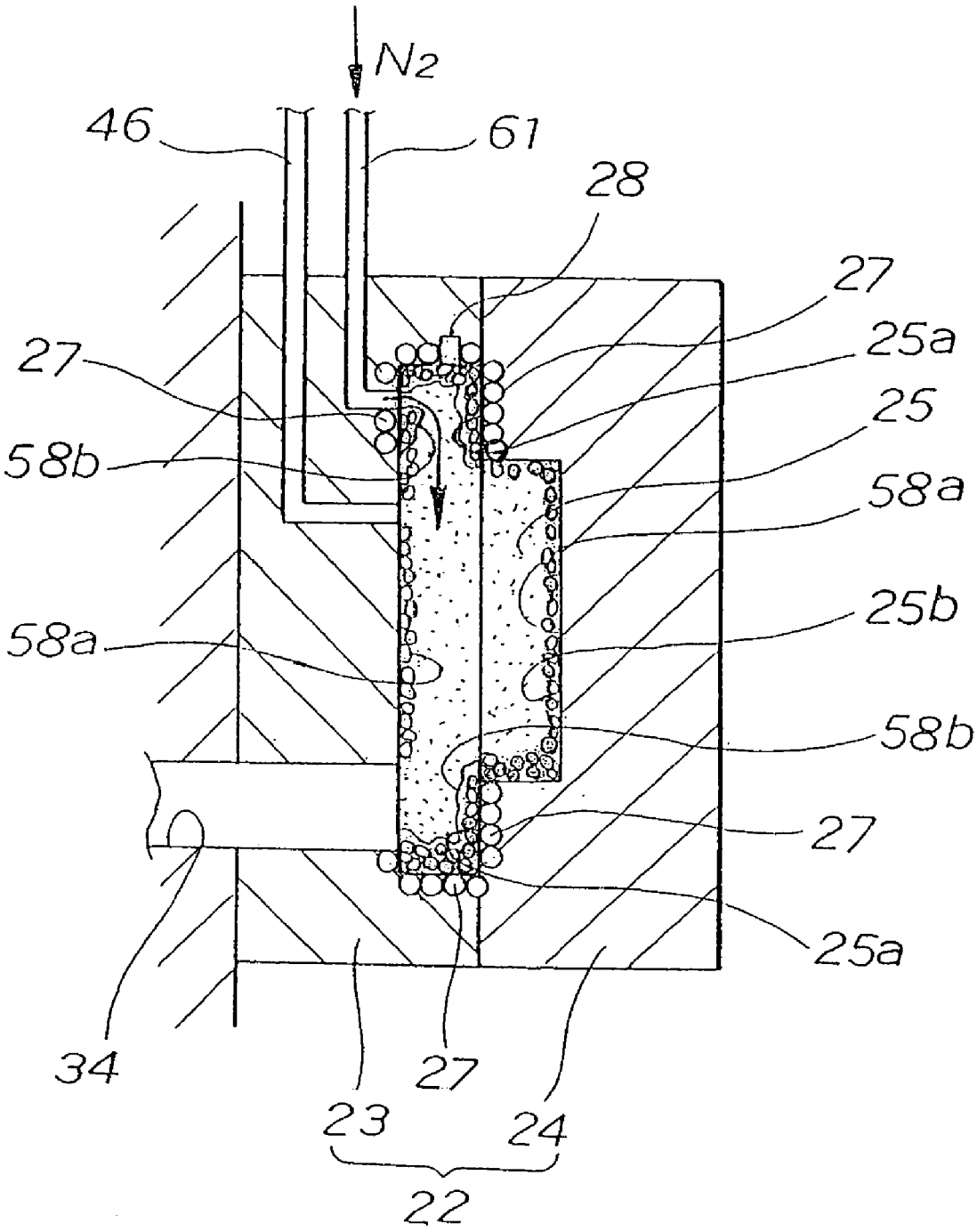
FIG. 8 is a diagram explaining an example in which magnesium nitride is formed on the cavity wall in the aluminum casting process according to the first embodiment of this invention.

FIG. 8 is a diagram for explaining an example in which magnesium nitride is formed on the cavity wall in the aluminum casting process according to the first embodiment of this invention, and it shows the latter half of ST13. The wall of the cavity 25 has been heated by the heater (cartridge heater) 27 to, for example, at least 400° C. in the area 25*a* corresponding to the disk portion 18 (portion of small thickness) shown in FIG. 1. As a result, the magnesium layer 58*a* in the area 25*a* corresponding to the disk portion 18 (portion of small thickness) and nitrogen gas react with each other and form magnesium nitride ($Mg_3N_2$) 58*b* on the surface of the magnesium layer 58*a* in that area. When the area 25*a* corresponding to the disk portion 18 (portion of small thickness) is heated to, for example, at least 400° C. by the heater (cartridge heater) 27 as described, the magnesium layer 58*a* is heated and magnesium nitride 58*b* can be formed easily. This enables the efficient formation of magnesium nitride 58*b*. After magnesium nitride 58*b* has been formed on the surface of the magnesium layer 58*a* in the area 25*a*, the nitrogen valve 63 is switched to its closed position.

For the formation of magnesium nitride 58*b*, the magnesium layer 58*a* is first formed by magnesium deposited on the wall of the cavity 25, then the area 25*a* corresponding to the disk portion 18 (portion of small thickness) is heated, and thereafter nitrogen gas is introduced into the cavity 25, as described with reference to FIGS. 6 and 8. As a result, magnesium nitride 58*b* is formed on the surface of the magnesium layer 58*a* in the heated area 25*a*. Accordingly, it is possible to form magnesium nitride 58*b* on only the surface of the magnesium layer 58*a* and thereby shorten the time required for forming magnesium nitride 58*b*. Moreover, it is possible to reduce the amount of nitrogen gas used, since it is sufficient to form magnesium nitride 58*b* on only the surface of the magnesium layer 58*a*.

Figure 9A:
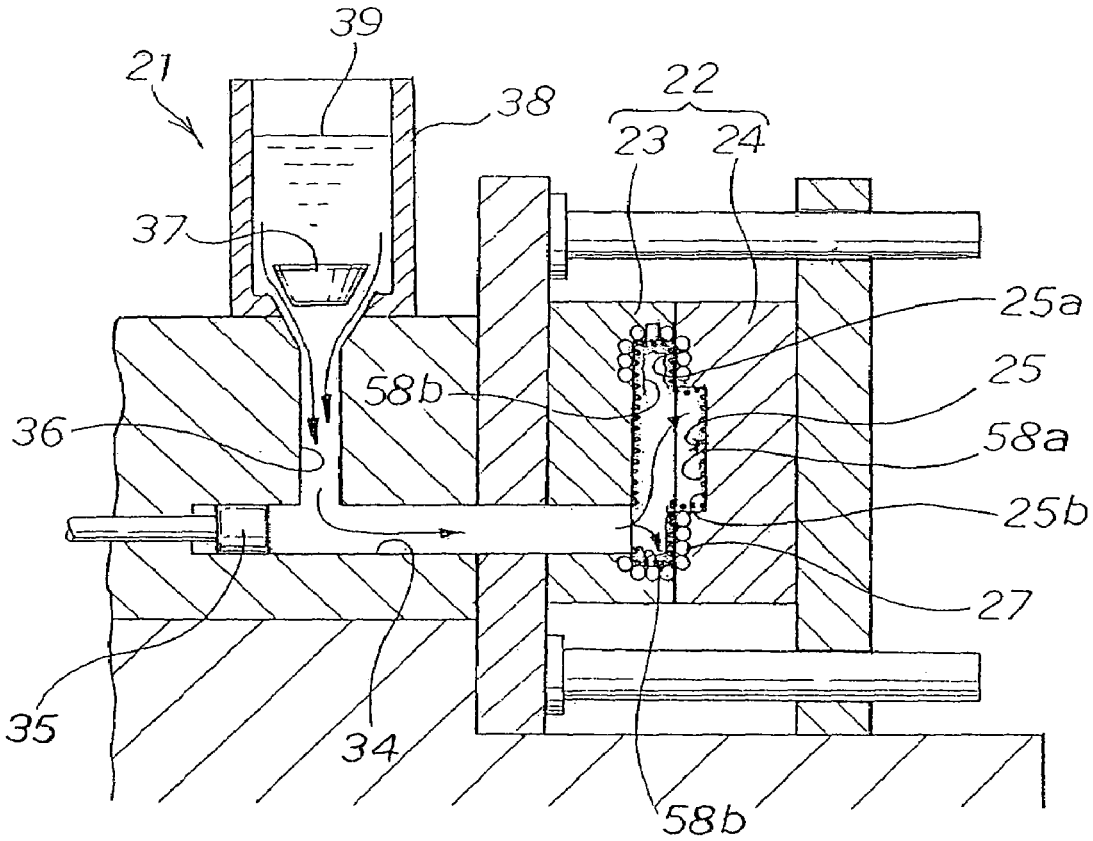
FIGS. 9A and 9B are diagrams explaining the example in which magnesium nitride is formed in the aluminum casting process according to the first embodiment of this invention.
Figure 9B:
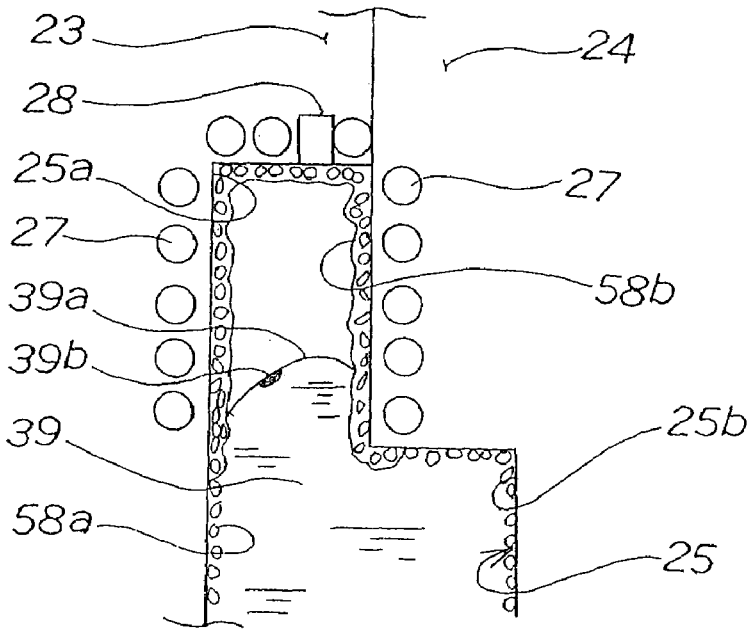

FIGS. 9A and 9B are diagrams for explaining an example in which molten aluminum is supplied into the cavity in the aluminum casting process according to the first embodiment of this invention, and they show the former half of ST14. Referring to FIG. 9A, the tenon 37 in the casting apparatus proper 21 is operated to open the sprue 36, so that molten aluminum 39 may be supplied from the pouring tank 38 into the cavity 25 through the sprue 36 and the runner 34 as shown by arrows. Generally, molten aluminum 39 flows smoothly if the cavity 25 is a wide space, but it does not flow smoothly if the cavity 25 is a narrow space. Accordingly, molten aluminum 39 flows smoothly along the area 25*b* of the cavity forming a wide space even if any oxide 39*b* may be formed on the surface 39*a* of molten aluminum 39. On the other hand, any oxide 39*b* formed on the aluminum surface 39*a* makes it difficult for molten aluminum 39 to flow smoothly along the area 25*a* of the cavity forming a narrow space which makes it relatively difficult for molten aluminum 39 to flow. In the area 25*a* of the cavity forming a narrow space, therefore, magnesium nitride 58*b* is formed on the wall of the cavity 25 to reduce any oxide 39*b* on the molten aluminum 39. This action will be explained with reference to FIG. 9B.

Referring to FIG. 9B, the molten aluminum 39 supplied into the cavity 25 has its surface 39*a* contact magnesium nitride 58*b* upon reaching the area 25*a* corresponding to the disk portion (portion of small thickness) shown in FIG. 1. It is likely that any oxide 39*b* may have been formed on the surface 39*a* of molten aluminum 39, and if any oxide 39*b* has been formed, its reaction with magnesium nitride 58*b* enables the removal of oxygen from the oxide 39*b*. This makes it possible to prevent the formation of any oxide film on the surface 39*a* of molten aluminum 39 and thereby restrain any increase in surface tension of molten aluminum 39. Accordingly, it is possible to maintain a good distribution of molten aluminum 39 along the area 25*a* corresponding to the disk portion 18 (portion of small thickness).

Figure 10A:
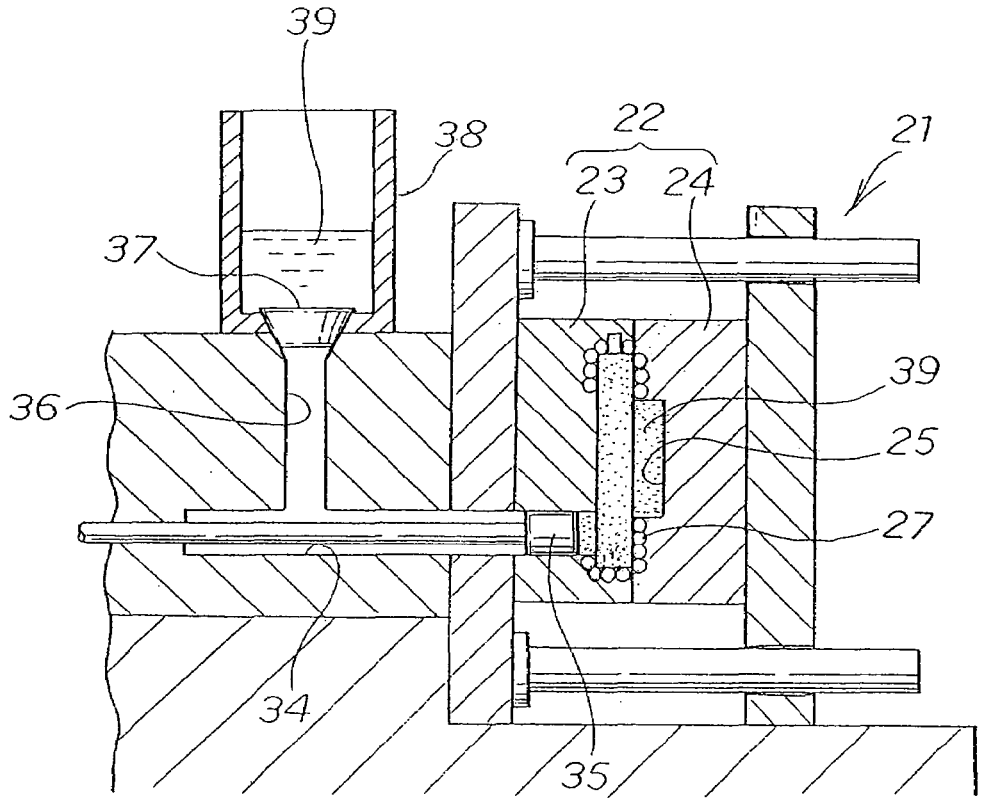
FIGS. 10A and 10B are diagrams explaining an example in which an aluminum casting is molded in the cavity in the aluminum casting process according to the first embodiment of this invention.
Figure 10B:
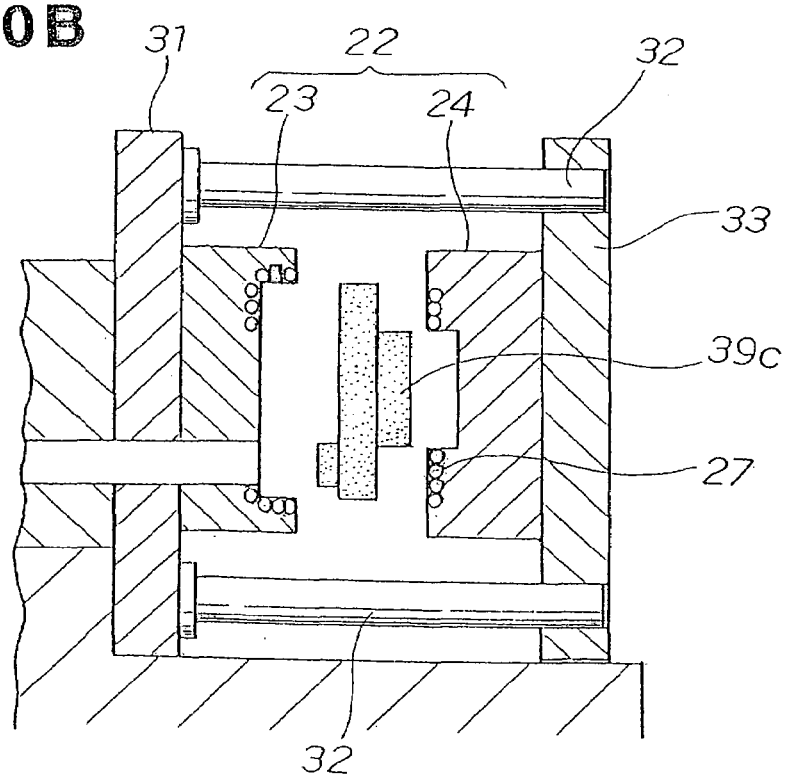

FIGS. 10A and 10B are diagrams for explaining an example in which an aluminum casting is molded in the cavity in accordance with the aluminum casting process according to the first embodiment of this invention, and they show the latter half of ST14. Referring to FIG. 10A, the sprue 36 is closed by the tenon 37 after a specific amount of molten aluminum 39 has been supplied from the pouring tank 38 to the cavity 25. The plunger 35 is pushed forward toward the cavity 25 to fill the cavity 25 with molten aluminum 39. Referring to FIG. 10B, the casting mold 22 is opened for the removal of an aluminum casting 39*c* obtained by the solidification of molten aluminum 39 (shown in FIG. 10A). The aluminum casting 39*c* is a product of higher quality owing to a good distribution of molten metal as poured. The aluminum casting 39*c* is worked on to make the disk rotor 10 shown in FIG. 1.

Second Embodiment:

Description will now be made of the second embodiment with reference to FIGS. 11 to 16. The reference numerals used for the first embodiment are used to denote like parts or materials for the second embodiment and no repeated description thereof is made.

Figure 11:
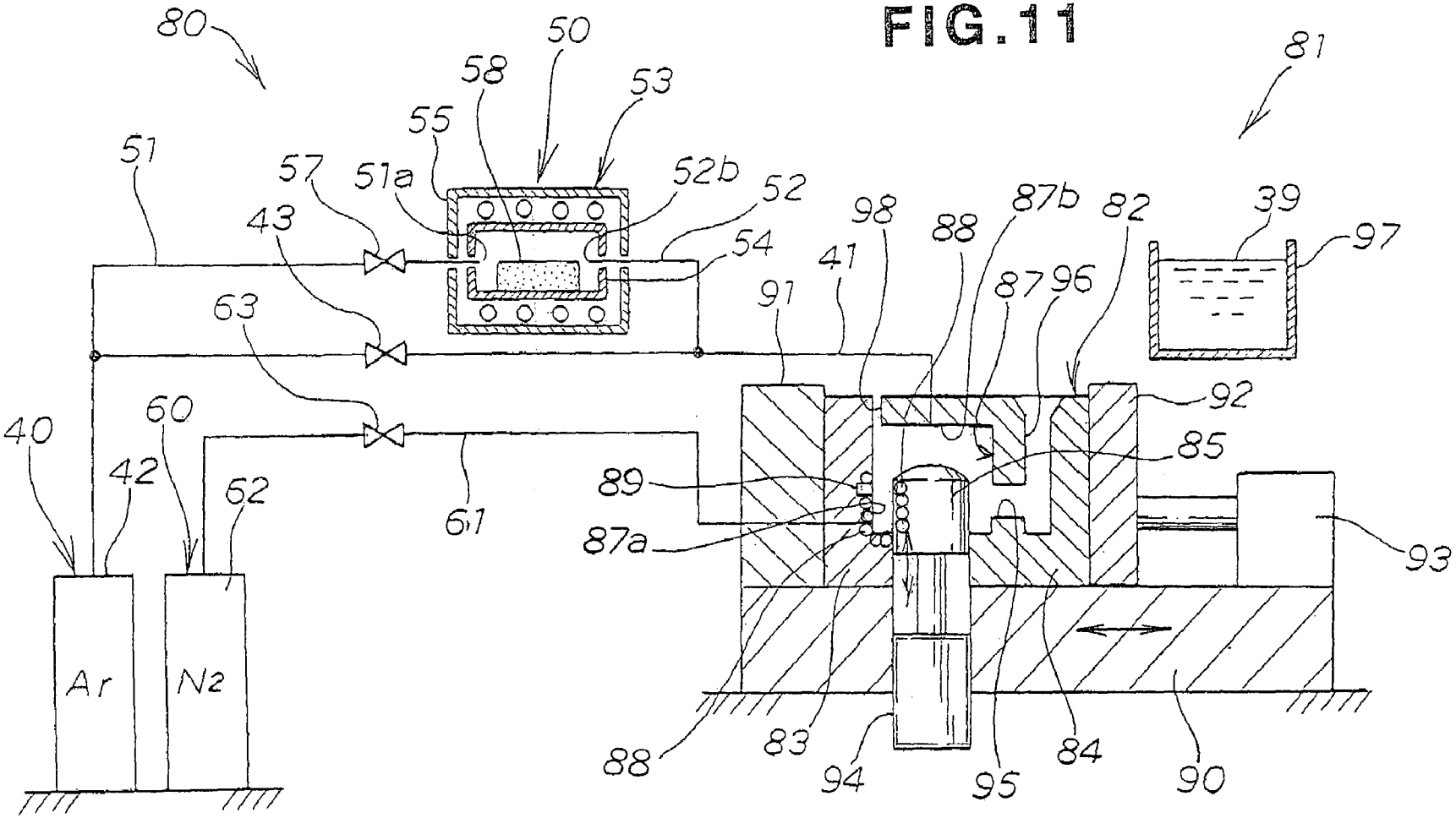
FIG. 11 is an overall diagram showing an aluminum casting apparatus for carrying out the aluminum casting process (second embodiment) using a casting mold and embodying this invention.

FIG. 11 is an overall diagram showing an aluminum casting apparatus for carrying out the aluminum casting process using a casting mold and embodying this invention. The aluminum casting apparatus 80 has a casting apparatus proper 81 having a casting mold 82, an inert gas introducing portion 40 for introducing argon (Ar) gas (inert (rare) gas) into the cavity 87 defined in the casting mold 82, a magnesium introducing portion 50 for introducing gaseous magnesium (Mg) into the cavity 87 into which the inert gas has been introduced, and a nitrogen gas introducing portion 60 for introducing nitrogen ($N_2$) gas into the cavity 87 into which the gaseous magnesium has been introduced. The casting apparatus proper 81 includes a fixed plate 91 secured to abase 90, a stationary mold member 83 is secured to the fixed plate 91, a movable plate 92 is movably mounted on the base 90, a movable mold member 84 is secured to the movable plate 92, a device 93 for moving the movable plate 92 is mounted on the base 90 and a core 85 for the casting mold 82 is supported by the base 90 so as to be capable of being raised and lowered by a raising and lowering device 94. A sprue runner 95 opening to the cavity 87 is formed in the movable mold member 84, a sprue 96 is formed vertically from the sprue runner 95, while a pouring tank 97 holding molten aluminum 39 is situated above the sprue 96, and the casting mold 82 has an opening 98 formed at its top as a vent or feeder head. The stationary and movable mold members 83 and 84 and the core 85 constitute the casting mold 82. While FIG. 11 shows the sprue 96 and the opening 98 as being large relative to the cavity 87 to provide an easier understanding of the casting apparatus proper 81, the real sprue 96 and opening 98 are sufficiently small relative to the cavity 87 to enable the cavity 87 to keep a substantially completely closed state when the casting mold 82 is closed.

According to the aluminum casting apparatus 80, the movement of the movable plate 92 in the directions of arrows by the moving device 93 enables the movable mold member 84 to move between its mold closing position (position shown in the drawing) and its mold opening position. The movement of the core 85 in the directions of arrows by the raising and lowering device 94 enables the core 85 to move between its mold closing position (position shown in the drawing) and its mold opening position. The movable mold member 84 and the core 85 held in their mold closing positions enable the stationary and movable mold members 83 and 84 and the core 85 to form the cavity 87. If molten aluminum 39 is supplied into the cavity 87, it is possible to mold an aluminum casting in the cavity 87.

The casting apparatus proper 81 differs from the casting apparatus proper 21 according to the first embodiment in that it is so constructed as to allow molten aluminum 39 to flow into the cavity 87 by its own weight at the atmospheric pressure. Moreover, the casting apparatus proper 81 has a heater (cartridge heater) 88 embedded in the casting mold 82 along the area 87*a* of the wall of the cavity 87 corresponding to the cylinder portion of a cylinder block (portion of small thickness), or in the left lower portion of the stationary mold member 83 and the outer periphery of the core 85. This makes it possible to heat the area 87*a* corresponding to the cylinder portion (portion of small thickness) to a specific temperature (for example, at least 400° C.).

Heating the whole casting mold 82 may be thought of as a method of heating the wall area 87*a* of the cavity 87 to a specific temperature. Heating the whole casting mold 82, however, requires a large amount of heat energy. Moreover, it takes a lot of time to heat the area 87*a* to a specific temperature by heating the whole casting mold 82. On the other hand, the heater (cartridge heater) embedded in the casting mold 82 can heat the specific area 87*a* to a specific temperature by heating only the necessary part of the casting mold 82. Accordingly, it is possible to reduce the heat energy required for heating the specific area 87*a* to a specific temperature. Moreover, it is possible to heat the specific area 87*a* to a specific temperature within a relatively short time, since it is sufficient to heat only the necessary part of the casting mold 82.

The casting apparatus proper 81 further includes a thermocouple 89 embedded in the area 87*a* corresponding to the cylinder portion (portion of small thickness) and located in the left lower portion of the stationary mold member 83. This enables the thermocouple 89 to detect the area 87*a* corresponding to the cylinder portion (portion of small thickness) of a cylinder block. The detection by the thermocouple 89 of the temperature of the area 87*a* corresponding to the cylinder portion (portion of small thickness) makes it possible to set the temperature of the specific area 87*a* more accurately to a specific temperature. This makes it possible to form magnesium nitride 103 (shown in FIG. 14) efficiently on a magnesium layer 102. Molten aluminum fails to flow smoothly particularly along the area 87*a* corresponding to the cylinder portion (portion of small thickness) as the cavity has a narrow space therein. The temperature of the area 87*a* corresponding to the cylinder portion (portion of small thickness) is, therefore, detected by the thermocouple 89. This makes it possible to form magnesium nitride 103 efficiently on the magnesium layer 102 in the area 87*a* corresponding to the cylinder portion (portion of small thickness). The magnesium nitride 103 reduces any oxide on molten aluminum and thereby makes it possible to maintain a good distribution of molten aluminum.

Figure 12:
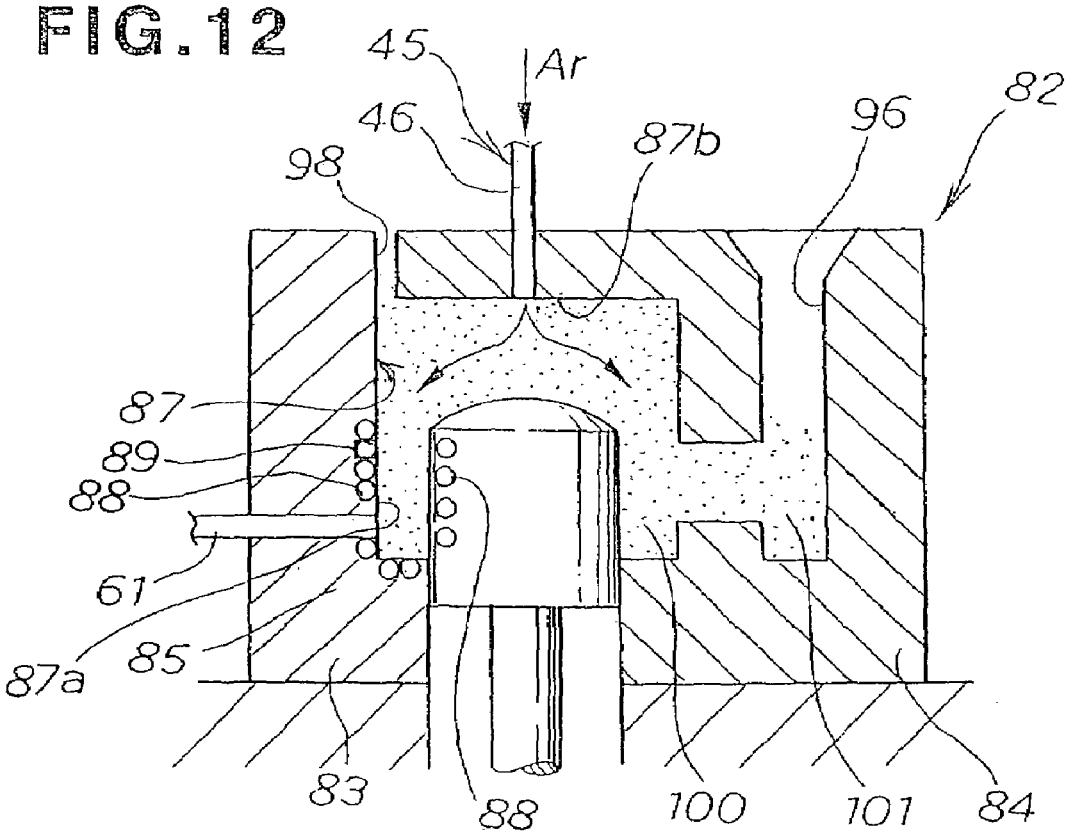
FIG. 12 is a diagram explaining an example in which an argon gas atmosphere is created in a cavity in the aluminum casting process according to the second embodiment of this invention.

An example in which the casting process according to the second embodiment of this invention is carried out by the aluminum casting apparatus 80 will now be described with reference to FIGS. 3 and 11 to 16. The step ST10 of FIG. 3 will first be explained. The argon valve 43 shown in FIG. 11 is switched to its open position to introduce argon gas from an argon gas bottle 42 into the cavity 87 through an introducing passage 41. FIG. 12 is a diagram for explaining an example in which an argon gas atmosphere is created in the cavity in accordance with the aluminum casting process according to the second embodiment of this invention. The argon gas filling the cavity 87 expels air from the cavity 87 through, for example, the sprue 96 or the vent or feeder head opening 98. As a result, an argon gas atmosphere is created in the cavity 87. After an argon gas atmosphere is created in the cavity 87, the argon valve 43 (shown in FIG. 11) is switched to its closed position.

The former half of ST11 of FIG. 3 will now be explained. Returning to FIG. 11, a sublimating heater 55 in a sublimating device 53 is placed in operation to heat the inside of a holding case 54 to a specific temperature (for example, at least 400° C.). The heating of the inside of the holding case 54 causes the sublimation of a magnesium ingot 58 into a gaseous form. A magnesium valve 57 is switched to its open position so that argon gas may be introduced from the argon gas bottle 42 into the holding case 54 through a first magnesium introducing passage 51. The introduced argon gas causes gaseous magnesium to be introduced into the cavity 87 through a second magnesium introducing passage 52 and the introducing passage 41. When gaseous magnesium is introduced into the cavity 87, the second magnesium introducing passage 52 and the introducing passage 41 are preferably heated so that no magnesium may be deposited in the second magnesium introducing passage 52 or the introducing passage 41.

Figure 13:
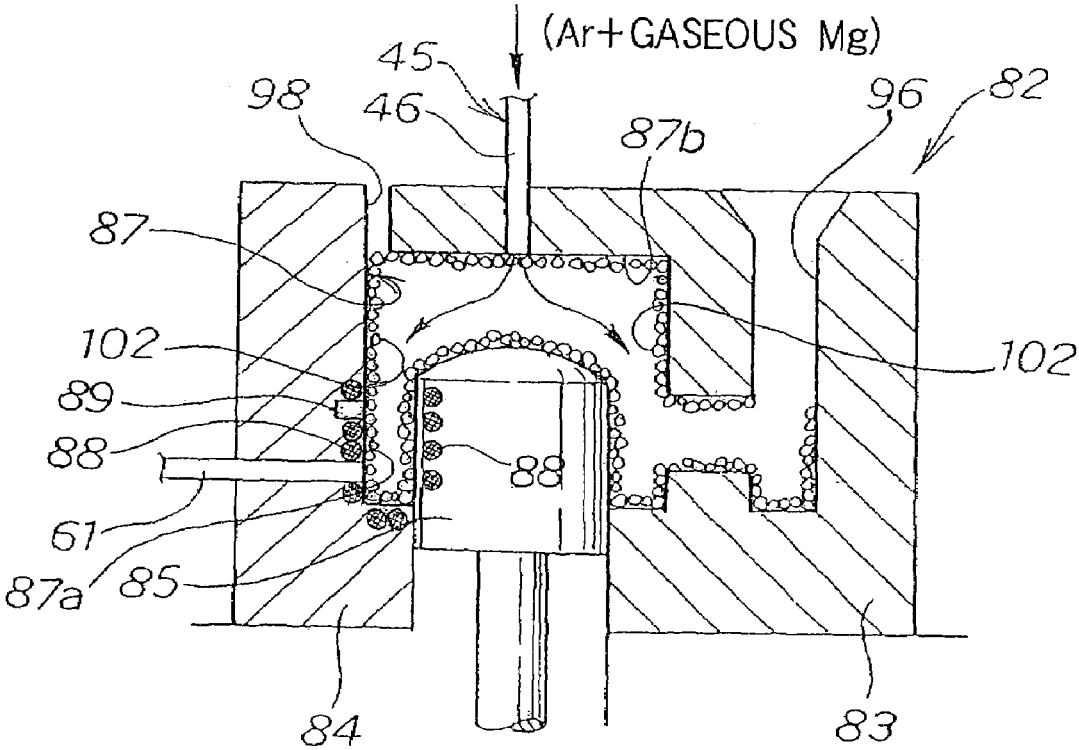
FIG. 13 is a diagram explaining an example in which the cavity wall is heated to a specific temperature after the deposition of magnesium in the aluminum casting process according to the second embodiment of this invention.

FIG. 13 is a diagram for explaining an example in which the cavity wall is heated to a specific temperature after the deposition of magnesium in the aluminum casting process according to the second embodiment of this invention, and it explains the latter half of Step ST11 and Step ST12. The gaseous magnesium introduced into the cavity 87 as shown by arrows has its temperature lowered to 150 to 250° C. by contacting the wall of the cavity 87. Its drop in temperature to 150 to 250° C. causes gaseous magnesium to be deposited on the wall of the cavity 87. The deposited magnesium is called a magnesium layer 102. After the deposition of the magnesium layer 102 on the wall of the cavity 87, the magnesium valve 57 (shown in FIG. 11) is switched to its closed position.

Step ST12 will now be explained. The heater (cartridge heater) 88 is heated after the magnesium layer 102 has been deposited on the wall of the cavity 25. It heats the area 87*a* (a part of the wall of the cavity 87) corresponding to the cylinder portion (portion of small thickness). The temperature of the area 87*a* corresponding to the cylinder portion (portion of small thickness) is detected by the thermocouple 89. When the temperature as detected by the thermocouple 89 has reached, for example, at least 400° C., the heater (cartridge heater) 88 is so controlled as to maintain that temperature.

The Step ST13 shown in FIG. 3 will now be explained. The nitrogen valve 63 in the nitrogen gas introducing portion 60 shown in FIG. 11 is switched to its open position to allow nitrogen gas to flow from a nitrogen gas bottle 62 into a nitrogen introducing passage 61. As a result, nitrogen gas is introduced from the nitrogen gas bottle 62 into the cavity 87 through the nitrogen introducing passage 61.

Figure 14:
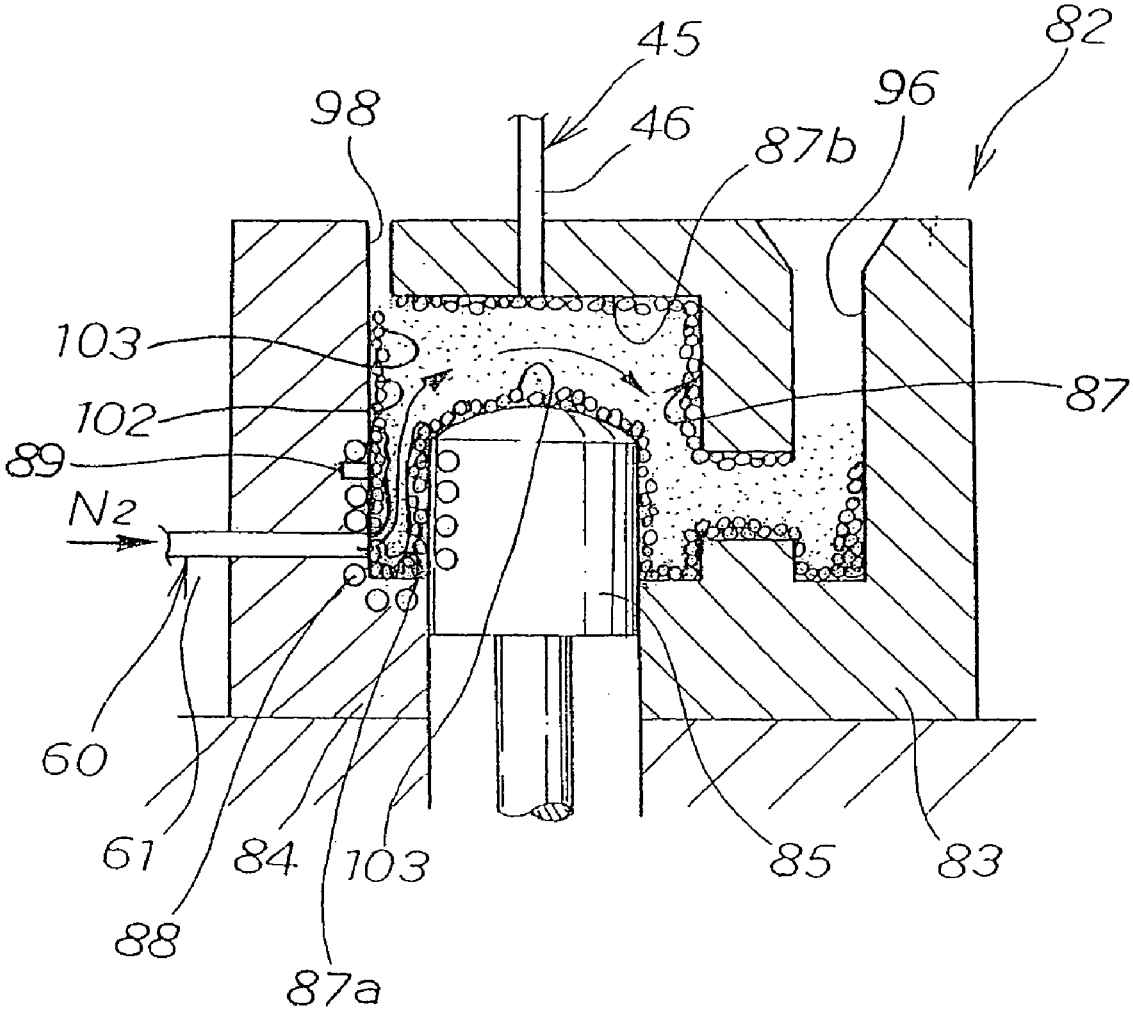
FIG. 14 is a diagram explaining an example in which magnesium nitride is formed in the aluminum casting process according to the second embodiment of this invention.

FIG. 14 is a diagram for explaining an example in which magnesium nitride is formed on the cavity wall in accordance with the aluminum casting process according to the second embodiment of this invention. The wall of the cavity 87 has been heated by the heater (cartridge heater) 88 to, for example, at least 400° C. in the area 87*a* corresponding to the cylinder portion of a cylinder block (portion of small thickness). As a result, the magnesium layer 102 in the area 87*a* corresponding to the cylinder portion (portion of small thickness) and nitrogen gas react with each other and form magnesium nitride ($Mg_3N_2$) 103 on the surface of the magnesium layer 102 in that area. When the area 87*a* corresponding to the cylinder portion (portion of small thickness) is heated to, for example, at least 400° C. by the heater (cartridge heater) 88 as described, the magnesium layer 102 is heated and magnesium nitride 103 can be formed easily. This enables the efficient formation of magnesium nitride 103. After magnesium nitride 103 has been formed on the surface of the magnesium layer 102 in the area 87*a*, the nitrogen valve 63 is switched to its closed position.

For the formation of magnesium nitride 103, the magnesium layer 102 is first formed by magnesium deposited on the wall of the cavity 87, then the area 87*a* corresponding to the cylinder portion (portion of small thickness) is heated, and thereafter nitrogen gas is introduced into the cavity 87, as shown in FIGS. 13 and 14. As a result, magnesium nitride 103 is formed on the surface of the magnesium layer 102. Accordingly, it is possible to form magnesium nitride 103 on only the surface of the magnesium layer 102 and thereby shorten the time required for forming magnesium nitride 103. Moreover, it is possible to reduce the amount of nitrogen gas used, since it is sufficient to form magnesium nitride 103 on only the surface of the magnesium layer 102.

Figure 15A:
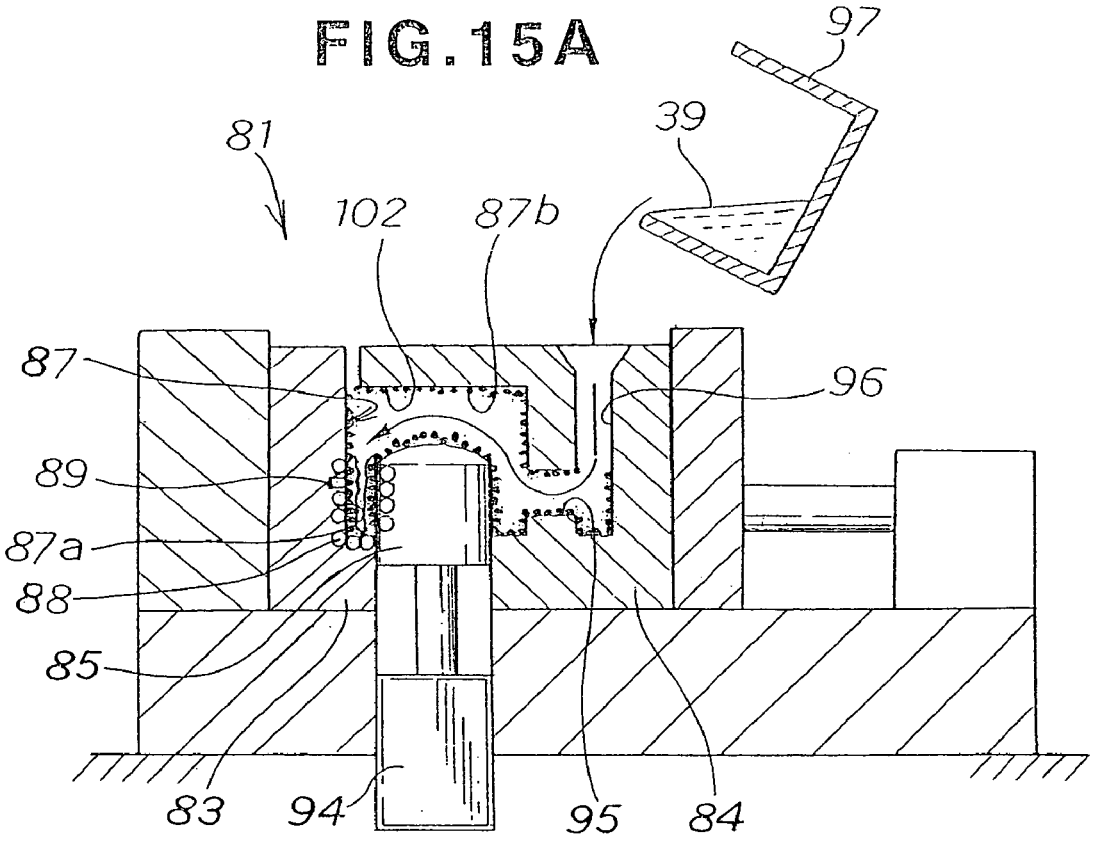
FIGS. 15A and 15B are diagrams explaining the example in which magnesium nitride is formed in the aluminum casting process according to the second embodiment of this invention.

Step ST14 of FIG. 3 will now be explained with reference to FIGS. 15 and 16. FIGS. 15A and 15B are diagrams for explaining an example in which magnesium nitride is formed in accordance with the aluminum casting process according to the second embodiment of this invention. Referring to FIG. 15A, the pouring tank 97 in the casting apparatus proper 81 is tilted to supply molten aluminum 39 of the pouring tank 97 into the cavity 87 through the sprue 96 and the runner 95 as shown by arrows. Generally, molten aluminum 39 flows smoothly if the cavity 87 is a wide space, but it does hot flow smoothly if the cavity 87 is a narrow space. Accordingly, molten aluminum 39 flows smoothly along the area 87*b* of the cavity forming a wide space even if any oxide 39*b* may be formed on the surface 39*a* of molten aluminum 39. On the other hand, any oxide 39*b* formed on the aluminum surface 39*a* makes it difficult for molten aluminum 39 to flow smoothly along the area 87*a* of the cavity forming a narrow space which makes it relatively difficult for molten aluminum 39 to flow. In the area 87*a* of the cavity forming a narrow space, therefore, magnesium nitride 103 is formed on the wall of the cavity 87 to reduce any oxide 39*b* on the molten aluminum 39. This action will be explained with reference to FIG. 15B.

Figure 15B:
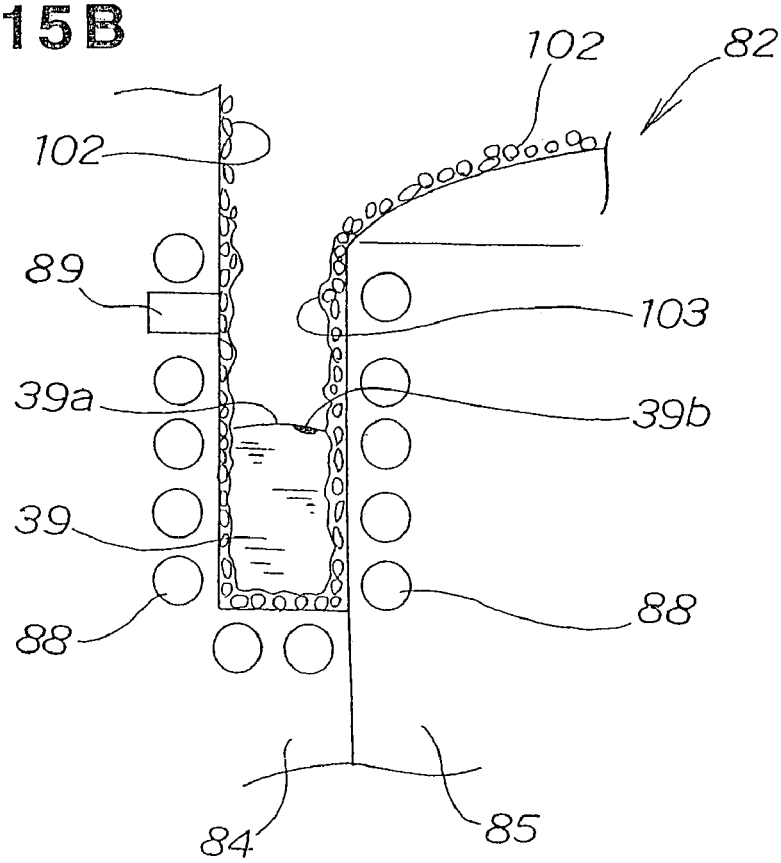

Referring to FIG. 15B, the molten aluminum 39 supplied into the cavity 87 has its surface 39*a* of the molten aluminum 39 contact magnesium nitride 103 upon reaching the area 87*a* corresponding to the cylinder portion of a cylinder block (portion of small thickness). It is likely that any oxide 39*b* may have been formed on the surface 39*a* of molten aluminum 39, and if any oxide 39*b* has been formed, its reaction with magnesium nitride 103 enables the removal of oxygen from the oxide 39*b*. This makes it possible to prevent the formation of any oxide film on the surface 39*a* of molten aluminum 39 and thereby restrain any increase in surface tension of molten aluminum 39. Accordingly, it is possible to maintain a good distribution of molten aluminum 39 along the area 87*a* corresponding to the cylinder portion of a cylinder block (portion of small thickness).

Figure 16A:
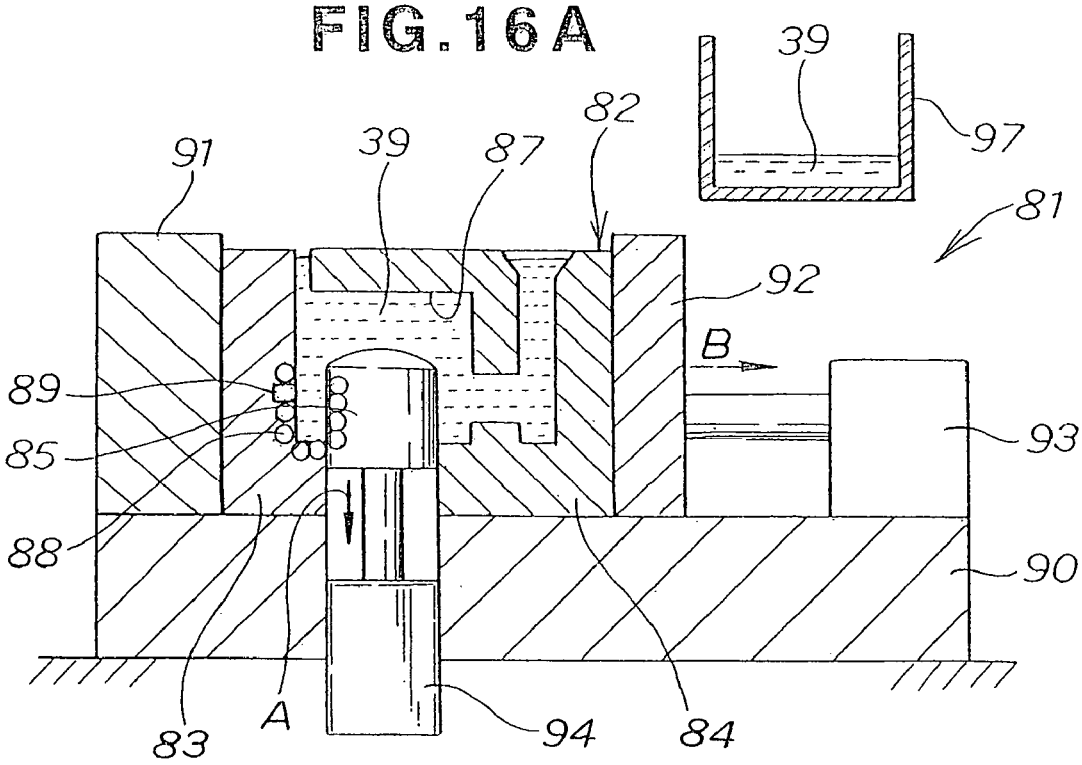
FIGS. 16A and 16B are diagrams explaining an example in which an aluminum casting is molded in the cavity in the aluminum casting process according to the second embodiment of this invention.
Figure 16B:
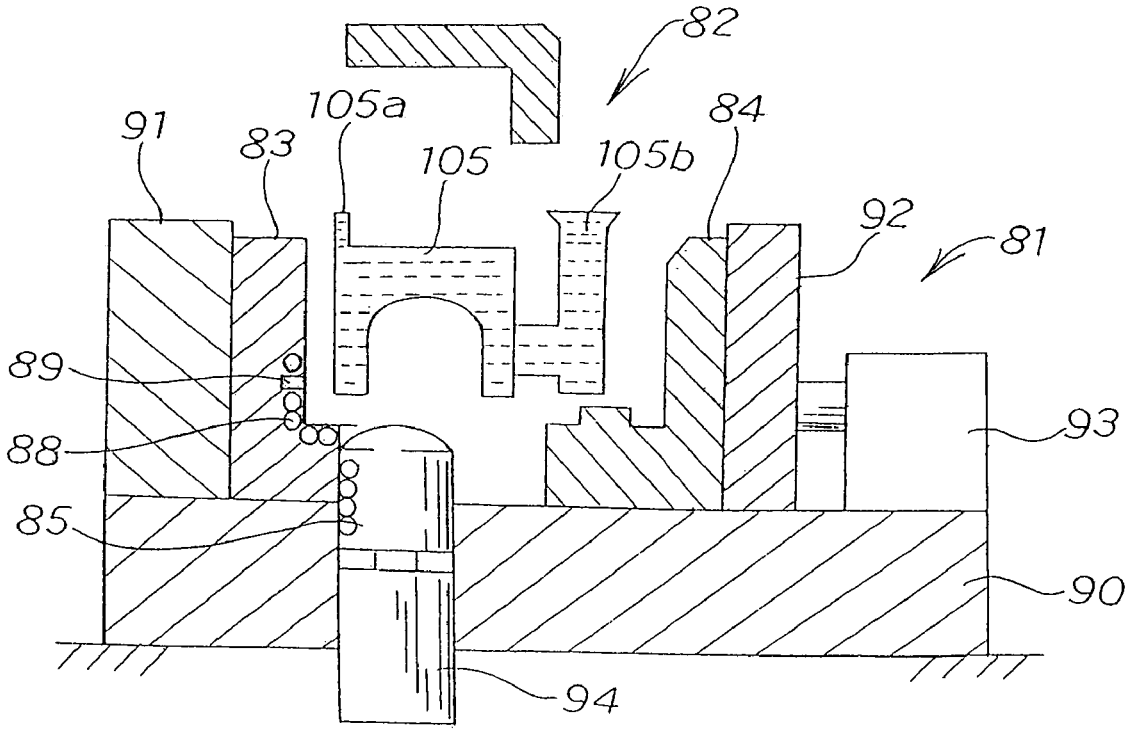

FIGS. 16A and 16B are diagrams for explaining an example in which an aluminum casting is molded in the cavity in accordance with the aluminum casting process according to the second embodiment of this invention. Referring to FIG. 16A, the pouring tank 97 is returned to its horizontal position after a specific amount of molten aluminum 39 has been supplied from the pouring tank 97 into the cavity 87. After molten aluminum 39 has solidified, the core 85 is lowered by the raising and lowering device 94 as shown by an arrow A and the movable mold member 84 is moved by the moving device 93 as shown by an arrow B, so that the casting mold 82 may be opened. Referring to FIG. 16B, the casting mold 82 is opened for the removal of an aluminum casting 105 obtained by the solidification of molten aluminum 39 (shown in FIG. 16A). The aluminum casting 105 is a product of higher quality owing to a good distribution of molten metal as poured. The aluminum casting 105 has its non-product portions 105*a* and 105*b* removed and has its product portion worked on to give an engine cylinder block.

Although the first and second embodiments have been described by the examples in which the wall of the cavity 25 or 87 is heated in the area 25*a* or 87*a* corresponding to the small thickness portion of the casting, those examples are not limitative, but it is also possible to arrange for heating the whole wall surface of the cavity 25 or 87. It is, however, to be noted that it is possible to reduce the amount of nitrogen as required if the area 25*a* or 87*a* corresponding to the small thickness portion of the casting is heated to have magnesium nitride 58*b* or 103 formed in only the area 25*a* or 87*a*.

Description will now be made of the third and fourth embodiments with reference to FIGS. 17 to 31.

Figure 17:
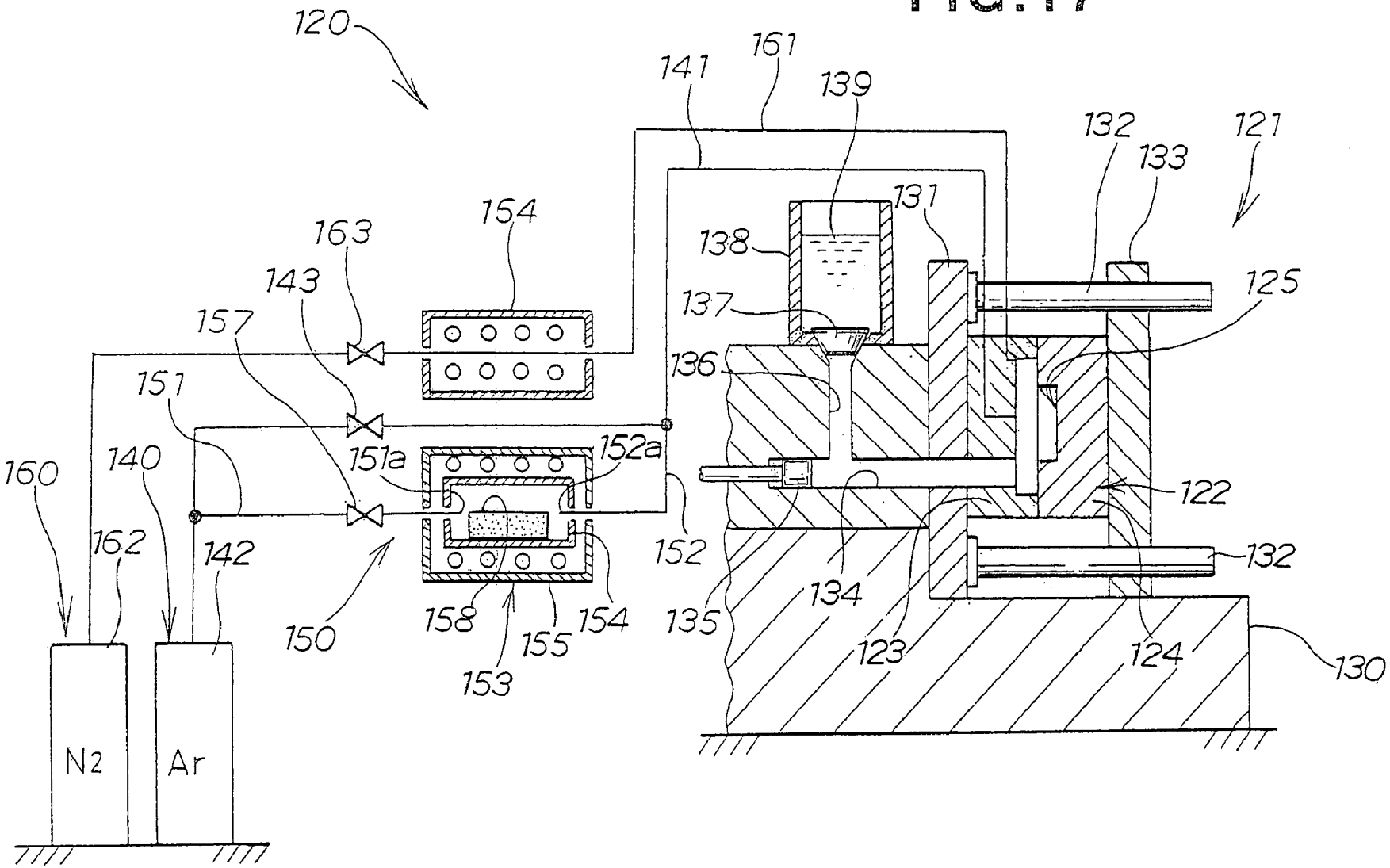
FIG. 17 is an overall diagram showing an aluminum casting apparatus for carrying out the aluminum casting process (third embodiment) using a casting mold and embodying this invention.

Third Embodiment:

FIG. 17 is an overall diagram showing an aluminum casting apparatus for carrying out the aluminum casting process (third embodiment) using a casting mold and embodying this invention. The aluminum casting apparatus 120 has a casting apparatus proper 121 having a casting mold 122, an inert gas introducing portion 140 for introducing argon (Ar) gas (inert (rare) gas) into the cavity 125 defined in the casting mold 122, a magnesium introducing portion 150 for introducing gaseous magnesium (Mg) into the cavity 125 into which the inert gas has been introduced, and a nitrogen gas introducing portion 160 for introducing nitrogen ($N_2$) gas into the cavity 125 into which the gaseous magnesium has been introduced. The casting apparatus proper 121 includes a fixed plate 131 secured to a base 130, the casting mold 122 has a stationary member 123 secured to the fixed plate 131, guide rods 132 are secured to the fixed plate 131, a movable plate 133 is movably supported by the guide rods 132, and the casting mold 122 has a movable member 124 secured to the movable plate 133. A sprue runner 134 opening to the cavity 125 is formed in the stationary member 123 of the mold and the base 130 and holds a movable plunger 135 therein. A sprue 136 is formed vertically from the sprue runner 134 and has an upper end of the sprue 136 closed by a tenon 137, while a pouring tank 138 capable of communicating with the sprue 136 is situated above it. The stationary and movable members 123 and 124 constitute the casting mold 122.

According to the aluminum casting apparatus 120, the movement of the movable plate 133 in the directions of arrows by a moving device (not shown) enables the movable member 124 of the mold to move between a mold closing position (position shown in the drawing) and a mold opening position. The movable member 124 held in its mold closing position enables the stationary and movable members 123 and 124 to form the cavity 125. After molten aluminum 139 is supplied into the cavity 125, it can be pressed by the plunger 135 to mold an aluminum casting in the cavity 125.

The inert gas introducing portion 140 has an argon gas bottle 142 connected to the cavity 125 by an introducing passage 141 provided with an argon valve 143 midway. The argon valve 143 is a valve for switching the introducing passage 141 between its open and closed positions. The argon valve 143 enables argon to be introduced from the argon gas bottle 142 into the cavity 125 through the introducing passage 141 when it is switched to its open position.

The magnesium introducing portion 150 has a first magnesium introducing passage 151 and a second magnesium introducing passage 152 both connected with the introducing passage 141, a sublimating device 153 connected to the first and second magnesium introducing passages 151 and 152 and a magnesium valve 157 provided in the first magnesium introducing passage 151. The sublimating device 153 has a holding case 154 connected with the outlet end 151*a* of the first magnesium introducing passage 151 and the inlet end 152*a* of the second magnesium introducing passage 152 and a sublimating heater 155 surrounding the holding case 154. The sublimating heater 155 can heat the inside of the holding case 154 to a specific temperature (for example, at least 400° C.) and thereby sublimate a magnesium ingot (magnesium) 158 in the holding case 154 into a gaseous form. The magnesium valve 157 is a valve for switching the first magnesium introducing passage 151 between its open and closed positions. The magnesium valve 157 makes it possible to introduce argon gas from the argon gas bottle 142 into the holding case 154 through the first magnesium introducing passage 151 when it is switched to its open position, so that the introduced argon gas may direct gaseous magnesium into the cavity 125 through the second magnesium introducing passage 152 and the introducing passage 141.

The nitrogen introducing portion 160 has a nitrogen gas bottle 162 connected with the cavity 125 through a nitrogen introducing passage 161 provided with a nitrogen valve 163 and a heater 164 midway. The heater 164 can heat nitrogen gas flowing in the nitrogen introducing passage 161 to a specific temperature (for example, at least 400° C.). The nitrogen valve 163 is a valve for switching the nitrogen introducing passage 161 between its open and closed positions. The nitrogen valve 163 makes it possible to introduce nitrogen gas from the nitrogen gas bottle 162 into the cavity 125 through the nitrogen introducing passage 161 when it is switched to its open position.

Figure 18:
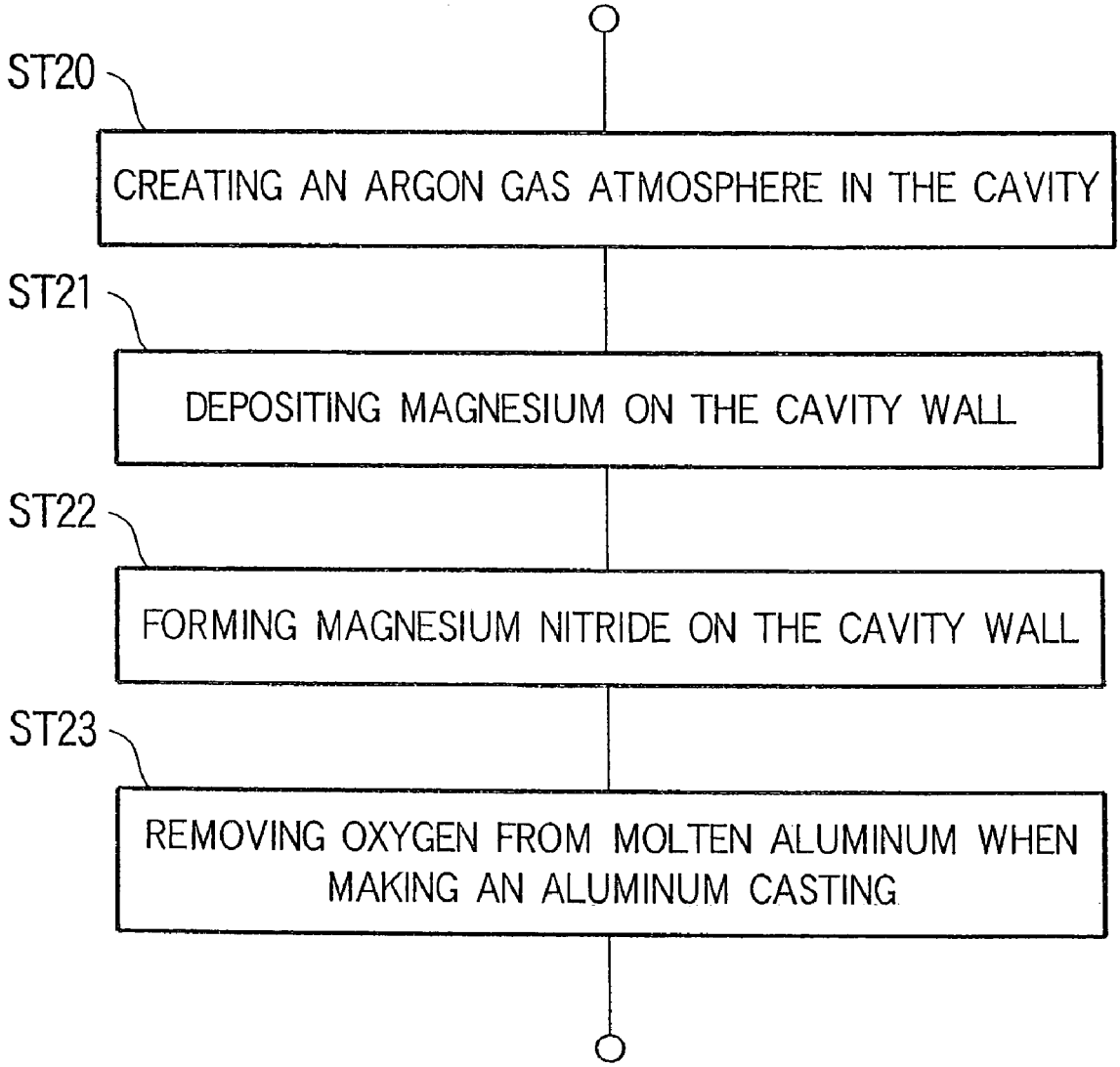
FIG. 18 is a flowchart explaining the aluminum casting process according to the third embodiment of this invention.

Description will now be made of an example in which the casting process according to the third embodiment of this invention is carried out by the aluminum casting apparatus 120. FIG. 18 is a flowchart explaining the aluminum casting process according to the third embodiment of this invention, in which each ST-- indicates Step No.

ST20: The cavity of a closed mold is filled with an inert gas.

ST21: Gaseous magnesium is introduced into the inert gas-filled cavity to have magnesium deposited on the cavity wall.

ST22: Heated nitrogen gas is introduced into the magnesium-deposited cavity to have magnesium nitride formed on the cavity wall.

ST23: Molten aluminum is supplied into the cavity in which magnesium nitride has been formed, to mold an aluminum casting in the cavity, while the surface of molten aluminum is reduced with magnesium nitride.

Figure 19:
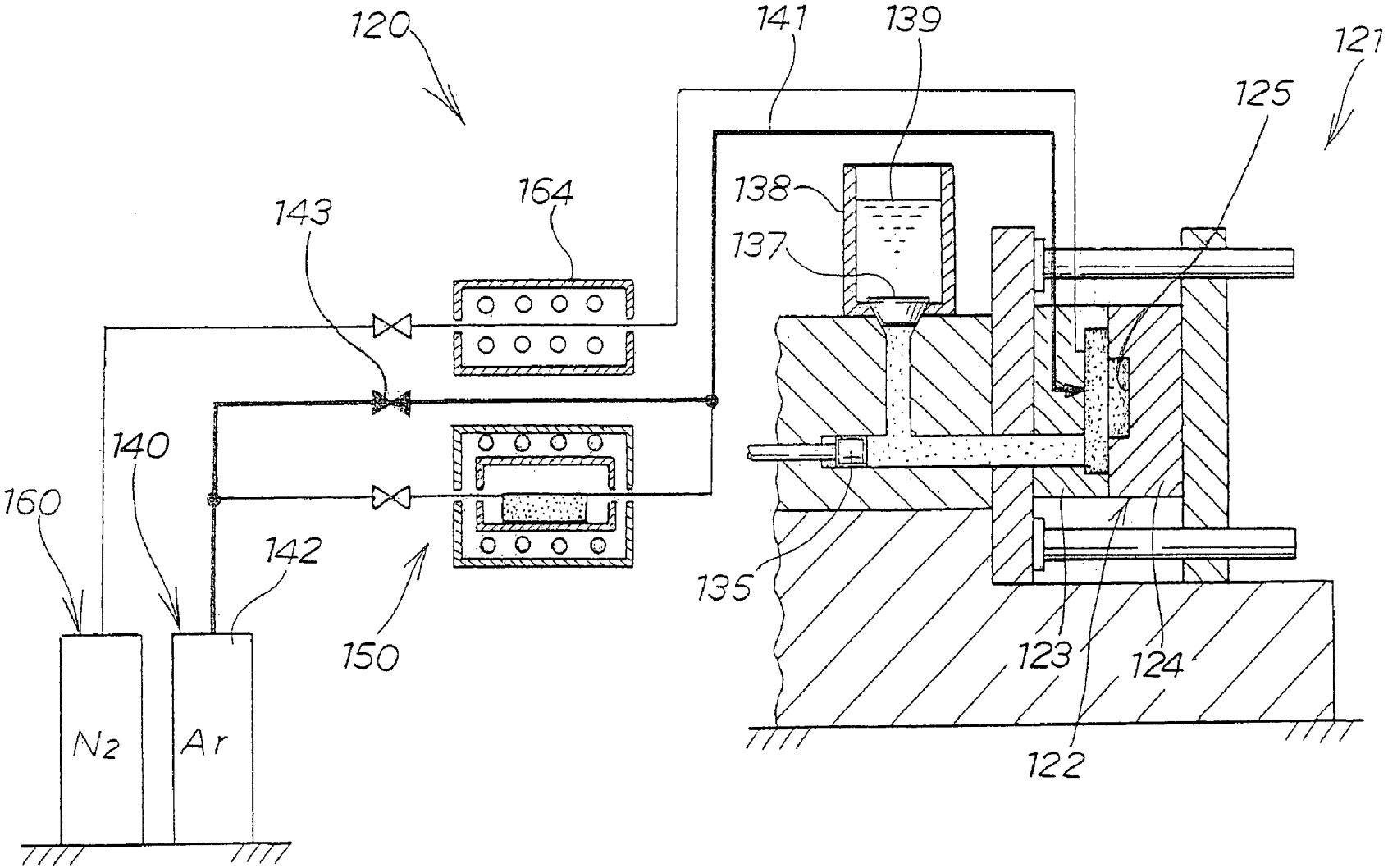
FIG. 19 is a diagram explaining an example in which a cavity is filled with an inert gas in the aluminum casting process according to the third embodiment of this invention.

Steps ST20 to ST23 of the aluminum casting process using a casting mold and embodying this invention will now be described in detail with reference to FIGS. 19 to 25. FIG. 19 is a diagram for explaining an example in which the cavity is filled with an inert gas in accordance with the aluminum casting process according to the third embodiment of this invention, and it shows ST20. The argon valve 143 is switched to its open position to introduce argon gas (shown in dots) from the argon gas bottle 142 into the cavity 125 through the introducing passage 141. The argon gas filling the cavity 125 expels air from the cavity 125 through, for example, any clearance between the stationary and movable members 123 and 124 of the mold. As a result, an argon gas atmosphere is created in the cavity 125. After an argon gas atmosphere is created in the cavity 125, the argon valve 143 is switched to its closed position.

Figure 20:
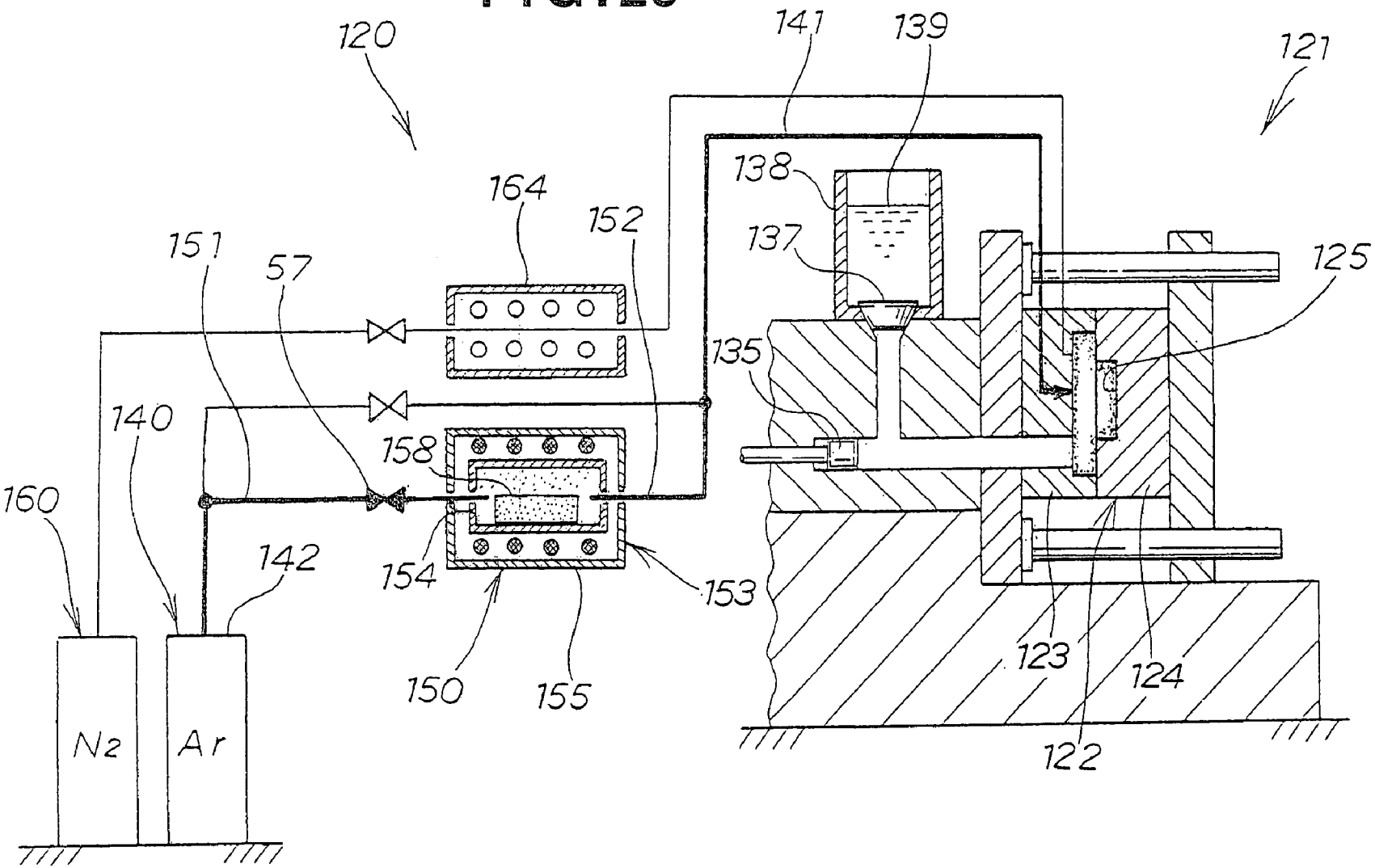
FIG. 20 is a diagram explaining an example in which gaseous magnesium is introduced into the cavity in the aluminum casting process according to the third embodiment of this invention.

FIG. 20 is a diagram for explaining an example in which gaseous magnesium is introduced into the cavity in accordance with the aluminum casting process according to the third embodiment of this invention, and it shows the former half of ST21. The sublimating heater 155 in the sublimating device 153 is placed in operation to heat the inside of the holding case 154 to a specific temperature (for example, at least 400° C.). The heating of the inside of the holding case 154 causes the sublimation of the magnesium ingot 158 into a gaseous form. The gaseous magnesium in the holding case 154 is shown in dots. The magnesium valve 157 is switched to its open position so that argon gas may be introduced from the argon gas bottle 142 into the holding case 154 through the first magnesium introducing passage 151. The introduced argon gas causes gaseous magnesium (shown in dots) to be introduced into the cavity 125 through the second magnesium introducing passage 152 and the introducing passage 141. When gaseous magnesium is introduced into the cavity 125, the second magnesium introducing passage 152 and the introducing passage 141 are preferably heated so that no magnesium may be deposited in the second magnesium introducing passage 152 or the introducing passage 141.

Figure 21:
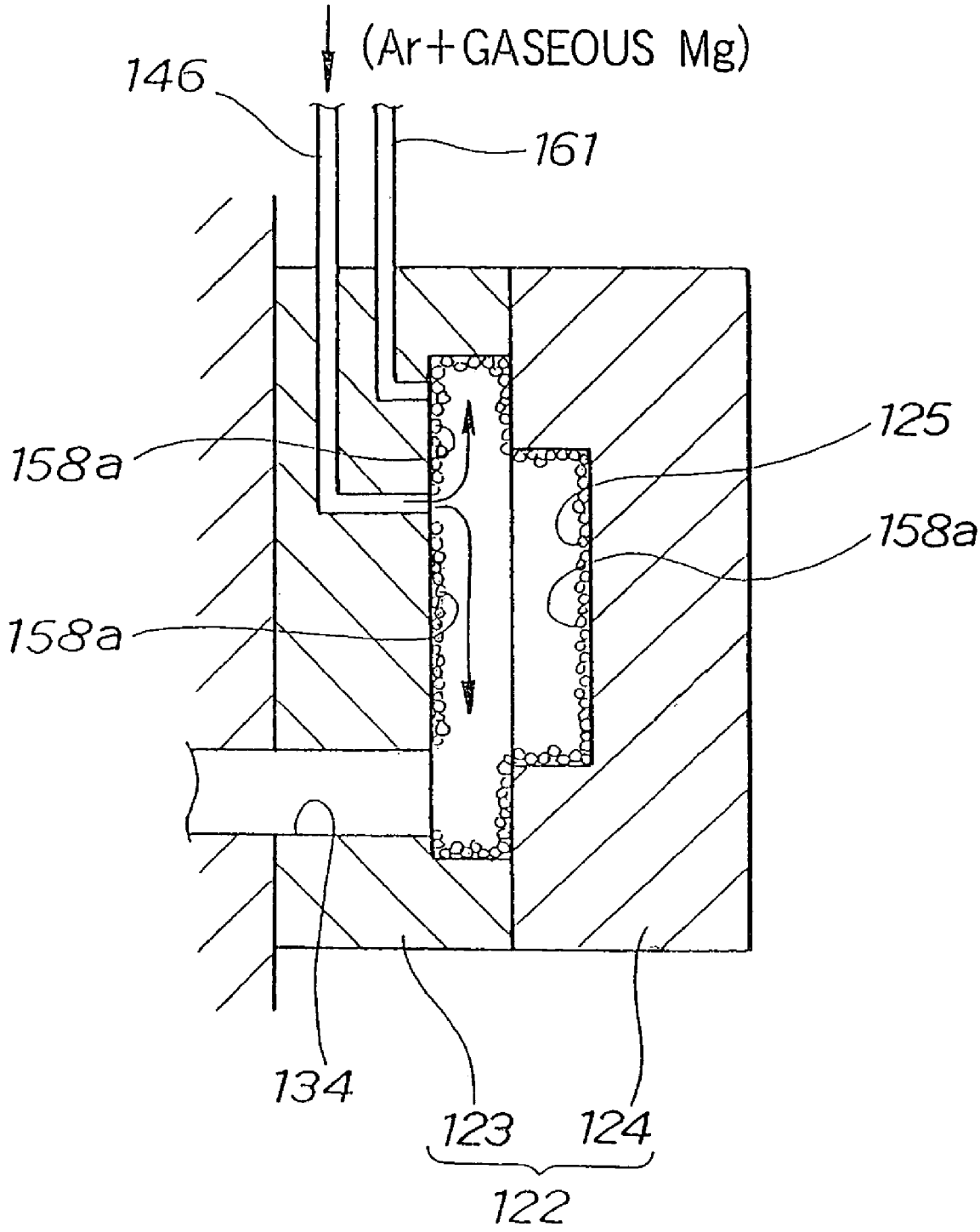
FIG. 21 is a diagram explaining an example in which gaseous magnesium is deposited on the cavity wall in the aluminum casting process according to the third embodiment of this invention.

FIG. 21 is a diagram for explaining an example in which gaseous magnesium is deposited on the cavity wall in accordance with the aluminum casting process according to the third embodiment of this invention, and it shows the latter half of ST21. The gaseous magnesium introduced into the cavity 125 as shown by arrows has its temperature lowered to 150 to 250° C. by contacting the wall of the cavity 125. Its drop in temperature to 150 to 250° C. causes gaseous magnesium to be deposited on the wall of the cavity 125. The deposited magnesium is called a magnesium layer 158*a*. After the deposition of the magnesium layer 158*a* on the wall of the cavity 125, the magnesium valve 157 (shown in FIG. 20) is switched to its closed position.

Figure 22:
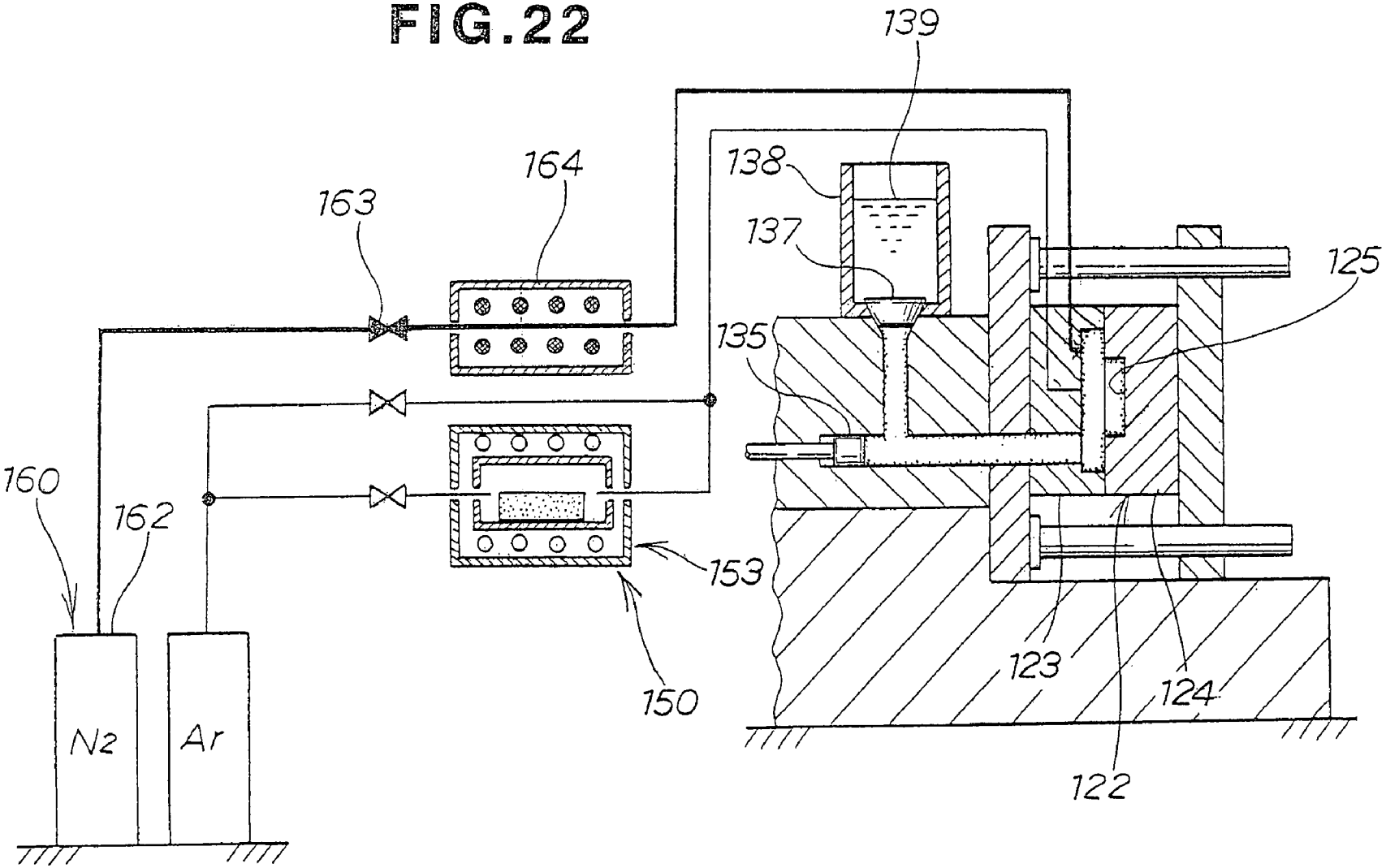
FIG. 22 is a diagram explaining an example in which nitrogen gas is introduced into the cavity in the aluminum casting process according to the third embodiment of this invention.

FIG. 22 is a diagram for explaining an example in which nitrogen gas is introduced into the cavity in accordance with the aluminum casting process according to the third embodiment of this invention, and it shows ST22. The heater 64 in the nitrogen gas introducing portion 60 is placed in operation and the nitrogen valve 63 is switched to its open position. The nitrogen valve 63 switched to its open position allows nitrogen gas to flow from the nitrogen gas bottle 62 into the nitrogen introducing passage 61. As a result, the nitrogen gas in the nitrogen gas introducing passage 16 is heated by the heater 64 and the heated nitrogen gas is introduced into the cavity 25 through the nitrogen introducing passage 61. The independent heating of nitrogen gas by the heater 164 makes it possible to heat nitrogen gas flowing in the nitrogen introducing passage 161 efficiently to a specific temperature (for example, at least 400° C.).

Figure 23:
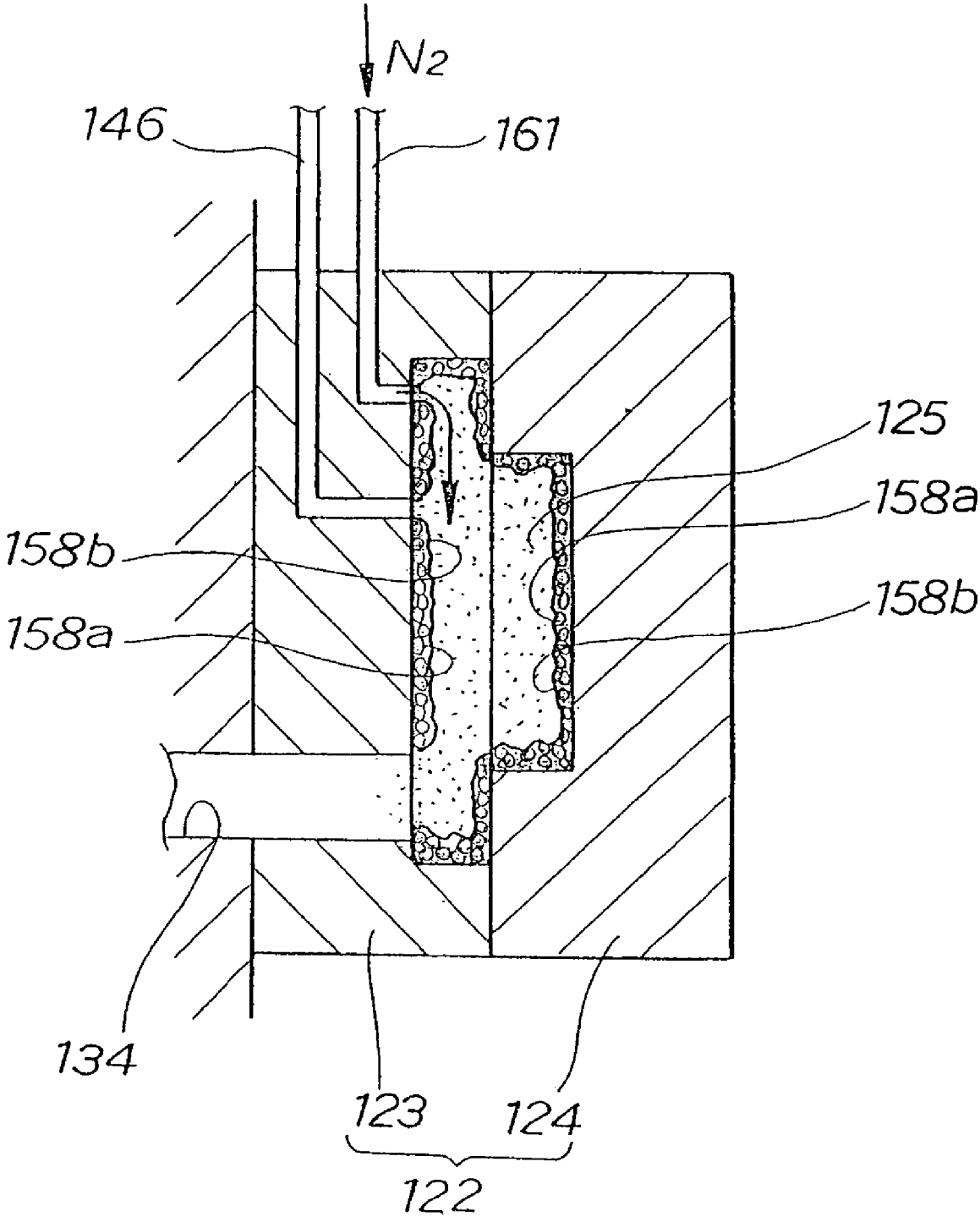
FIG. 23 is a diagram explaining an example in which magnesium nitride is formed in the aluminum casting process according to the third embodiment of this invention.

FIG. 23 is a diagram for explaining an example in which magnesium nitride is formed in accordance with the aluminum casting process according to the third embodiment of this invention.

The temperature T (° C.) of gas in the cavity 125 and the pressure P (atmosphere) in the cavity 125 are so selected as to maintain their relationship $T \geqq (130 \times P + 270)$. If this condition is met, it is possible to have magnesium-nitride ($Mg_3N_2$) 158*b* formed on the surface of the magnesium layer 158*a* by the reaction of the magnesium layer 158*a* deposited on the wall of the cavity 125 and nitrogen gas. More specifically, their relationship $T \geqq (130 \times P + 270)$ teaches that when the pressure P in the cavity 125 is, for example, 1 atmosphere, the temperature T of nitrogen gas in the cavity 125 may be set at 400° C. for forming magnesium nitride 158*b* on the surface of the magnesium layer 158*a*. As the temperature T (° C.) of nitrogen gas in the cavity 125 and the pressure P (atmosphere) in the cavity 125 are relatively easy to determine based on their relationship $T \geqq (130 \times P + 270)$, it is possible to perform the adjustment of equipment within a short time. Moreover, nitrogen gas is heated and heated nitrogen gas is used for forming magnesium nitride 158*b*. This makes it possible to form magnesium nitride 158*b* efficiently, as it is possible to heat nitrogen gas to a temperature at which magnesium nitride 158*b* is easy to form. The nitrogen valve 163 is switched to its closed position after magnesium nitride 158*b* has been formed on the surface of the magnesium layer 158*a*.

For the formation of magnesium nitride 158*b*, the magnesium layer 158*a* is first formed by magnesium deposited on the wall of the cavity 125 and then, nitrogen gas is introduced into the cavity 125 to form magnesium nitride 158*b* on the surface of the magnesium layer 158*a*, as described with reference to FIGS. 21 and 23. Accordingly, it is possible to form magnesium nitride 158*b* on only the surface of the magnesium layer 158*a* and thereby shorten the time required for forming magnesium nitride 158*b*. Moreover, it is possible to reduce the amount of nitrogen gas used, since it is sufficient to form magnesium nitride 158*b* on only the surface of the magnesium layer 158*a*.

Figure 24A:
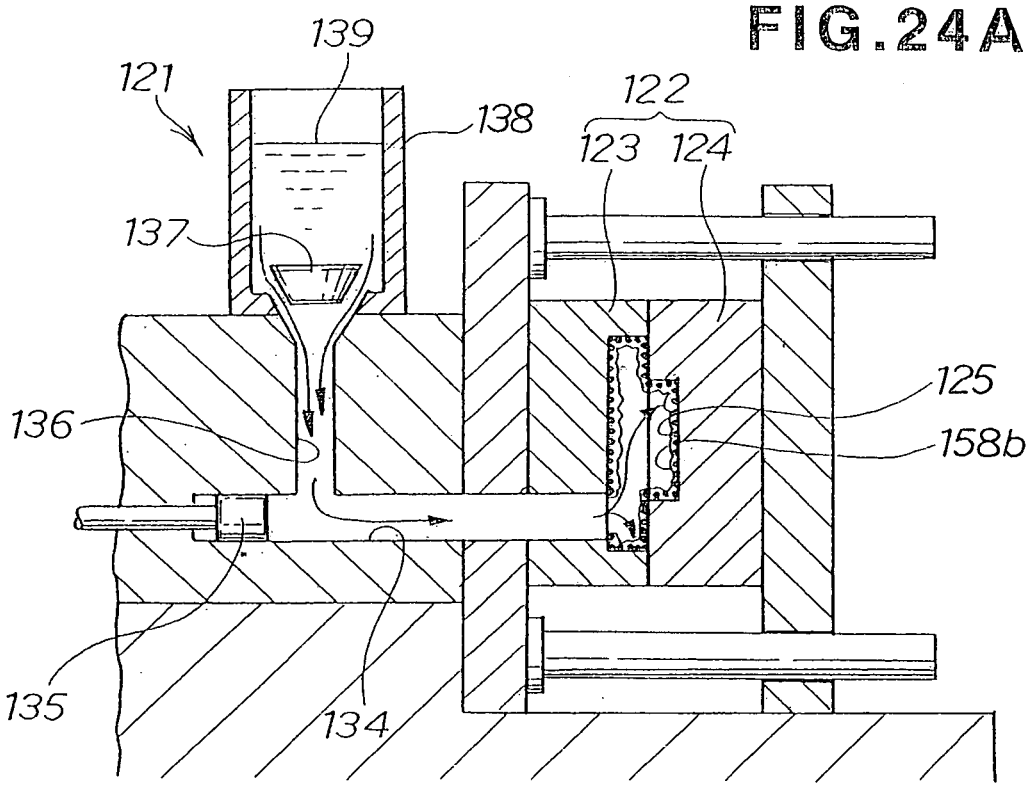
FIGS. 24A and 24B are diagrams explaining the example in which molten aluminum is supplied into the cavity in the aluminum casting process according to the third embodiment of this invention.
Figure 24B:
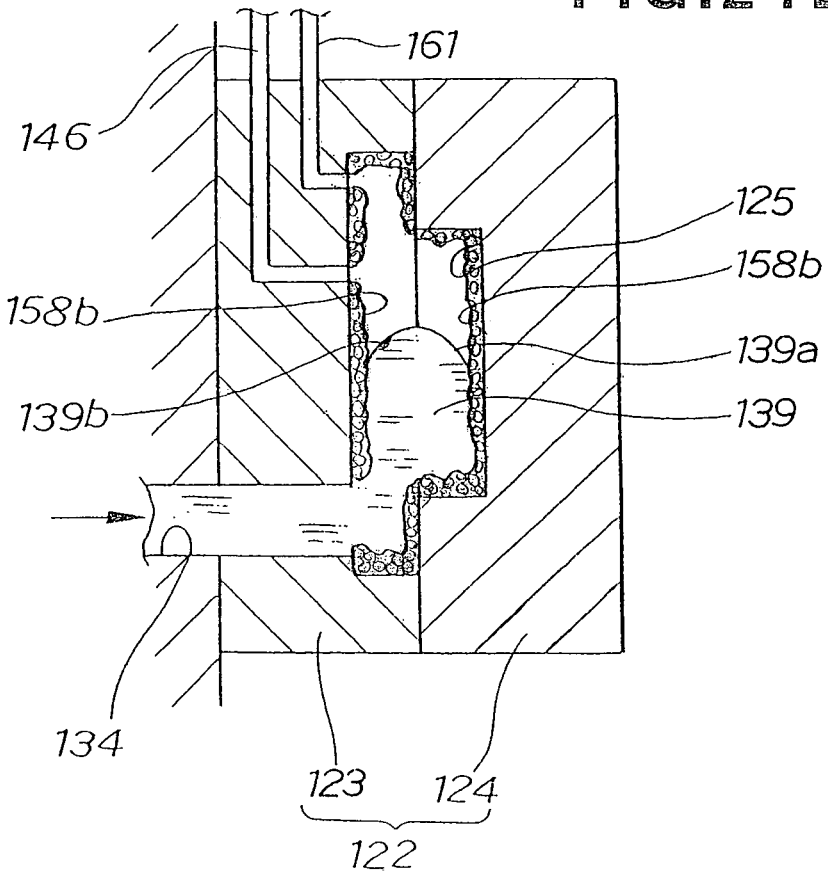

FIGS. 24A and 24B are diagrams for explaining an example in which molten aluminum is supplied into the cavity in accordance with the aluminum casting process according to the third embodiment of this invention, and they show the former half of ST23. Referring to FIG. 24A, the tenon 137 in the casting apparatus proper 121 is operated to open the sprue 136, so that molten aluminum 139 may be supplied from the pouring tank 138 into the cavity 125 through the sprue 136 and the runner 134 as shown by arrows. Referring to FIG. 24B, the molten aluminum 139 supplied into the cavity 125 has its surface 139*a* contact magnesium nitride 158*b*. It is likely that any oxide 139*b* may have been formed on the surface 139*a* of molten aluminum 139, and if any oxide 139*b* has been formed, its reaction with magnesium nitride 158*b* enables the removal of oxygen from the oxide 139*b*. This makes it possible to prevent the formation of any oxide film on the surface 139*a* of molten aluminum 139 and thereby restrain any increase in surface tension of molten aluminum 139. Accordingly, it is possible to maintain a good distribution of molten aluminum 139 in the cavity 125.

Figure 25A:
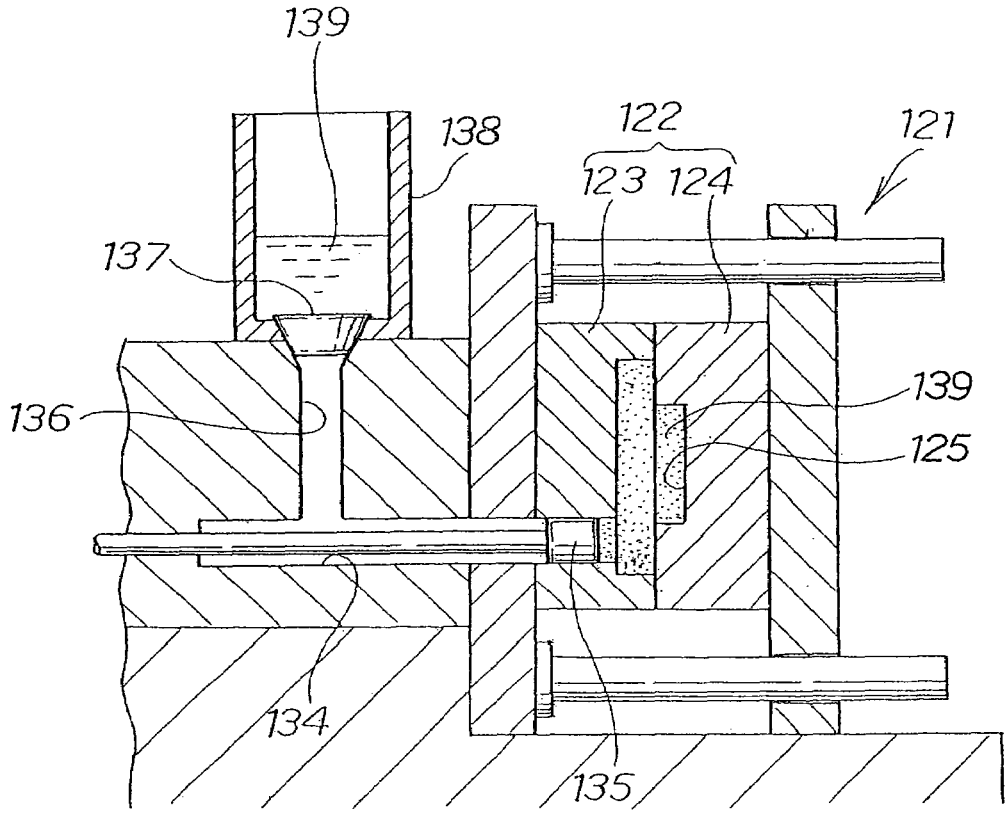
FIGS. 25A and 25B are diagrams explaining an example in which an aluminum casting is molded in the aluminum casting process according to the third embodiment of this invention.
Figure 25B:
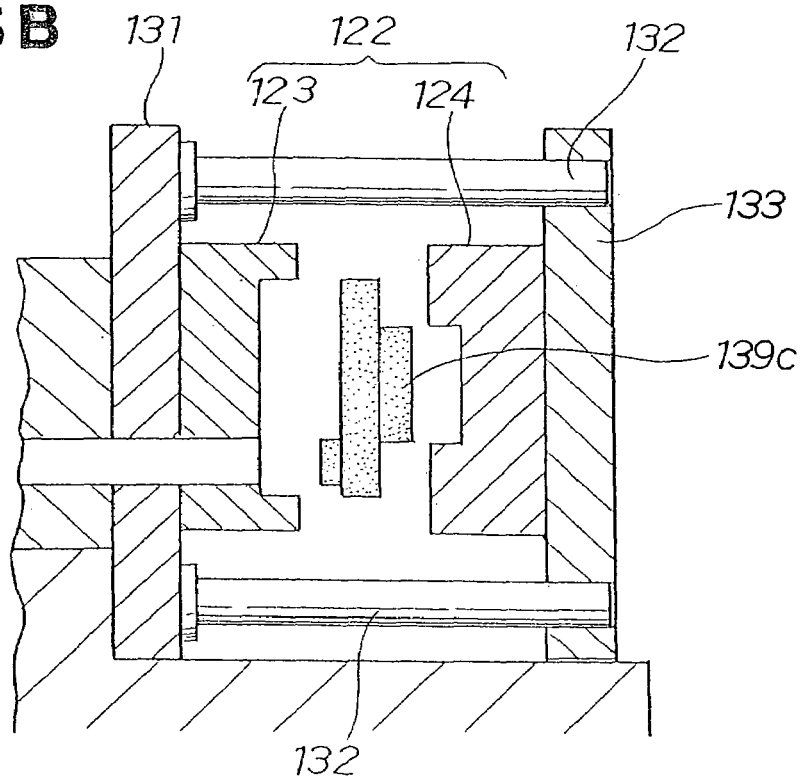

FIGS. 25A and 25B are diagrams for explaining an example in which an aluminum casting is molded in accordance with the aluminum casting process according to the third embodiment of this invention, and they show the latter half of ST23. Referring to FIG. 25A, the sprue 136 is closed by the tenon 137 after a specific amount of molten aluminum 139 has been supplied from the pouring tank 138 to the cavity 125. The plunger 135 is pushed forward toward the cavity 125 to fill the cavity 125 with molten aluminum 139. Referring to FIG. 25B, the casting mold 122 is opened for the removal of an aluminum casting 139*c* obtained by the solidification of molten aluminum 139 (shown in FIG. 25A). The aluminum casting 139*c* is a product of higher quality owing to a good distribution of molten metal as poured. The aluminum casting 139*c* is worked on to make the disk rotor 10 shown in FIG. 1.

Fourth Embodiment:

Description will now be made of the fourth embodiment with reference to FIGS. 26 to 31. The reference numerals used for the third embodiment are used to denote like parts or materials for the fourth embodiment and no repeated description thereof is made.

Figure 26:
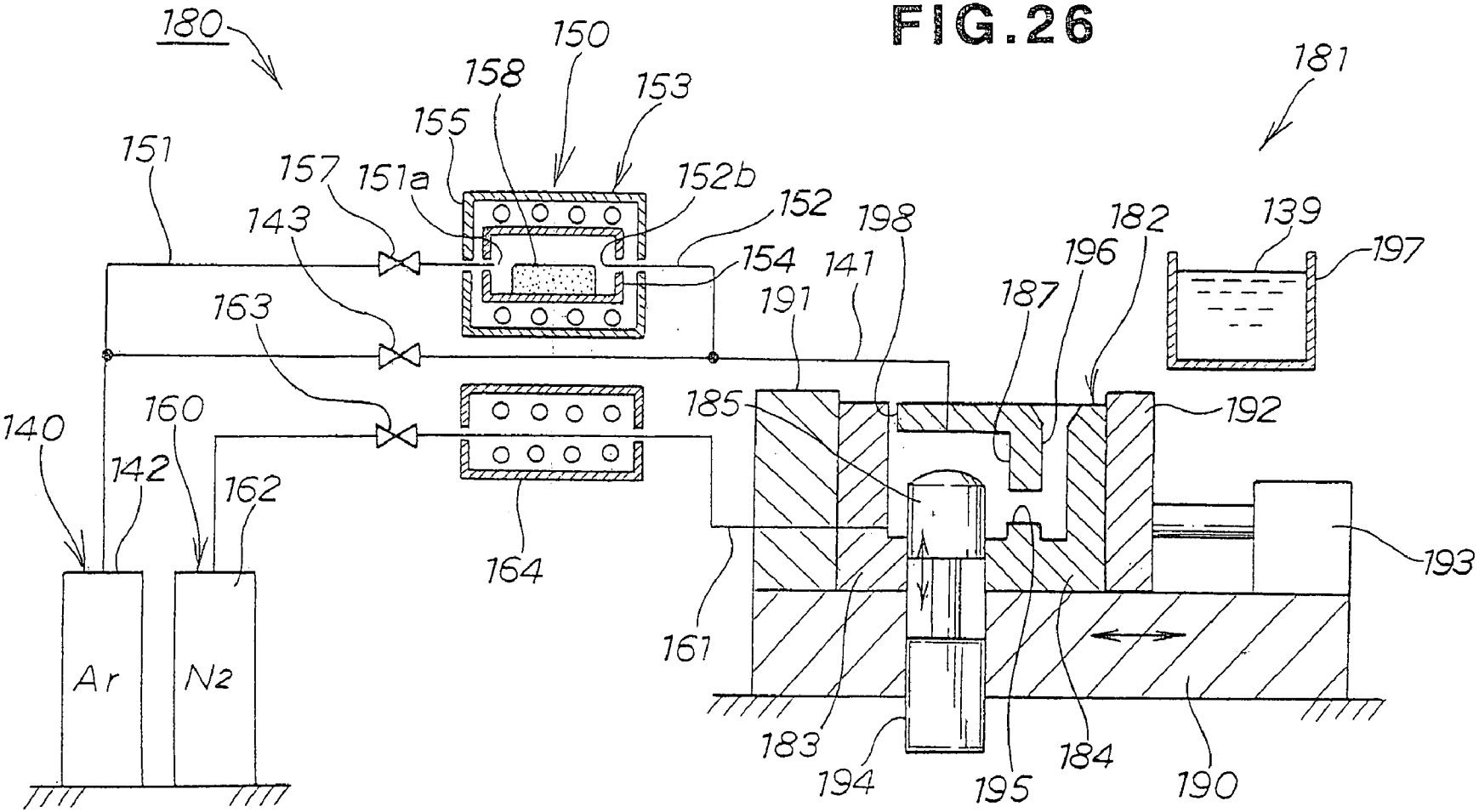
FIG. 26 is an overall diagram showing an aluminum casting apparatus for carrying out the aluminum casting process (fourth embodiment) using a casting mold and embodying this invention.

FIG. 26 is an overall diagram showing an aluminum casting apparatus for carrying out the aluminum casting process (fourth embodiment) using a casting mold and embodying this invention. The aluminum casting apparatus 180 has a casting apparatus proper 181 having a casting mold 182, an inert gas introducing portion 140 for introducing argon (Ar) gas (inert (rare) gas) into the cavity 187 defined in the casting mold 182, a magnesium introducing portion 150 for introducing gaseous magnesium (Mg) into the cavity 187 into which the inert gas has been introduced, and a nitrogen gas introducing portion 160 for introducing heated nitrogen ($N_2$) gas into the cavity 187 into which the gaseous magnesium has been introduced. The casting apparatus proper 181 includes a fixed plate 191 secured to a base 190, a stationary mold member 183 is secured to the fixed plate 191, a movable plate 192 is movably mounted on the base 190, a movable mold member 84 is secured to the movable plate 192, a device 193 for moving the movable plate 192 is mounted on the base 190 and a core 185 for the casting mold 182 is supported by the base 190 so as to be capable of being raised and lowered by a raising and lowering device 194. A sprue runner 195 opening to the cavity 187 is formed in the movable mold member 184, a sprue 196 is formed vertically from the sprue runner 195, while a pouring tank 197 holding molten aluminum 139 is situated above the sprue 196, and the casting mold 182 has an opening 198 formed at its top as a vent or feeder head. The stationary and movable mold members 183 and 184 and the core 185 constitute the casting mold 182. While FIG. 26 shows the sprue 196 and the opening 198 as being large relative to the cavity 187 to provide an easier understanding of the casting apparatus proper 181, the real sprue 196 and opening 198 are sufficiently small relative to the cavity 187 to enable the cavity 187 to keep a substantially completely closed state when the casting mold 182 is closed.

According to the aluminum casting apparatus 180, the movement of the movable plate 192 in the directions of arrows by the moving device 193 enables the movable mold member 184 to move between its mold closing position (position shown in the drawing) and its mold opening position. The movement of the core 185 in the directions of arrows by the raising and lowering device 194 enables the core 185 to move between its mold closing position (position shown in the drawing) and its mold opening position. The movable mold member 184 and the core 185 held in their mold closing positions enable the stationary and movable mold members 183 and 184 and the core 185 to form the cavity 187. If molten aluminum 139 is supplied into the cavity 187, it is possible to mold an aluminum casting in the cavity 187.

The casting apparatus proper 181 differs from the casting apparatus proper 121 according to the third embodiment in that it is so constructed as to allow molten aluminum 139 to flow into the cavity 187 by its own weight at the atmospheric pressure.

Figure 27:
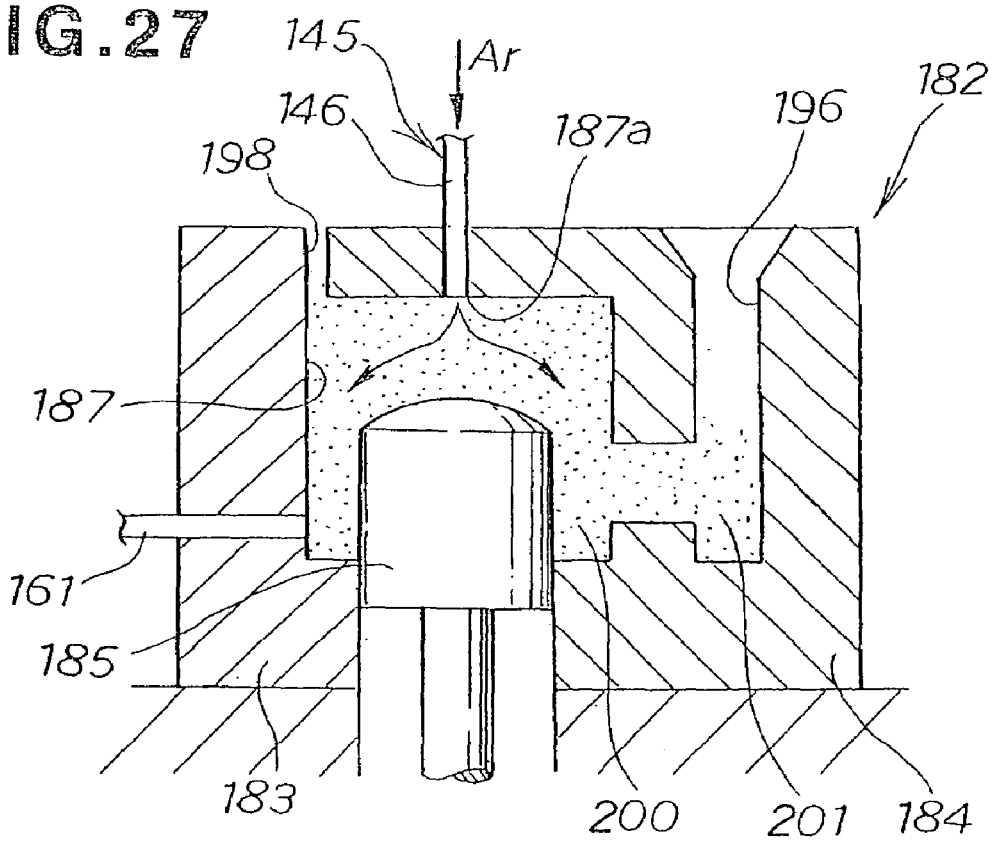
FIG. 27 is a diagram explaining an example in which an argon gas atmosphere is created in a cavity in the aluminum casting process according to the fourth embodiment of this invention.

An example in which the casting process according to the fourth embodiment of this invention is carried out by the aluminum casting apparatus 180 will now be described with reference to FIGS. 18 and 26 to 31. The step ST20 of FIG. 18 will first be explained. The argon valve 143 shown in FIG. 26 is switched to its open position to introduce argon gas from an argon gas bottle 142 into the cavity 187 through an introducing passage 141. FIG. 27 is a diagram for explaining an example in which an argon gas atmosphere is created in the cavity in accordance with the aluminum casting process according to the fourth embodiment of this invention. The argon gas filling the cavity 187 expels air from the cavity 187 through, for example, the sprue 196 or the vent or feeder head opening 198. As a result, an argon gas atmosphere is created in the cavity 187. After an argon gas atmosphere is created in the cavity 187, the argon valve 143 (shown in FIG. 26) is switched to its closed position.

The step ST21 of FIG. 18 will now be explained. Returning to FIG. 26, a sublimating heater 155 in a sublimating device 153 is placed in operation to heat the inside of a holding case 154 to a specific temperature (for example, at least 400° C.). The heating of the inside of the holding case 154 causes the sublimation of a magnesium ingot 158 into a gaseous form. A magnesium valve 157 is switched to its open position so that argon gas may be introduced from the argon gas bottle 142 into the holding case 154 through a first magnesium introducing passage 151. The introduced argon gas causes gaseous magnesium to be introduced into the cavity 187 through a second magnesium introducing passage 152 and the introducing passage 141. When gaseous magnesium is introduced into the cavity 187, the second magnesium introducing passage 152 and the introducing passage 141 are preferably heated so that no magnesium may be deposited in the second magnesium introducing passage 152 or the introducing passage 141.

Figure 28:
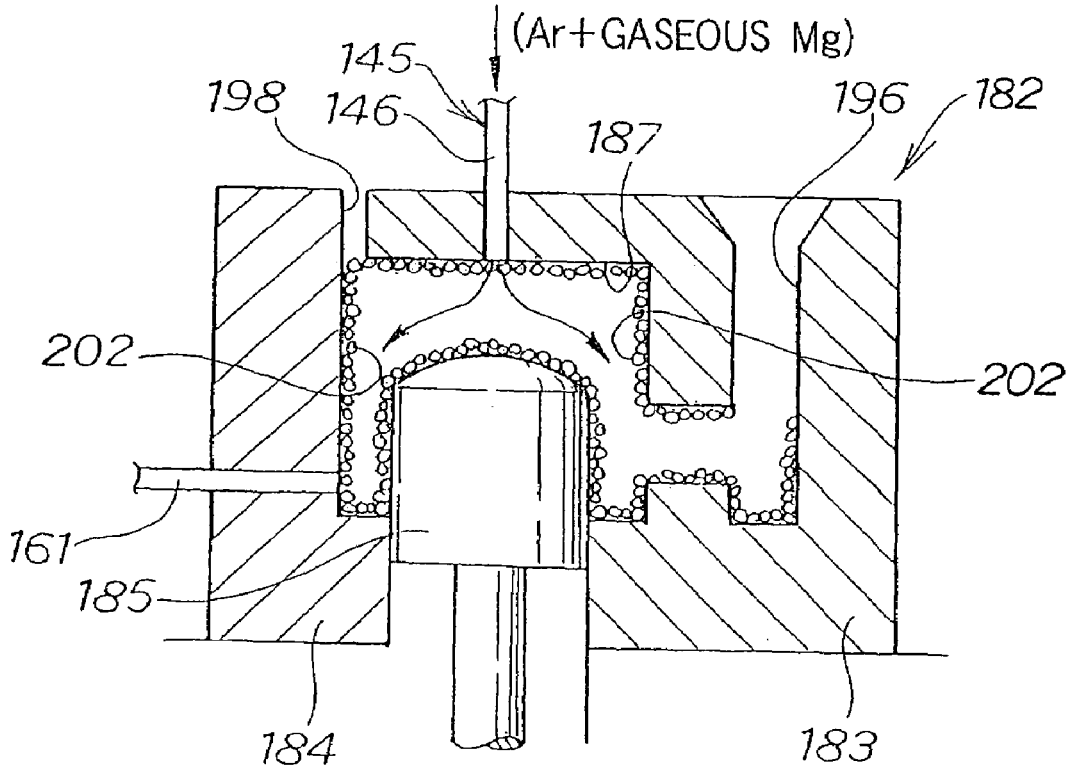
FIG. 28 is a diagram explaining an example in which magnesium is deposited on the cavity wall in the aluminum casting process according to the fourth embodiment of this invention.

FIG. 28 is a diagram for explaining an example in which magnesium is deposited on the cavity wall in accordance with the aluminum casting process according to the fourth embodiment of this invention. The gaseous magnesium introduced into the cavity 187 as shown by arrows has its temperature lowered to 150 to 250° C. by contacting the wall of the cavity 187. Its drop in temperature to 150 to 250° C. causes gaseous magnesium to be deposited on the wall of the cavity 187. The deposited magnesium is called a magnesium layer 202. After the deposition of the magnesium layer 202 on the wall of the cavity 187, the magnesium valve 157 (shown in FIG. 26) is switched to its closed position.

Step ST22 of FIG. 18 will now be explained. The heater 164 in the nitrogen gas introducing portion 160 shown in FIG. 26 is heated and the nitrogen valve 163 is switched to its open position. This enables nitrogen gas to flow from the nitrogen gas bottle 162 into the nitrogen introducing passage 161. As a result, the nitrogen gas in the nitrogen gas introducing passage 161 is heated by the heater 164 and the heated nitrogen gas is introduced into the cavity 187 through the nitrogen introducing passage 161. The independent heating of nitrogen gas by the heater 164 makes it possible to heat nitrogen gas flowing in the nitrogen introducing passage 161 efficiently to a specific temperature (for example, at least 400° C.).

Figure 29:
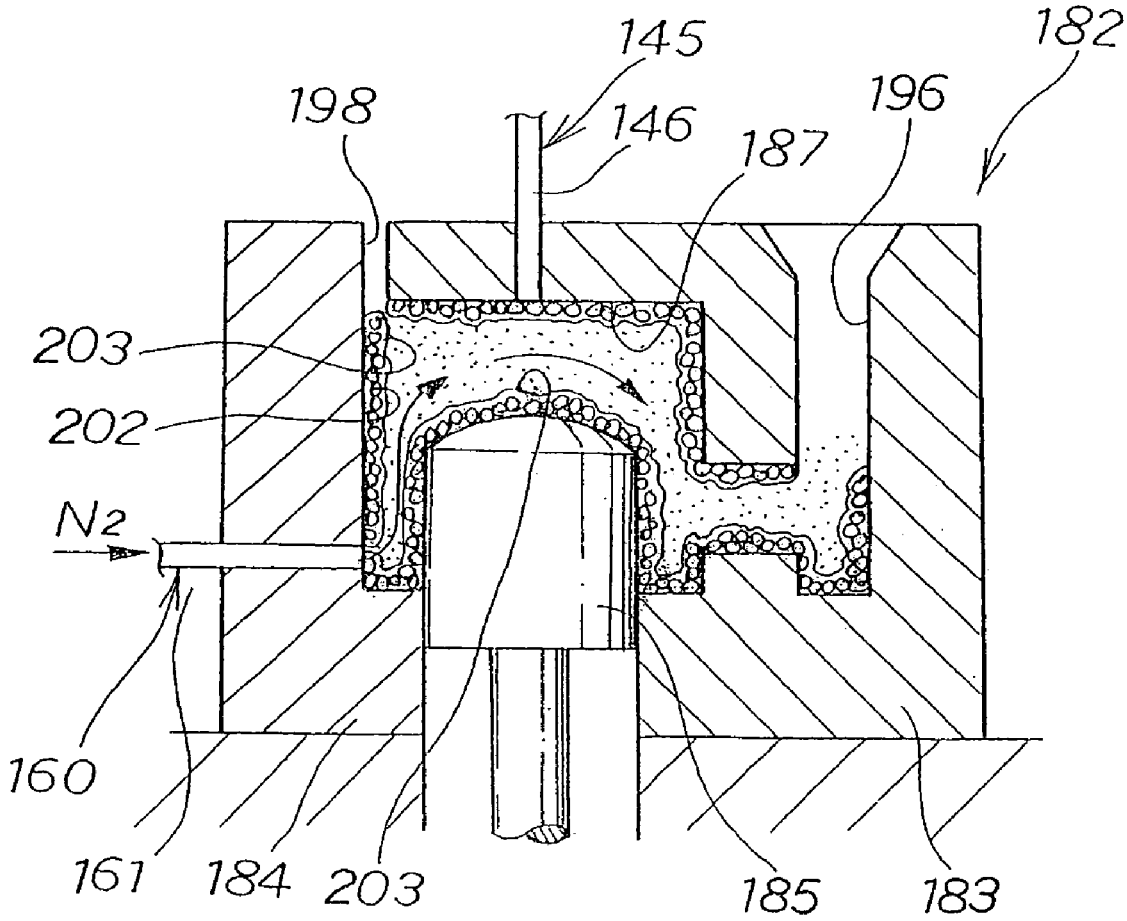
FIG. 29 is a diagram explaining an example in which magnesium nitride is formed on the cavity wall in the aluminum casting process according to the fourth embodiment of this invention.

FIG. 29 is a diagram for explaining an example in which magnesium nitride is formed on the cavity wall in accordance with the aluminum casting process according to the fourth embodiment of this invention. The temperature T (° C.) of nitrogen gas (shown in dots) in the cavity 187 and the pressure P (atmosphere) in the cavity 187 are so selected as to maintain their relationship $T \geqq (130 \times P + 270)$. If this condition is met, it is possible to have magnesium nitride 203 formed on the surface of the magnesium layer 202 by the reaction of the magnesium layer 202 deposited on the wall of the cavity 187 and the nitrogen gas. More specifically, their relationship T≧(130×P+270) teaches that when the pressure Pin the cavity 187 is, for example, 1 atmosphere, the temperature T of nitrogen gas in the cavity 187 may be set at 400° C. for forming magnesium nitride 203 on the surface of the magnesium layer 202. As the temperature T of nitrogen gas in the cavity 187 and the third pressure P are relatively easy to determine based on their relationship T≧(130×P+270), it is possible to perform the adjustment of equipment within a short time. Moreover, nitrogen gas is heated and heated nitrogen gas is used for forming magnesium nitride 203. This makes it possible to form magnesium nitride 203 efficiently, as it is possible to heat nitrogen gas to a temperature at which magnesium nitride 203 is easy to form. The nitrogen valve 163 (shown in FIG. 26) is switched to its closed position after magnesium nitride 203 has been formed on the surface of the magnesium layer 202.

For the formation of magnesium nitride 203, the magnesium layer 202 is first formed by magnesium deposited on the wall of the cavity 187 and then, nitrogen gas is introduced into the cavity 187 to form magnesium nitride 203 on the surface of the magnesium layer 202, as shown in FIGS. 28 and 29. Accordingly, it is possible to form magnesium nitride 203 on only the surface of the magnesium layer 202 and thereby shorten the time required for forming magnesium nitride 203. Moreover, it is possible to reduce the amount of nitrogen gas used, since it is sufficient to form magnesium nitride 203 on only the surface of the magnesium layer 202.

Figure 30A:
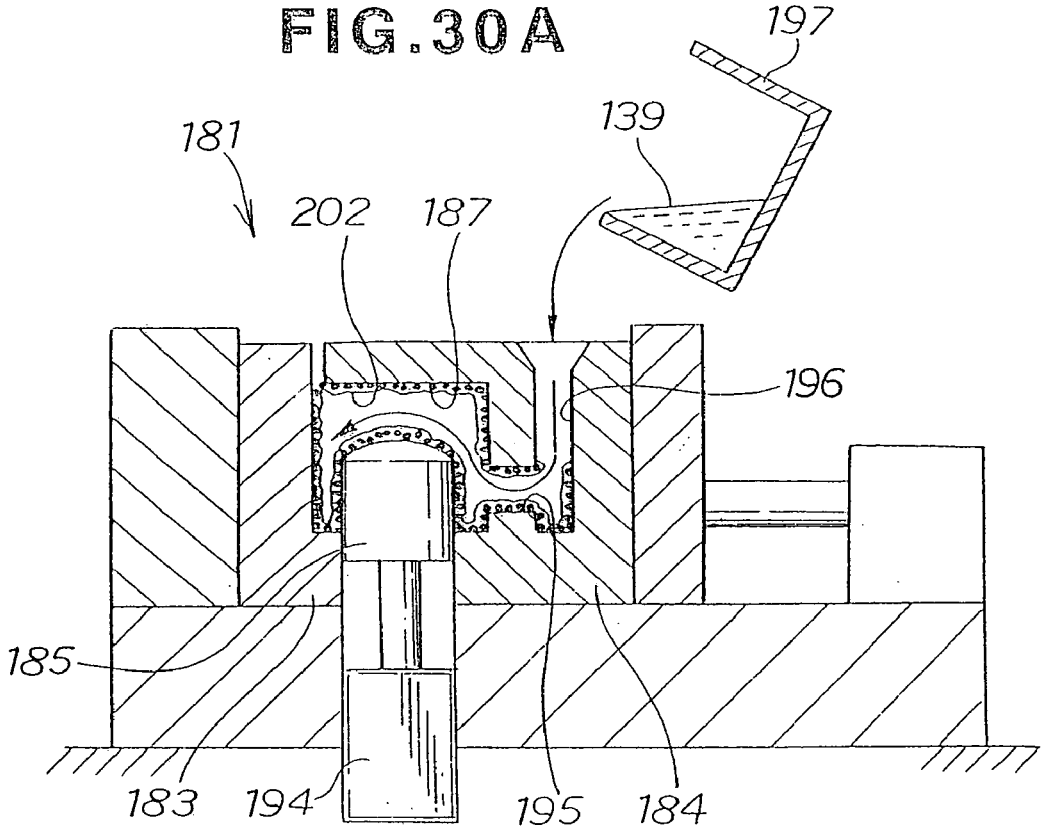
FIGS. 30A and 30B are diagrams explaining an example in which molten aluminum is supplied into the cavity in the aluminum casting process according to the fourth embodiment of this invention.
Figure 30B:
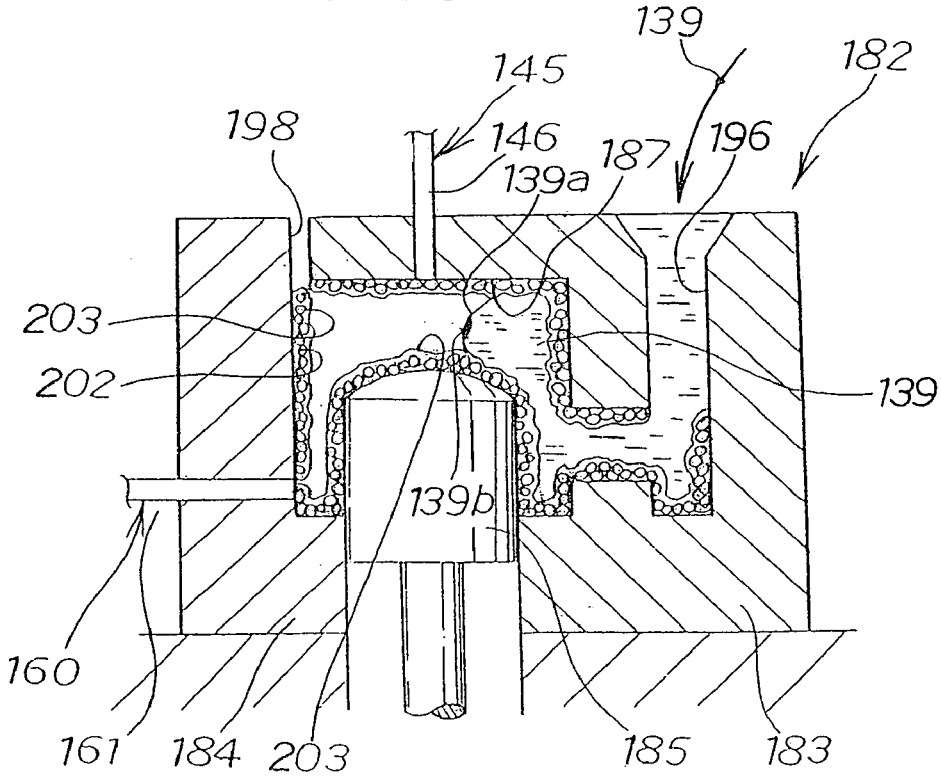

Step ST23 of FIG. 18 will now be explained. FIGS. 30A and 30B are diagrams for explaining an example in which molten aluminum is supplied into the cavity in accordance with the aluminum casting process according to the fourth embodiment of this invention. Referring to FIG. 30A, the pouring tank 197 in the casting apparatus proper 181 is tilted to supply molten aluminum 139 from the pouring tank 197 into the cavity 187 through the sprue 196 and the runner 195 as shown by arrows. It is possible to fill the cavity 187 with molten aluminum 139 smoothly, since the cavity 187 has its third pressure P regulated to the atmospheric level or below. Referring to FIG. 30B, the molten aluminum 139 supplied into the cavity 187 has its surface 139*a* contact magnesium nitride 203. It is likely that any oxide 139*b* may have been formed on the surface 139*a* of molten aluminum 139, and if any oxide 139*b* has been formed, its reaction with magnesium nitride 203 enables the removal of oxygen from the oxide 139*b*. This makes it possible to prevent the formation of any oxide film on the surface 139*a* of molten aluminum 139 and thereby restrain any increase in surface tension of molten aluminum 139. Accordingly, it is possible to maintain a good distribution of molten aluminum 139 in the cavity 187.

Figure 31A:
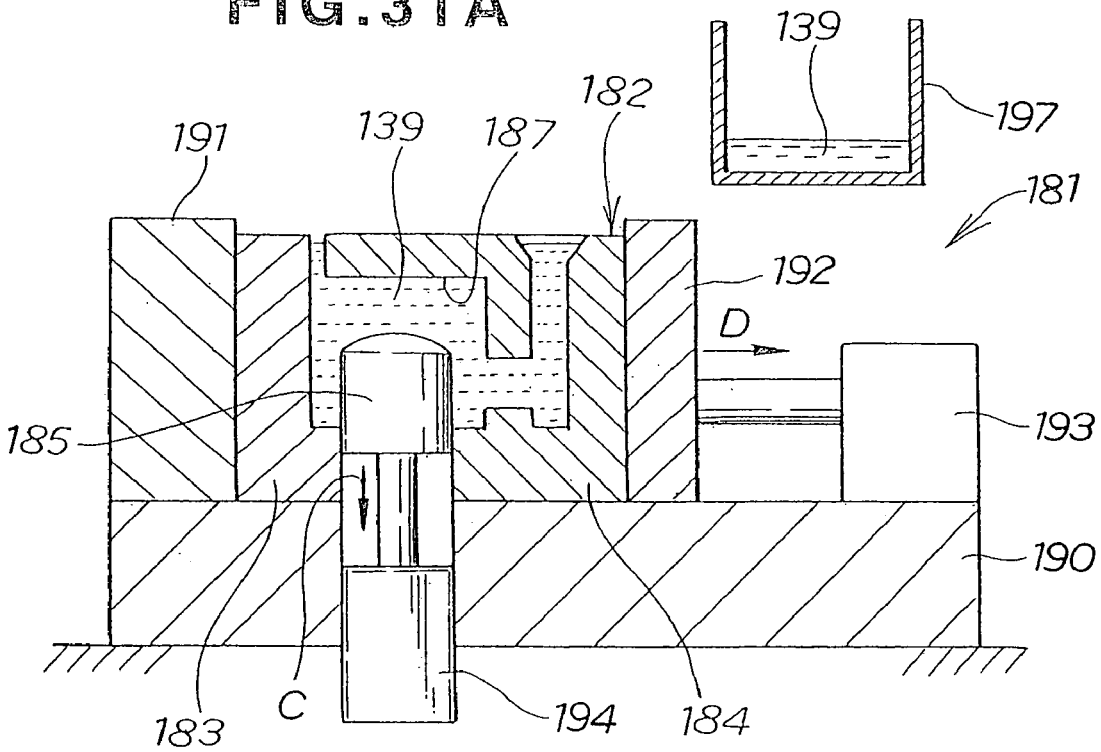
FIGS. 31A and 31B are diagrams explaining an example in which an aluminum casting is molded in the aluminum casting process according to the fourth embodiment of this invention.
Figure 31B:
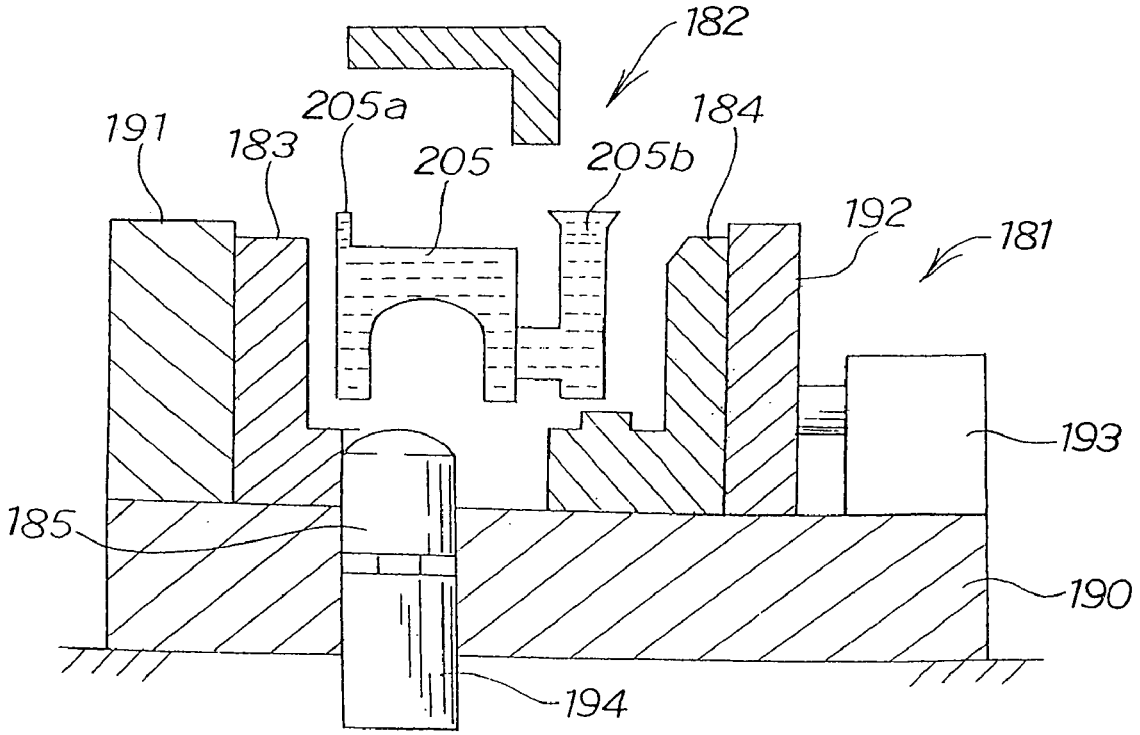

FIGS. 31A and 31B are diagrams for explaining an example in which an aluminum casting is molded in accordance with the aluminum casting process according to the fourth embodiment of this invention. Referring to FIG. 31A, the pouring tank 197 is returned to its horizontal position after a specific amount of molten aluminum 139 has been supplied from the pouring tank 197 into the cavity 187. After molten aluminum 139 has solidified, the core 185 is lowered by the raising and lowering device 194 as shown by an arrow C and the movable mold member 184 is moved by the moving device 193 as shown by an arrow D, so that the casting mold 182 may be opened. Referring to FIG. 31B, the casting mold 182 is opened for the removal of an aluminum casting 205 obtained by the solidification of molten aluminum 139 (shown in FIG. 31A). The aluminum casting 205 is a product of higher quality owing to a good distribution of molten metal as poured. The aluminum casting 205 has its non-product portions 205*a* and 205*b* removed and has its product portion worked on to give an engine cylinder block.

The fifth to eighth embodiments of this invention will now be described with reference to FIGS. 32 to 47.

Figure 32:
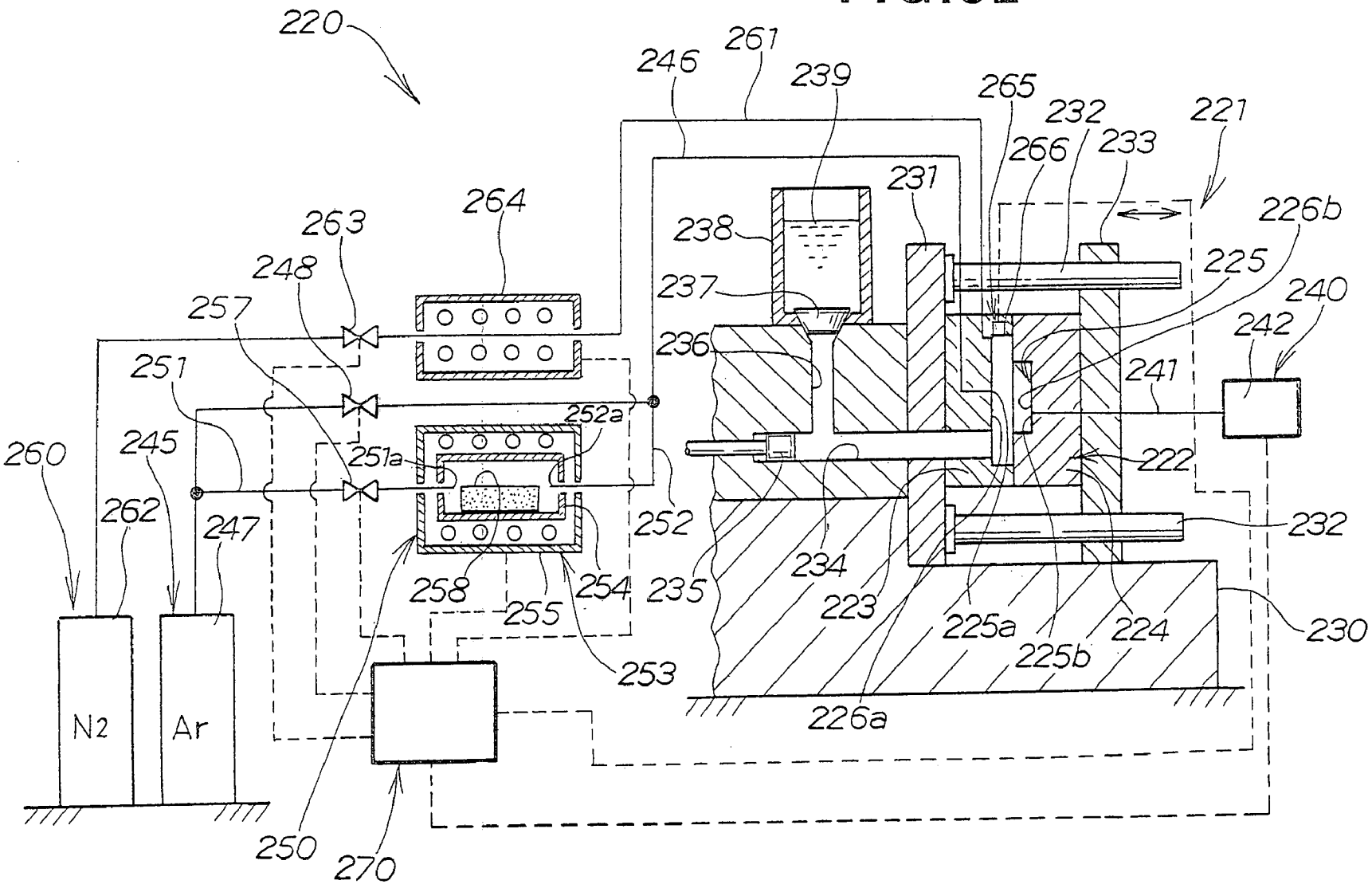
FIG. 32 is an overall diagram showing an aluminum casting apparatus (fifth embodiment) embodying this invention.

Fifth Embodiment:

FIG. 32 is an overall diagram showing an aluminum casting apparatus (fifth embodiment) according to this invention. The aluminum casting apparatus 220 has a casting apparatus proper 221 having a casting mold 222, an air discharging portion 240 for discharging air from the cavity 225 formed in the casting mold 222, an inert gas introducing portion 245 for introducing argon (Ar) gas (inert (rare) gas) into the cavity 225 from which air has been discharged, a magnesium introducing portion 250 for introducing gaseous magnesium (Mg) into the cavity 225 into which the inert gas has been introduced, a nitrogen gas introducing portion 260 for introducing nitrogen ($N_2$) gas into the cavity 225 into which the gaseous magnesium has been introduced, a detecting portion 265 for detecting the pressure in the cavity 225 and a control portion 270 for regulating the inside of the cavity 225 to a specific pressure based on information as detected by the detecting portion 265. The casting apparatus proper 221 includes a fixed plate 231 secured to a base 230, the casting mold 222 has a stationary member 223 secured to the fixed plate 231, guide rods 232 are secured to the fixed plate 231 and support a movable plate 233 movably, and the casting mold 222 has a movable member 224 secured to the movable plate 233. A sprue runner 234 opening to the cavity 225 is formed in the stationary member 223 of the mold and the base 230 and holds a movable plunger 235 therein. A sprue 236 is formed vertically from the sprue runner 234 and has an upper end closed by a tenon 237, while a pouring tank 238 capable of communicating with the sprue 236 is situated above it. The stationary and movable members 223 and 224 constitute the casting mold 222.

According to the aluminum casting apparatus 220, the movement of the movable plate 233 in the directions of arrows by a moving device (not shown) enables the movable member 224 of the mold to move between its mold closing position (shown) and its mold opening position. The movable member 224 held in its mold closing position enables the stationary and movable members 223 and 24 to form the cavity 225. After molten aluminum 239 is supplied into the cavity 225, it can be pressed by the plunger 235 to mold an aluminum casting in the cavity 225.

The air discharging portion 240 has a vacuum pump 242 connected with the cavity 225 through a discharging passage 241 and adapted to be switched between its operative and inoperative positions in accordance with a control signal from the control portion 270. The vacuum pump 242 switched to its operative position makes it possible to discharge air from the cavity 225 to the atmosphere through the discharging passage 241.

The inert gas introducing portion 245 has an argon gas bottle 247 connected to the cavity 225 by an introducing passage 246 provided with an argon valve 248 adapted to be switched between its open and closed positions in accordance with a control signal from the control portion 270. The argon valve 248 enables argon to be introduced from the argon gas bottle 247 into the cavity 225 through the introducing passage 246 when it is switched to its open position. The position 225*a* where the introducing passage 246 of the inert gas introducing portion 245 meets the cavity 225 and the position 225*b* where the discharging passage 241 of the air discharging portion 240 meets the cavity 225 are situated in the opposite areas 226*a* and 226*b*, respectively, of the wall of the cavity 225. Thus, the position 225*a* where the introducing passage 246 meets the cavity 225 and the position 225*b* where the discharging passage 241 meets the cavity 225 can be so situated as to face each other. Accordingly, the argon gas introduced into the cavity 225 through the argon gas introducing passage 246 directs the air in the cavity 225 toward the discharging passage 241. This enables the efficient discharging of air from the cavity 225 through the discharging passage 41.

The magnesium introducing portion 250 has a first magnesium introducing passage 251 and a second magnesium introducing passage 252 both connected with the introducing passage 246, a sublimating device 253 connected to the first and second magnesium introducing passages 251 and 252 and a magnesium valve 257 provided in the first magnesium introducing passage 251. The sublimating device 253 has a holding case 254 connected with the outlet end 251*a* of the first magnesium introducing passage 251 and the inlet end 252*a* of the second magnesium introducing passage 252 and a sublimating heater 255 surrounding the holding case 254. The sublimating device 253 is so constructed that the sublimating heater 255 has its heating temperature regulated when it is switched between its heating and non-heating positions in accordance with a control signal from the control portion 270. The sublimating heater 255 can heat the inside of the holding case 254 to a specific temperature (for example, at least 400° C.) and thereby sublimate a magnesium ingot (magnesium) 258 in the holding case 254 into a gaseous form. The magnesium valve 257 is a valve that can be switched between its open and closed positions in accordance with a control signal from the control portion 270. The magnesium valve 257 makes it possible to introduce argon gas from the argon gas bottle 247 into the holding case 254 through the first magnesium introducing passage 251 when it is switched to its open position, so that the introduced argon gas may direct gaseous magnesium into the cavity 225 through the second magnesium introducing passage 252 and the introducing passage 246.

The nitrogen introducing portion 260 has a nitrogen gas bottle 262 connected with the cavity 225 through a nitrogen introducing passage 261 provided with a nitrogen valve 263 and a heater 264. The nitrogen valve 263 is a valve that can be switched between its open and closed positions in accordance with a control signal from the control portion 270. The nitrogen valve 263 makes it possible to introduce nitrogen gas from the nitrogen gas bottle 262 into the cavity 225 through the nitrogen introducing passage 261 when it is switched to its open position. The nitrogen gas introducing portion 260 is so constructed that the heater 264 has its heating temperature regulated when it is switched between its heating and non-heating positions in accordance with a control signal from the control portion 270. The heater 264 can heat nitrogen gas flowing in the nitrogen introducing passage 261 to a specific temperature (for example, at least 400° C.).

The detecting portion 265 has a sensor 266 situated at the top of the cavity 225 for detecting the pressure in the cavity 225 and transmitting information as detected to the control portion 270.

The control portion 270 is adapted to control the air discharging portion 240, inert gas introducing portion 245, magnesium introducing portion 250 and nitrogen gas introducing portion 260 individually and regulate the pressure in the cavity 225 to a specific level by controlling the air discharging portion 240, inert gas introducing portion 245, magnesium introducing portion 250 and nitrogen gas introducing portion 260. The control portion 270 can transmit a signal for switching the vacuum pump 242 between its operative and inoperative positions to the vacuum pump 242, a signal for switching the argon valve 248 between its open and closed positions to the argon valve 248, a signal for switching the magnesium valve 257 between its open and closed positions to the magnesium valve 257 and a signal for switching the nitrogen valve 263 between its open and closed positions to the nitrogen valve 263. The control portion 270 can also transmit a signal for switching the sublimating heater 255 in the sublimating portion 253 between its heating and non-heating positions to the sublimating heater 255 and a signal for switching the heater 264 between its heating and non-heating positions to the heater.

Figure 33:
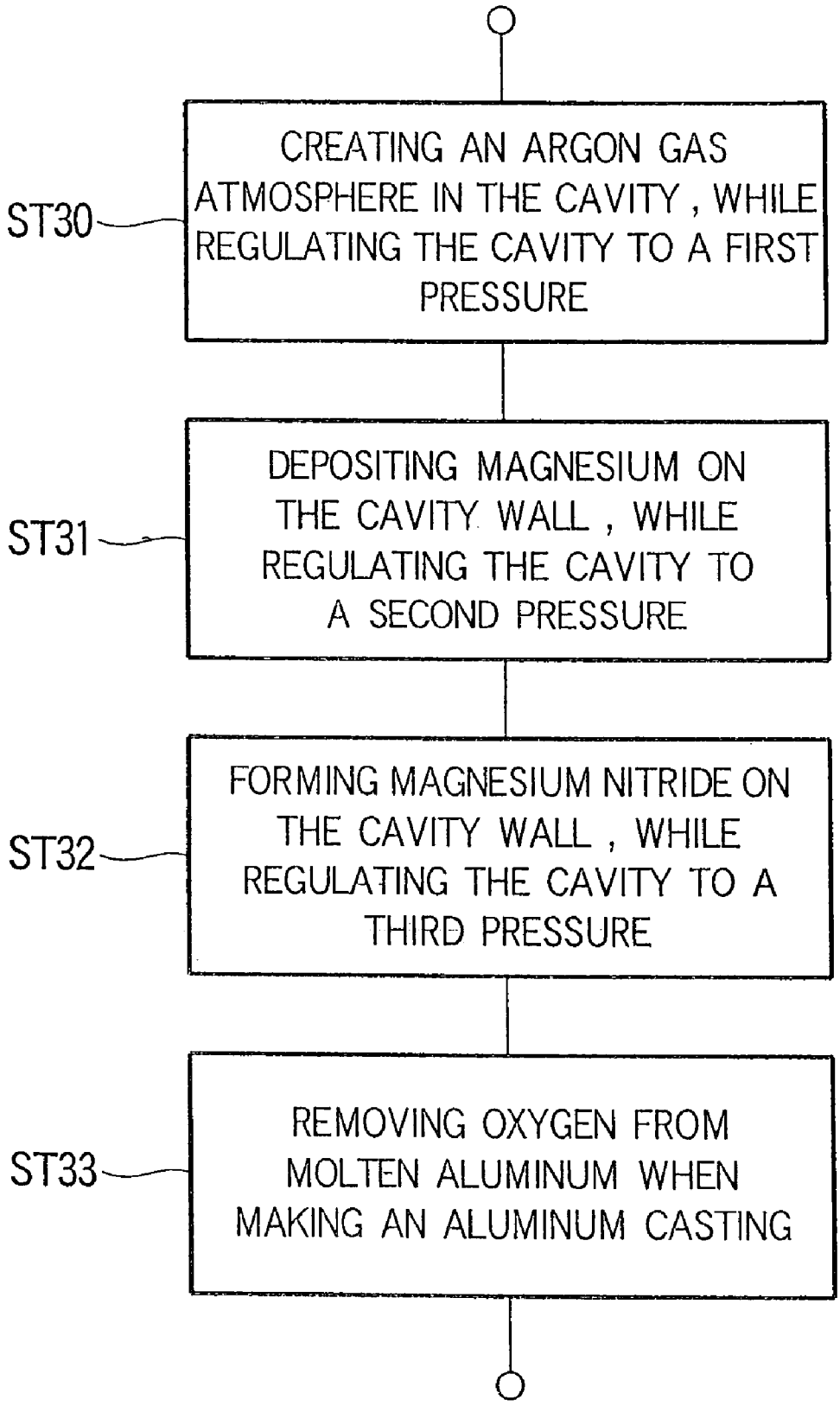
FIG. 33 is a flowchart explaining the operation of the fifth embodiment of this invention.

Description will now be made of the operation of the aluminum casting apparatus 220 (fifth embodiment) according to this invention. FIG. 33 is a flowchart explaining the operation of the fifth embodiment of this invention, and showing the aluminum casting process. In the chart, ST-- indicates Step No.

ST30: While air is discharged from the cavity of the closed mold, an inert gas is charged into the cavity to establish a first pressure in the cavity.

ST31: Gaseous magnesium is introduced into the cavity to have magnesium deposited on the cavity wall, while establishing a second pressure in the cavity.

ST32: Heated nitrogen gas is introduced into the cavity to have magnesium nitride ($Mg_3N_2$) formed on the cavity wall, while establishing a third pressure in the cavity.

ST33: Molten aluminum is supplied into the cavity to mold an aluminum casting in the cavity, while the surface of the molten aluminum is reduced with magnesium nitride.

The aluminum casting operation according to this invention, or the steps of the aluminum casting process (ST30 to ST33) will now be described in detail with reference to FIGS. 34 to 41.

Figure 34:
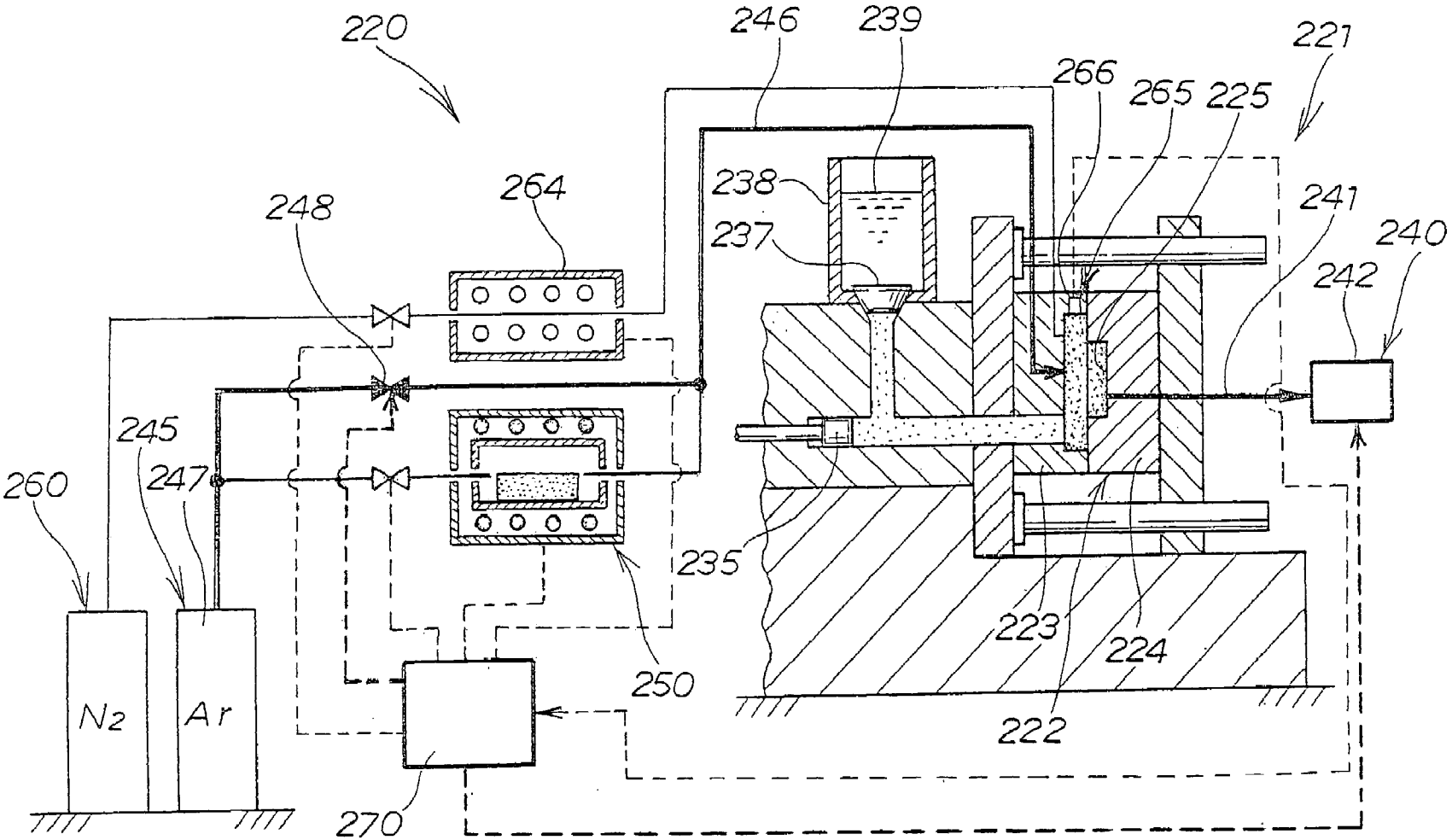
FIG. 34 is a diagram explaining an example in which the cavity in the apparatus according to the fifth embodiment of this invention is filled with an inert gas.

FIG. 34 is a diagram for explaining an example in which an inert gas is charged into the cavity in the apparatus according to the fifth embodiment of this invention, and it shows ST30. A drive signal is transmitted from the control portion 270 to the vacuum pump 242 to drive it and thereby discharge air from the cavity 225 into the atmosphere through the discharging passage 241. At the same time, an open signal is transmitted from the control portion 270 to the argon valve 248 to switch it to its open position. The argon valve 248 switched to its open position causes argon gas (shown in dots) to be introduced from the argon gas bottle 47 into the cavity 225 through the introducing passage 246. After air has been discharged from the cavity 225, a stop signal is transmitted from the control portion 270 to the vacuum pump 242 to stop it. When the pressure of the cavity 225 as detected by the sensor 266 in the detecting portion 265 has reached a preset first pressure of 0.5 atmospheres below the atmospheric pressure, a close signal is transmitted from the control portion 270 to the argon valve 248 to turn it to its closed position. This makes it possible to create an argon gas atmosphere in the cavity 225. Air is discharged from the cavity 225 when an argon gas atmosphere is created in the cavity 225. This makes it possible to replace the air in the cavity 225 with an argon gas atmosphere within a short time. Moreover, the regulation of the cavity 225 to a first pressure makes it possible to prevent any invasion of air from the atmosphere into the cavity 225. This makes it possible to purge the cavity 225 with an argon gas atmosphere still more efficiently.

Figure 35:
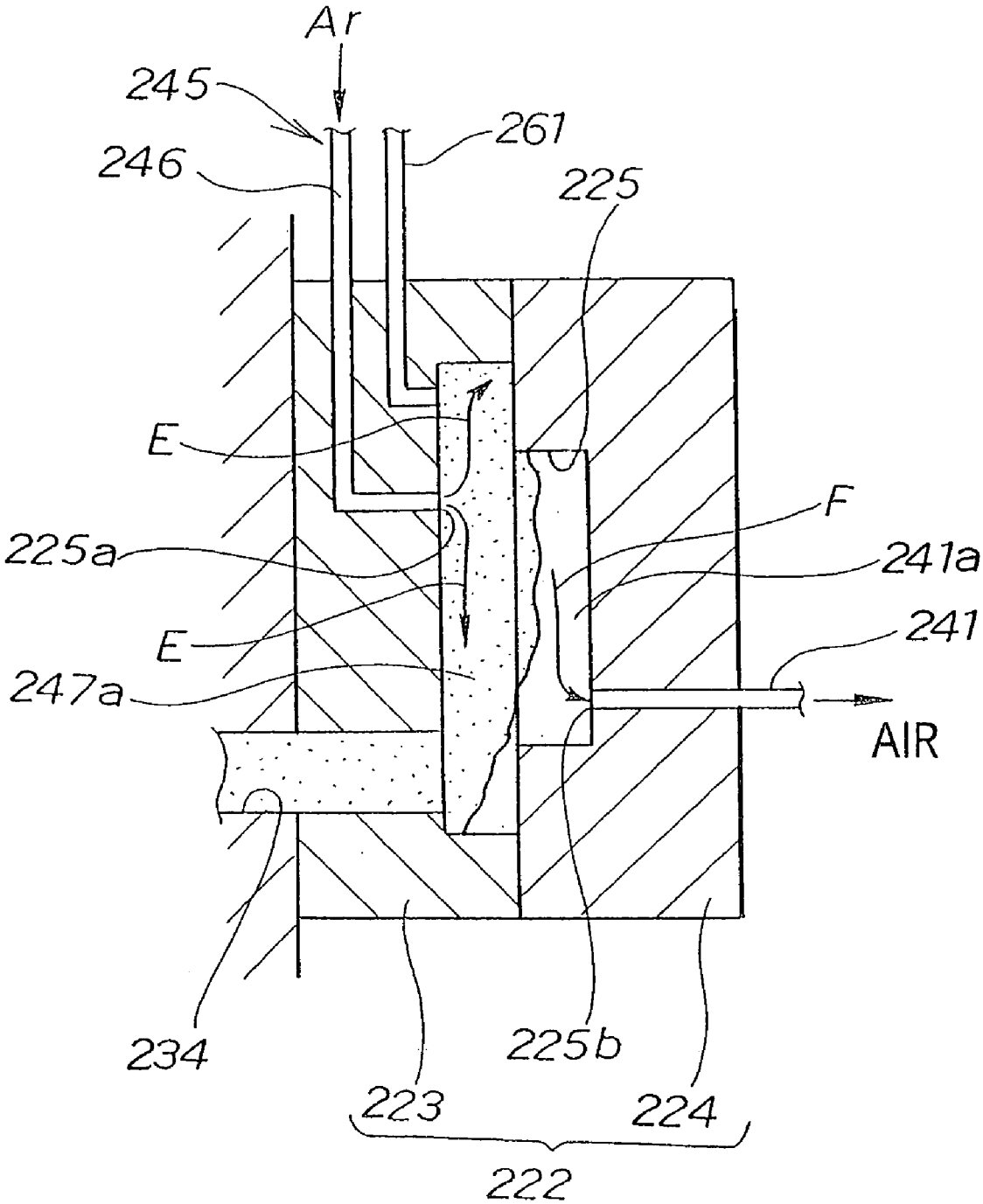
FIG. 35 is a diagram explaining an example in which air is discharged from the cavity in the apparatus according to the fifth embodiment of this invention.

FIG. 35 is a diagram for explaining an example in which air is discharged from the cavity in the apparatus according to the fifth embodiment of this invention. The position 25*a* where the introducing passage 46 in the inert gas introducing portion 45 meets the cavity 25 and the position 25*b* where the discharging passage 41 in the air discharging portion 40 meets the cavity 25 are shown as being situated in a mutually opposite relation. The situation of the argon gas introducing passage 246 in an opposite relation to the air discharging passage 241 makes it possible to urge an air zone 241*a* in the cavity 225 toward the discharging passage 241 efficiently, as an argon gas zone 247*a* expands when argon gas (shown in dots) is introduced into the cavity 225 as shown by arrows E through the argon gas introducing passage 246. This makes it possible to discharge air from the cavity 225 efficiently through the discharging passage 241 as shown by an arrow F. Accordingly, it is possible to discharge air from the cavity 225 and purge it with an argon gas atmosphere within a still shorter time.

Figure 36:
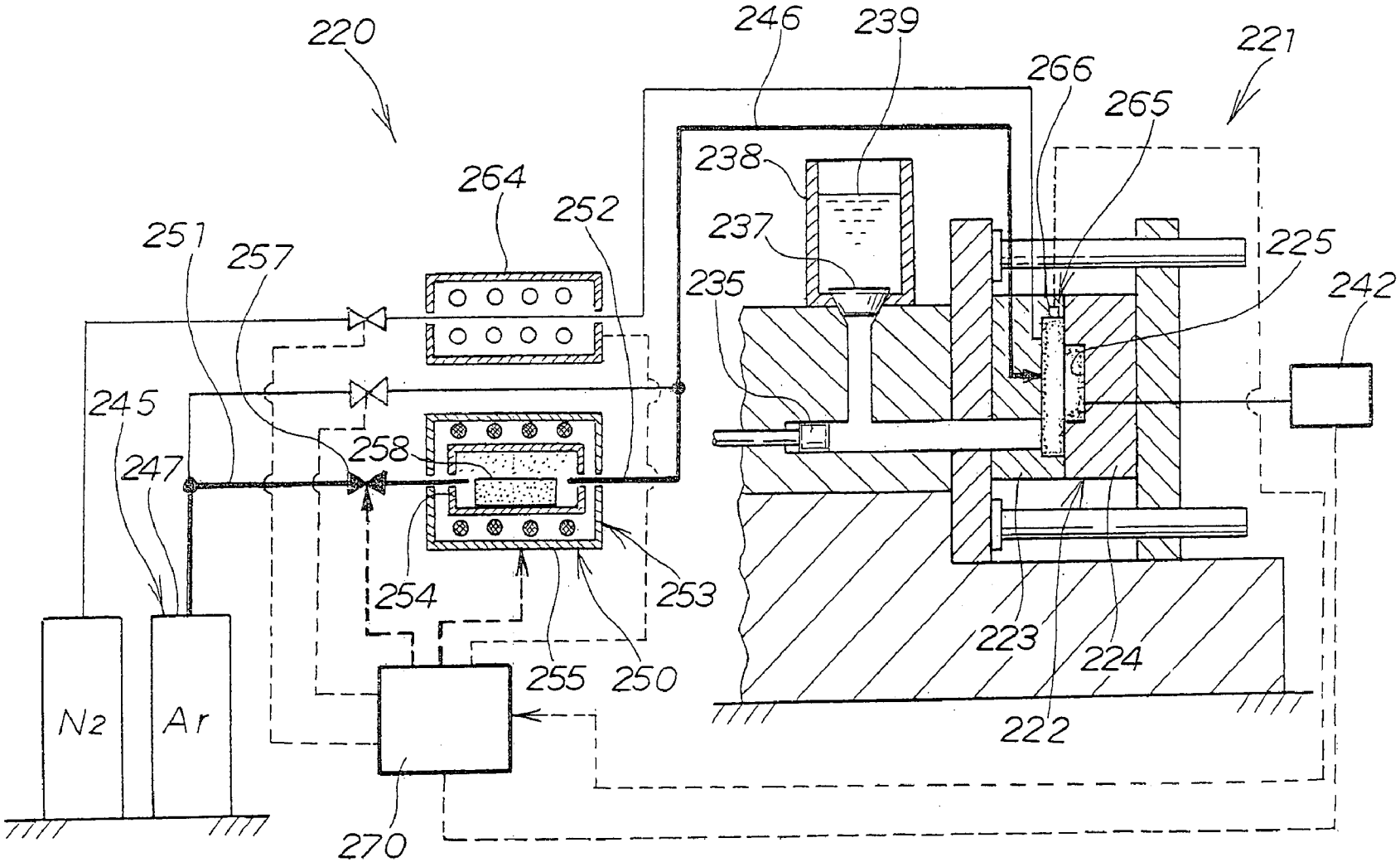
FIG. 36 is a diagram explaining an example in which magnesium is introduced into the cavity in the apparatus according to the fifth embodiment of this invention.

FIG. 36 is a diagram for explaining an example in which magnesium is introduced into the cavity in the apparatus according to the fifth embodiment of this invention, and it shows the former half of ST31. The sublimating heater 255 in the sublimating portion 253 is placed in its heating position in accordance with a signal from the control portion 270 to heat the inside of the holding case 254 to a specific temperature (for example, at least 400° C.). Heating the inside of the holding case 254 causes the magnesium ingot 258 to be sublimated into a gaseous form. The gaseous magnesium in the holding case 254 is shown in dots. An open signal is transmitted from the control portion 270 to the magnesium valve 257 to switch it to its open position. The magnesium valve 257 switched to its open position causes argon gas to be introduced from the argon gas bottle 247 into the holding case 254 through the first magnesium introducing passage 251. The introduced argon gas causes gaseous magnesium (shown in dots) to be introduced into the cavity 225 through the second magnesium introducing passage 252 and the introducing passage 246. On that occasion, the cavity 225 has a second pressure regulated to a sub-atmospheric level (0.5 to 0.7 atmospheres). The first pressure (0.5 atmospheres) regulated like the second pressure (0.5 to 0.7 atmospheres) to a sub-atmospheric level as described with reference to FIG. 34 makes it possible to reduce or eliminate any difference between the first and second pressures and thereby change from the first to the second pressure within a short time. Accordingly, it is possible to suppress any time lag caused by a change from the first to the second pressure. Returning to FIG. 36, the second magnesium introducing passage 252 and the introducing passage 246 are preferably heated when gaseous magnesium is introduced into the cavity 225, so that no magnesium may be deposited in the second magnesium introducing passage 252 or the introducing passage 246.

Figure 37:
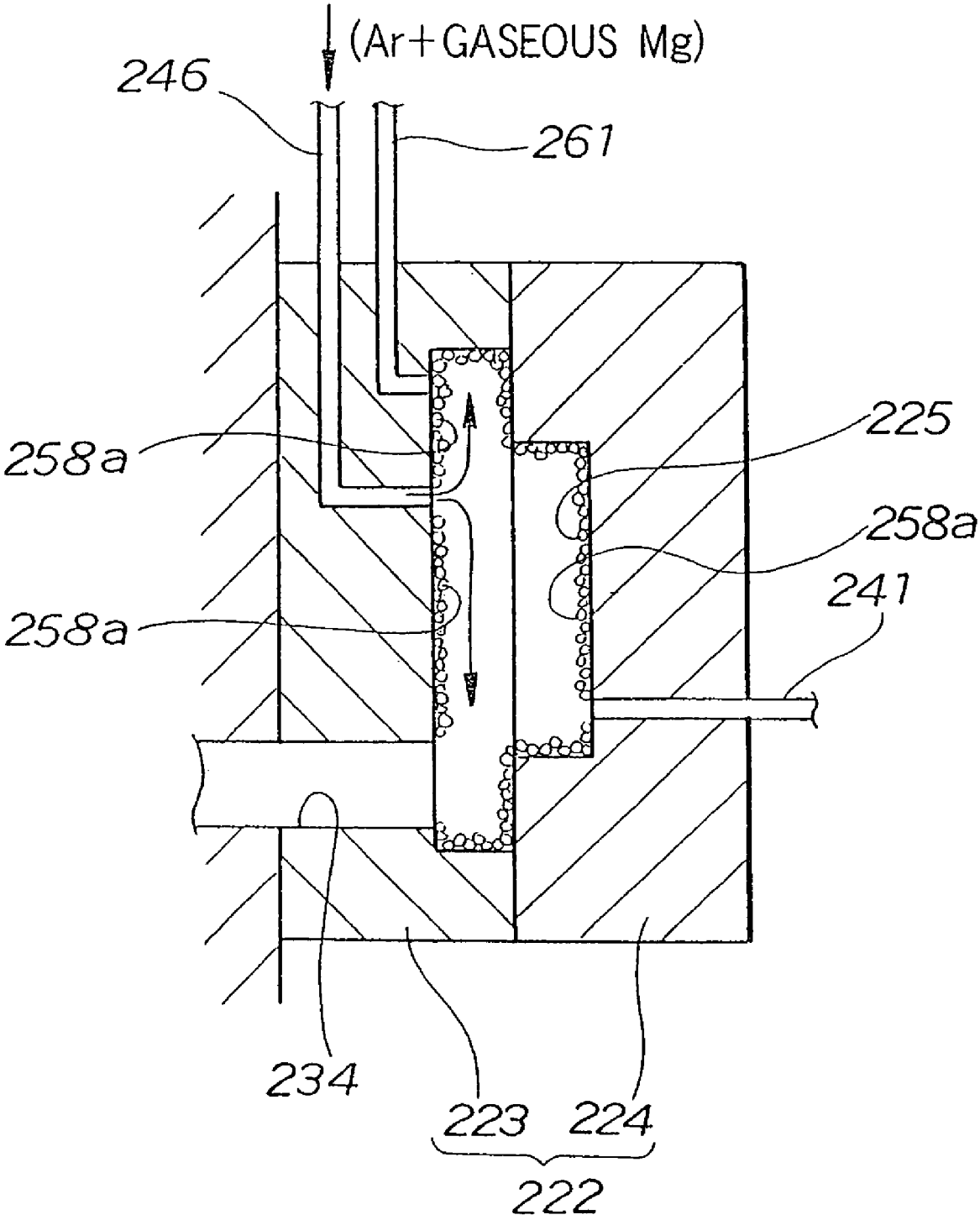
FIG. 37 is a diagram explaining an example in which magnesium is deposited on the cavity wall in the apparatus according to the fifth embodiment of this invention.

FIG. 37 is a diagram for explaining an example in which magnesium is deposited on the cavity wall in the apparatus according to the fifth embodiment of this invention, and it shows the latter half of ST31. The gaseous magnesium introduced into the cavity 225 as shown by arrows has its temperature lowered to 150 to 250° C. by contacting the wall of the cavity 225. Its drop in temperature to 150 to 250° C. causes gaseous magnesium to be deposited on the wall of the cavity 225. The deposited magnesium is called a magnesium layer 258*a*. The second pressure of the cavity 225 regulated to a sub-atmospheric level (0.5 to 0.7 atmospheres) makes it possible to establish the condition facilitating the deposition of magnesium (i.e. the wall temperature of the cavity 225 in the range of 150 to 250° C.) easily in the cavity 225 and thereby have magnesium deposited efficiently. Returning to FIG. 36, a close signal is transmitted from the control portion 270 to the magnesium valve 257 to turn it to its closed position when the pressure of the cavity 225 as detected by the sensor 266 in the detecting portion 265 has reached the preset second pressure.

Figure 38:
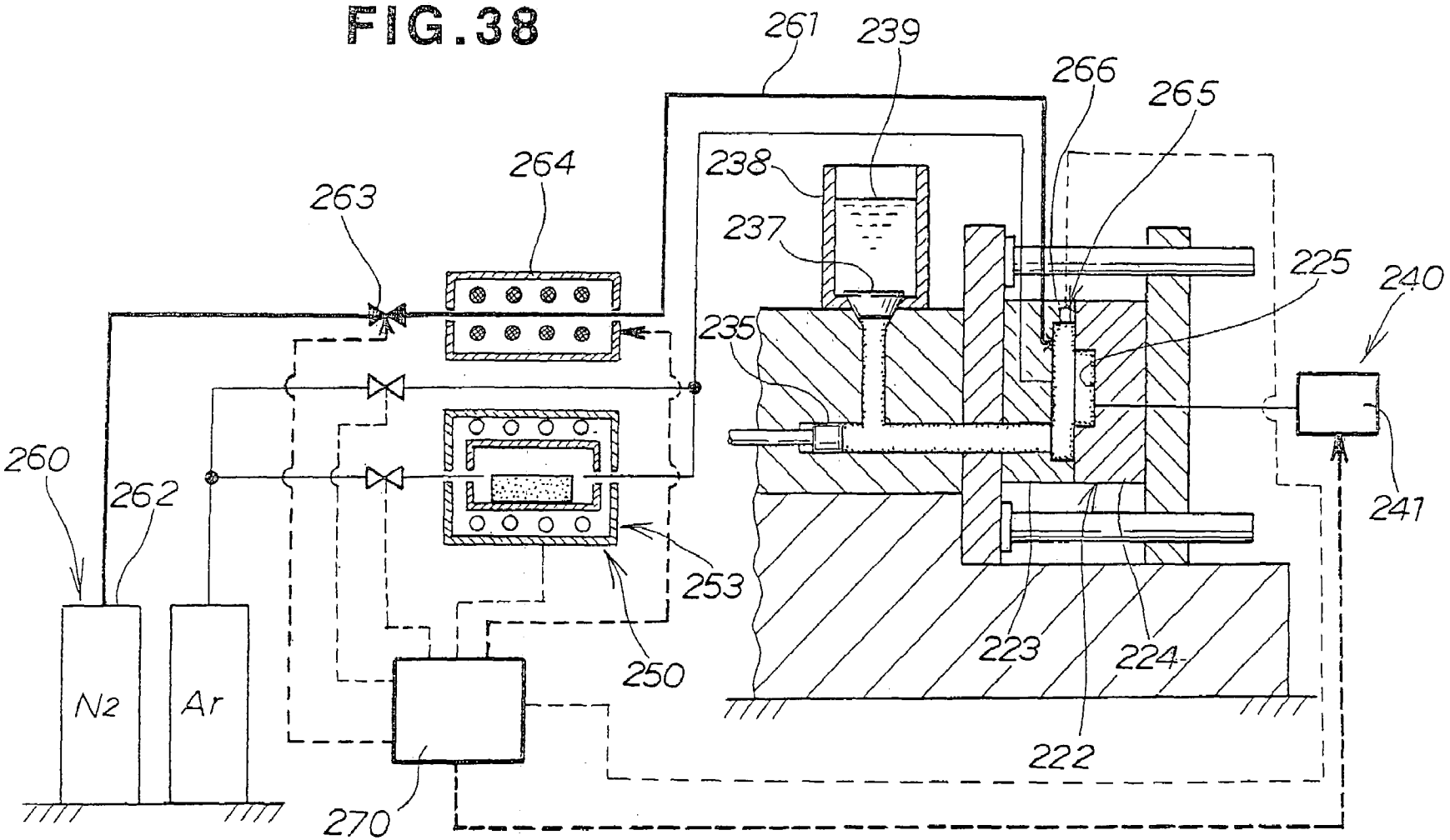
FIG. 38 is a diagram explaining an example in which nitrogen gas is introduced into the cavity in the apparatus according to the fifth embodiment of this invention.

FIG. 38 is a diagram for explaining an example in which nitrogen gas is introduced into the cavity in the apparatus according to the fifth embodiment of this invention, and it shows ST32. The heater 264 in the nitrogen gas introducing portion 260 is placed in its heating position in accordance with a signal from the control portion 270. An open signal is transmitted from the control portion 270 to the nitrogen valve 263 to switch it to its open position. The nitrogen valve 263 switched to its open position causes nitrogen gas to flow from the nitrogen gas bottle 262 into the nitrogen introducing passage 261. The nitrogen gas in the nitrogen introducing passage 261 is heated by the heater 264 and the heated nitrogen gas is introduced into the cavity 225 through the nitrogen introducing passage 261. At the same time, a drive signal is transmitted from the control portion 270 to the vacuum pump 242 to discharge gas from the cavity 225 into the atmosphere through the discharging passage 241. This causes the pressure of the cavity 225 to be regulated to a third pressure P at a sub-atmospheric level of, for example, 0.1 atmosphere. The independent heating of nitrogen gas by the heater 264 makes it possible to heat nitrogen gas flowing in the nitrogen introducing passage 261 to a specific temperature (for example, at least 400° C.) efficiently.

Figure 39:
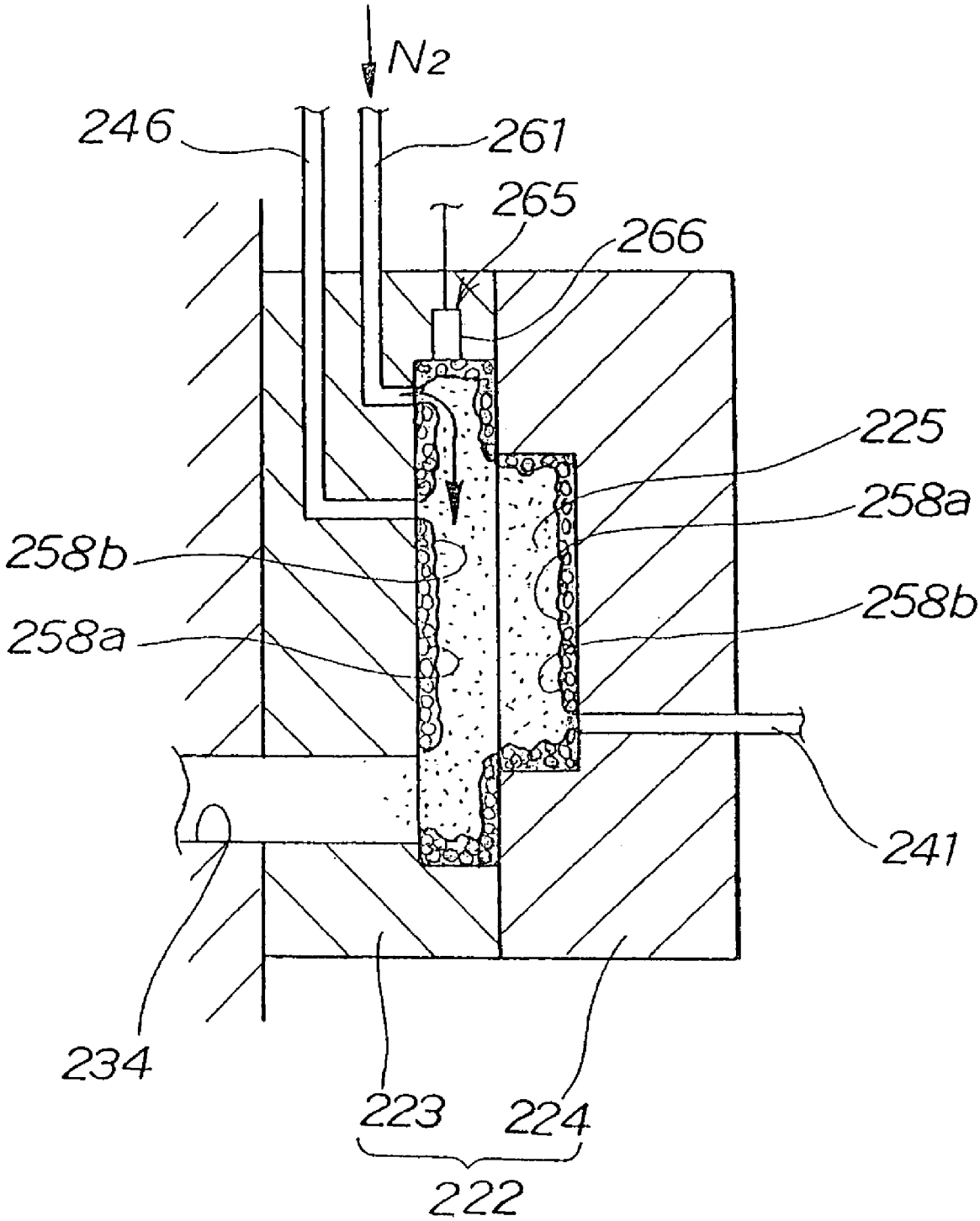
FIG. 39 is a diagram explaining an example in which magnesium nitride is formed in the apparatus according to the fifth embodiment of this invention.

FIG. 39 is a diagram for explaining an example in which magnesium nitride is formed in the apparatus according to the fifth embodiment of this invention. The third pressure P (atmosphere) in the cavity 225 and the temperature T (° C.) of nitrogen gas (shown in dots) in the cavity 225 are so selected as to maintain their relationship $P \leqq (T-270)/130$. If this condition is met, it is possible to have magnesium nitride ($Mg_3N_2$) 258*b* formed on the surface of the magnesium layer 258*a* by the reaction of the magnesium layer 258*a* deposited on the wall of the cavity 225 and the nitrogen gas. More specifically, their relationship $P \leqq (T-270)/130$ teaches that when the third pressure P in the cavity 225 as detected by the sensor 266 in the detecting portion 265 is, for example, 0.1 atmosphere, the temperature T of nitrogen gas in the cavity 225 may be set at 283° C. for forming magnesium nitride 258*b* on the surface of the magnesium layer 258*a*, and also that when the third pressure P in the cavity 225 is 1 atmosphere, the temperature T of nitrogen gas in the cavity 225 may be set at 400° C. for forming magnesium nitride 258*b* on the surface of the magnesium layer 258*a*. As the third pressure P and the temperature T of nitrogen gas in the cavity 225 are relatively easy to determine based on their relationship $P \leqq (T-270)/130$, it is possible to perform the adjustment of equipment within a short time. Moreover, nitrogen gas is heated and heated nitrogen gas is used for forming magnesium nitride 258*b*. This makes it possible to form magnesium nitride 258*b* efficiently, as it is possible to heat nitrogen gas to a temperature at which magnesium nitride 258*b* is easy to form. The regulation of the third pressure P in the cavity 225 makes it possible to establish the conditions facilitating the deposition of magnesium nitride 258*b* (i.e. the third pressure P of 0.1 atmosphere and the gas temperature of 283° C. in the cavity 225) in the cavity 225 and thereby form magnesium nitride 258*b* efficiently. The third pressure P of the cavity 225 regulated to a sub-atmospheric level makes it possible to regulate the temperature of nitrogen gas in the cavity 225 to a temperature at which magnesium nitride 258*b* is easy to form.

For the formation of magnesium nitride 258*b*, the magnesium layer 258*a* is first formed by magnesium deposited on the wall of the cavity 225 and then, nitrogen gas is introduced into the cavity 225 to form magnesium nitride 258*b* on the surface of the magnesium layer 258*a*, as described with reference to FIGS. 37 and 39. Accordingly, it is possible to form magnesium nitride 258*b* on only the surface of the magnesium layer 258*a* and thereby shorten the time required for forming magnesium nitride 258*b*. Moreover, it is possible to reduce the amount of nitrogen gas used, since it is sufficient to form magnesium nitride 258*b* on only the surface of the magnesium layer 258*a*.

Figure 40A:
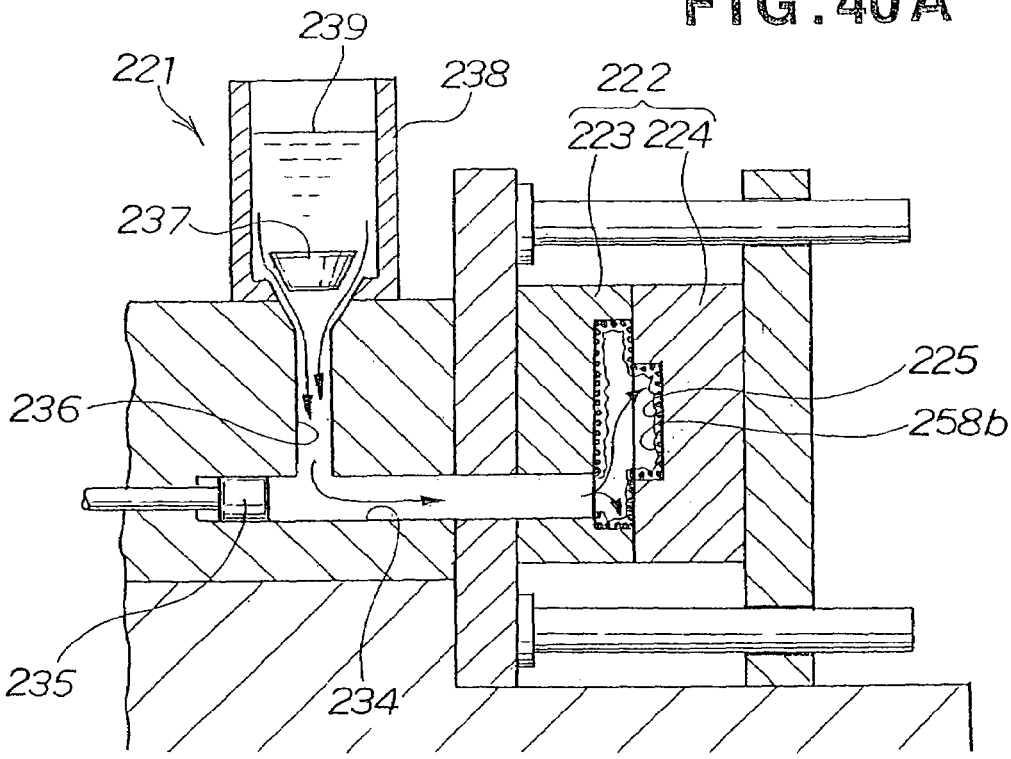
FIGS. 40A and 40B are diagrams explaining an example in which molten aluminum is supplied into the cavity in the apparatus according to the fifth embodiment of this invention.
Figure 40B:
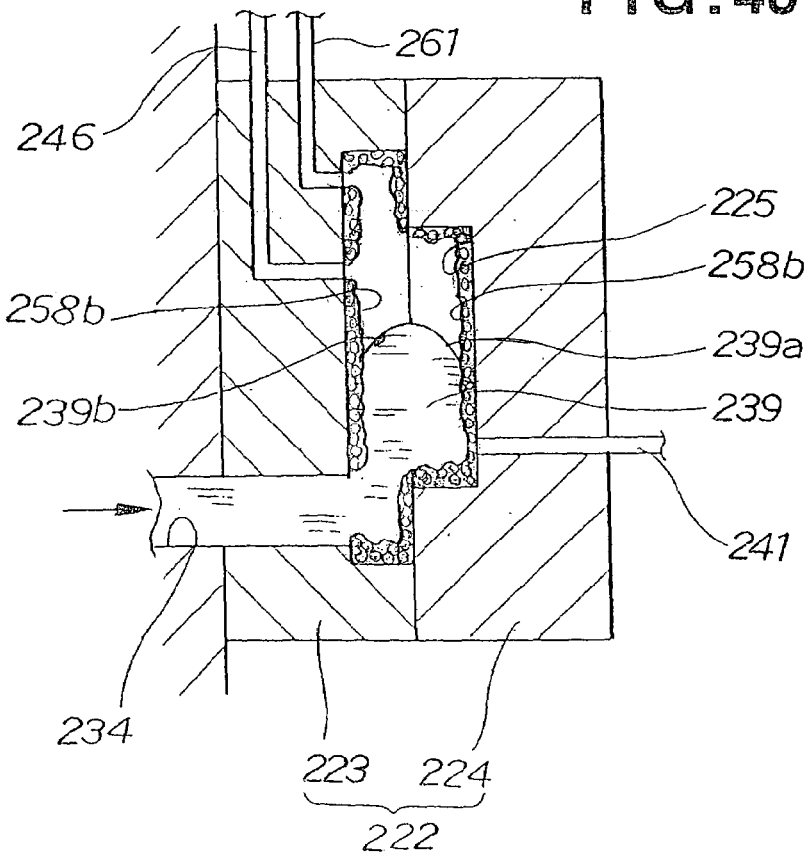

FIGS. 40A and 40B are diagrams for explaining an example in which molten aluminum is supplied into the cavity in the apparatus according to the fifth embodiment of this invention, and they show the former half of ST33. Referring to FIG. 40A, the tenon 237 in the casting apparatus proper 221 is operated to open the sprue 236, so that molten aluminum 239 may be supplied from the pouring tank 238 into the cavity 225 through the sprue 236 and the runner 234 as shown by arrows. Referring to FIG. 40B, the molten aluminum 239 supplied into the cavity 225 has its surface 239*a* contact magnesium nitride 258*b*. It is likely that any oxide 239*b* may have been formed on the surface 239*a* of molten aluminum 239, and if any oxide 239*b* has been formed, its reaction with magnesium nitride 258*b* enables the removal of oxygen from the oxide 239*b*. This makes it possible to prevent the formation of any oxide film on the surface 239*a* of molten aluminum 239 and thereby restrain any increase in surface tension of molten aluminum 239. Accordingly, it is possible to maintain a good distribution of molten aluminum 239 in the cavity 225.

Figure 41A:
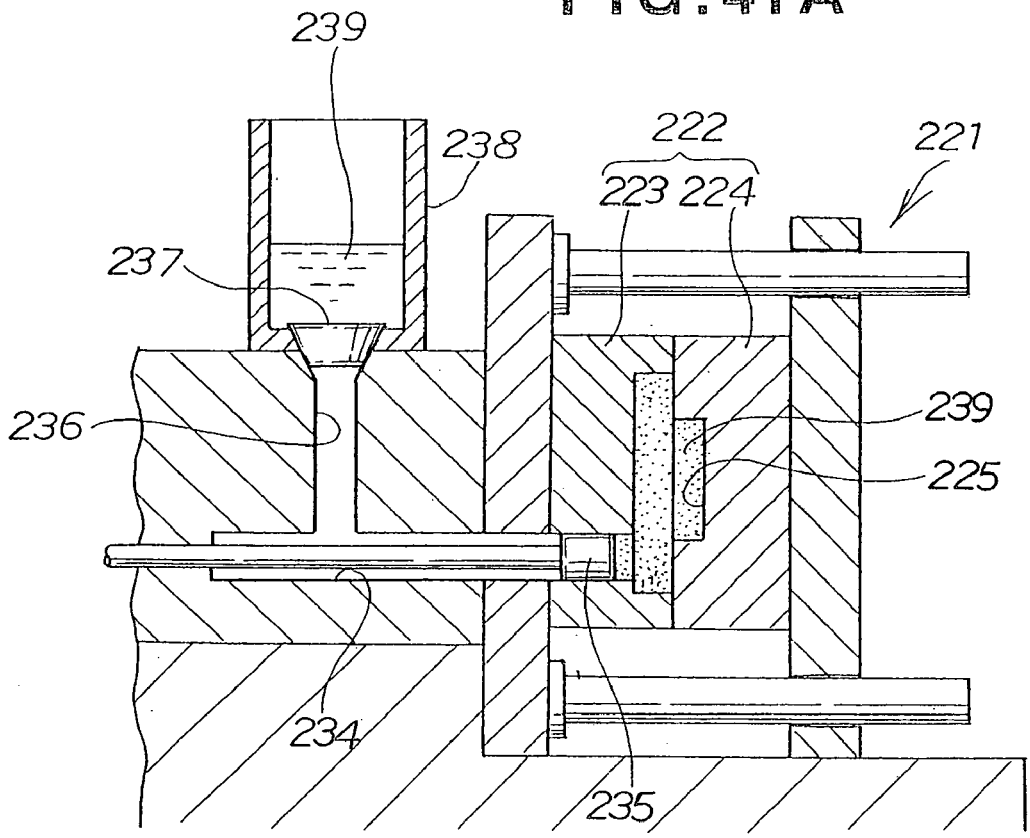
FIGS. 41A and 41B are diagrams explaining an example in which an aluminum casting is molded in the apparatus according to the fifth embodiment of this invention.
Figure 41B:
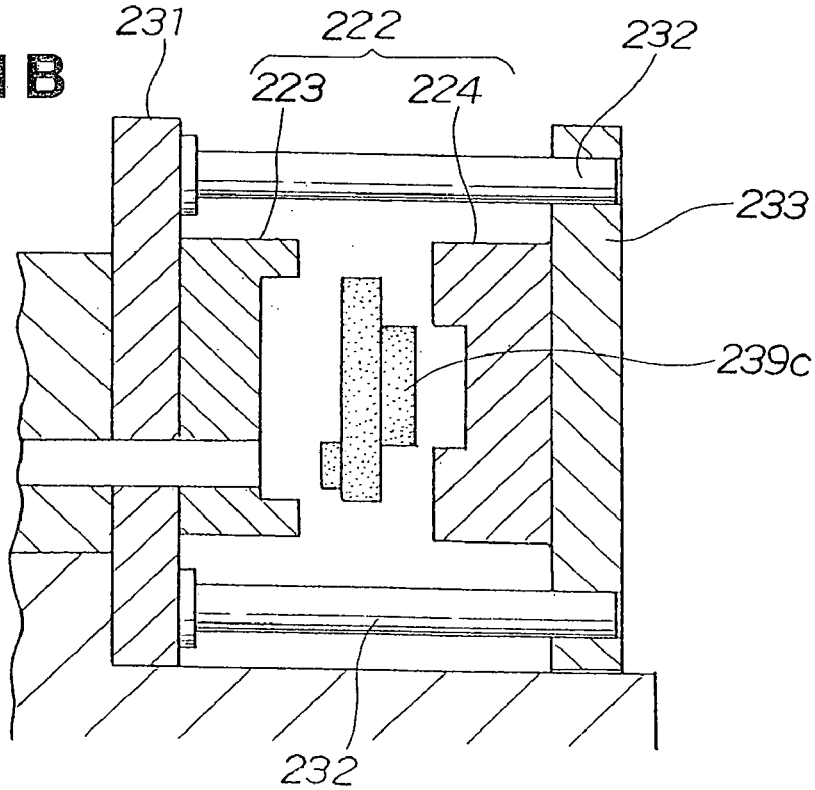

FIGS. 41A and 41B are diagrams for explaining an example in which an aluminum casting is molded in the apparatus according to the fifth embodiment of this invention, and they show the latter half of ST33. Referring to FIG. 41A, the sprue 236 is closed by the tenon 237 after a specific amount of molten aluminum 239 has been supplied from the pouring tank 238 to the cavity 225. The plunger 235 is pushed forward toward the cavity 225 to fill the cavity 225 with molten aluminum 239. The third pressure P of the cavity 225 regulated to a sub-atmospheric level (for example, 0.1 atmosphere) as explained with reference to FIG. 39 makes it possible to fill the cavity 225 with molten aluminum 239 smoothly. Referring to FIG. 41B, the casting mold 222 is opened for the removal of an aluminum casting 239*c* obtained by the solidification of molten aluminum 239 (shown in FIG. 41A). The aluminum casting 239*c* is a product of higher quality owing to a good distribution of molten metal as poured. The aluminum casting 239*c* is worked on to make a disk rotor 10 as shown in FIG. 1.

According to the fifth embodiment, the aluminum casting apparatus 220 includes the air discharging portion 240, inert gas introducing portion 245, magnesium introducing portion 250 and nitrogen gas introducing portion 260 and the control portion 270 controls the portions 240, 245, 250 and 260 to regulate the cavity 225 to a specific pressure, as described above. The regulation of the cavity 225 to a specific pressure by the control portion 270 makes it possible to deposit magnesium layer 258*a* efficiently on the wall of the cavity 225 and form magnesium nitride 258*b* efficiently on the surface of the deposited magnesium layer 258*a*. Therefore, it is possible to carry out the formation of the magnesium nitride 258*b* in a short time. Moreover, the formation of magnesium nitride 258*b* on only the surface of the magnesium layer 258*a* makes it possible to reduce the amount of nitrogen gas as required. According to the fifth embodiment, moreover, the control portion 270 is adapted to control the air discharging portion 240, inert gas introducing portion 245, magnesium introducing portion 250 and nitrogen gas introducing portions 260 individually. This facilitates the regulation of the environment in the cavity 225 in accordance with the conditions for the deposition of the magnesium layer 258*a* and the conditions for the formation of magnesium nitride 258*b*. The easy setting of the conditions for the deposition of the magnesium layer 258*a* and the conditions for the formation of magnesium nitride 258*b* makes it possible to carry out the formation of magnesium nitride 258*b* within a short time. According to the fifth embodiment, moreover, the control of the sublimating and heating devices 253 and 264 by the control portion 270 enables the sublimating device 253 to sublimate magnesium into a gaseous form efficiently as desired and the heating device 264 to heat nitrogen gas efficiently as desired. This makes it possible to deposit the magnesium layer 258*a* efficiently and form magnesium nitride 258*b* efficiently. Moreover, it is possible to carry out the deposition of the magnesium layer 258*a* and the formation of magnesium nitride 258*b* within a short time.

Sixth Embodiment:

Description will now be made of the sixth embodiment of this invention in which a disk rotor 10 (see FIG. 1) is molded by the aluminum casting apparatus 220 shown in FIG. 32. The sixth embodiment is characterized in that the cavity 225 has its first and second pressures set both at the atmospheric level and its third pressure P set at a sub-atmospheric or negative level. Incidentally, the first and second pressures and the third pressure P are all set not higher than the atmospheric level in the case of the aluminum casting processes as described with reference to FIGS. 23 to 41. As the first pressure set at the atmospheric level enables the pressure of the cavity 225 to be equal to that of the open atmosphere, it is possible to prevent still more reliably any invasion of air from the open atmosphere into the cavity 225 when an argon gas atmosphere is created in the cavity 225. The second pressure of the cavity 225 is also set at the atmospheric level. While the deposition of magnesium on the wall of the cavity 225 requires it to have a wall temperature lowered to a level of, say, 150 to 250° C. as explained in connection with the fifth embodiment, it is relatively easy to regulate the temperature to a level of say, 150 to 250° C. even if the second pressure of the cavity 225 may not be lowered to a sub-atmospheric level.

Magnesium is deposited at a temperature of 300° C. when the second pressure of the cavity 225 is set at the atmospheric level. It is sufficient to set the wall temperature of the cavity 225 at a level of, say, 150 to 250° C. for the satisfactory deposition of magnesium. The second pressure set at the atmospheric level enables the pressure of the cavity 225 to be equal to that of the open atmosphere. This makes it continuously possible to prevent any invasion of air from the open atmosphere into the cavity 225 efficiently when magnesium is deposited on the wall of the cavity 225. Thus, the first and second pressures set both at the atmospheric level make it possible to have magnesium nitride 258*b* formed on the wall of the cavity 225 still more efficiently, since it is possible to prevent any invasion of air into the cavity 225 still more reliably. It is also possible to restrain the formation of any oxide 239*b* on the surface 239*a* of molten aluminum 239 when the molten aluminum 239 is supplied into the cavity 225. Moreover, the third pressure P set at a sub-atmospheric or negative pressure makes it possible to charge the cavity 225 with molten aluminum 239 still more smoothly. For the regulation of the pressure of the cavity 225 from the second pressure (atmospheric) to the third pressure P (sub-atmospheric), a drive signal is transmitted from the control portion 270 to the vacuum pump 242 to drive it to discharge gas from the cavity 225 into the open atmosphere through the discharging passage 241 as in the case of the fifth embodiment. According to the sixth embodiment, thus, the first and second pressures set both at the atmospheric level and the third pressure P set at a sub-atmospheric or negative level make it possible to carry out aluminum casting treatment still more efficiently and thereby achieve a still higher level of productivity.

Description will now be made of the seventh embodiment with reference to FIGS. 42 to 47. The reference numerals used for the fifth embodiment are used to denote like parts or materials for the seventh embodiment and no repeated description thereof is made.

Figure 42:
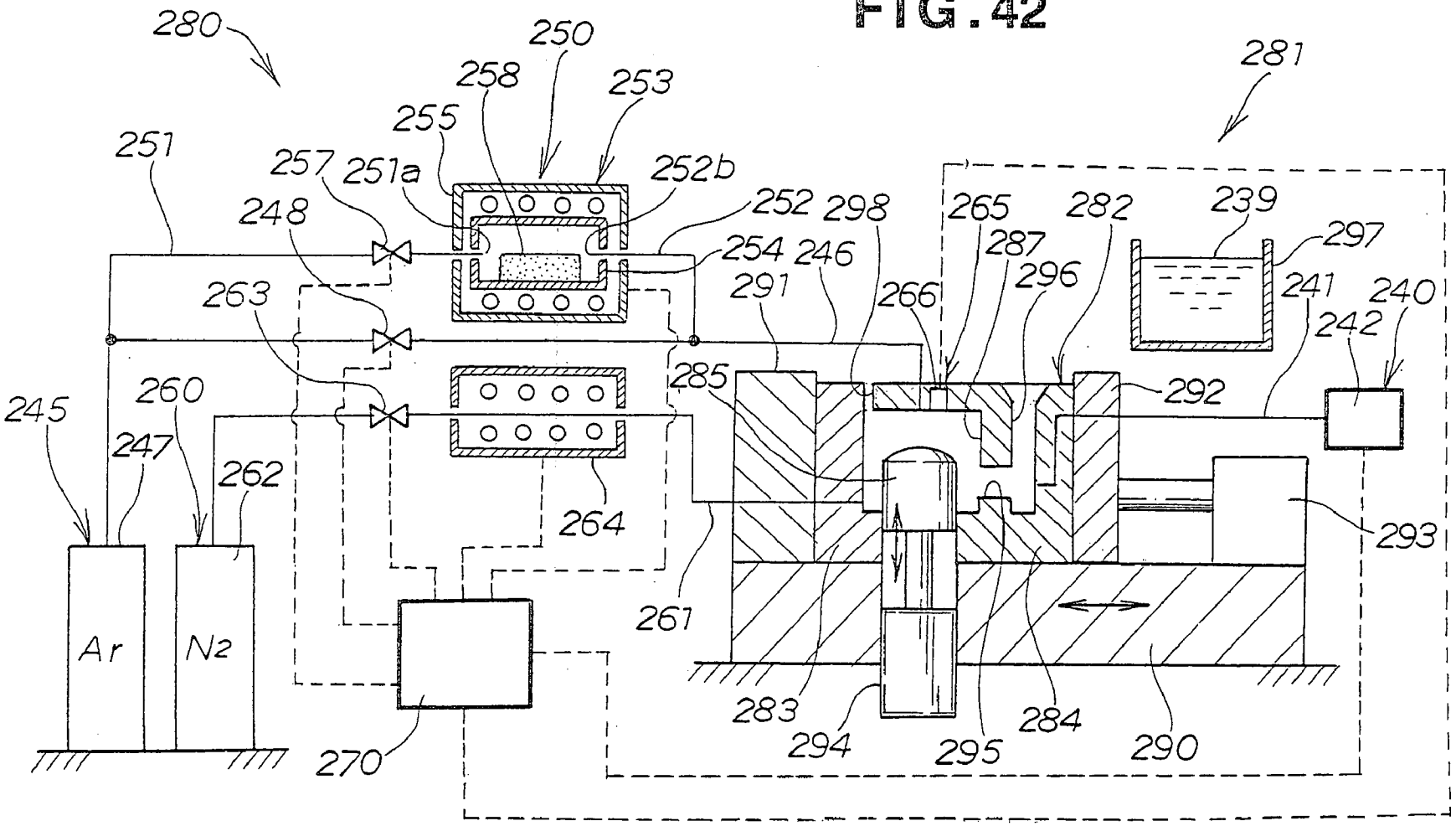
FIG. 42 is an overall diagram showing an aluminum casting apparatus (seventh embodiment) embodying this invention.

Seventh Embodiment:

FIG. 42 is an overall diagram showing an aluminum casting apparatus (seventh embodiment) according to this invention. The aluminum casting apparatus 280 has a casting apparatus proper 281 having a casting mold 282, an air discharging portion 240 for discharging air from the cavity 287 formed in the casting mold 282, an inert gas introducing portion 245 for introducing argon (Ar) gas (inert (rare) gas) into the cavity 287 from which air has been discharged, a magnesium introducing portion 250 for introducing gaseous magnesium (Mg) into the cavity 287 into which the inert gas has been introduced, a nitrogen gas introducing portion 260 for introducing nitrogen ($N_2$) gas into the cavity 287 into which the gaseous magnesium has been introduced, a detecting portion 265 for detecting the pressure in the cavity 287 and a control portion 270 for regulating the inside of the cavity 287 to a specific pressure based on information as detected by the detecting portion 265. The casting apparatus proper 281 includes a fixed plate 291 secured to a base 290, a stationary mold member 283 is secured to the fixed plate 291, a movable plate 292 is movably mounted on the base 290, a movable mold member 284 is secured to the movable plate 292, a device 293 for moving the movable plate 292 is mounted on the base 290 and a core 285 for the casting mold 282 is supported by the base 290 so as to be capable of being raised and lowered by a raising and lowering device 294. A sprue runner 295 opening to the cavity 287 is formed in the movable mold member 284, a sprue 296 is formed vertically from the sprue runner 295, while a pouring tank 297 holding molten aluminum 239 is situated above the sprue 296, and the casting mold 282 has an opening 298 formed at its top as a vent or feeder head. The stationary and movable mold members 283 and 284 and the core 285 constitute the casting mold 282. While FIG. 42 shows the sprue 296 and the opening 298 as being large relative to the cavity 287 to provide an easier understanding of the casting apparatus proper 281, the real sprue 296 and opening 298 are sufficiently small relative to the cavity 287 to enable the cavity 287 to keep a substantially completely closed state when the casting mold 282 is closed.

According to the aluminum casting apparatus 280, the movement of the movable plate 292 in the directions of arrows by the moving device 293 enables the movable mold member 284 to move between its mold closing position (position shown in the drawing) and its mold opening position. The movement of the core 285 in the directions of arrows by the raising and lowering device 294 enables the core 285 to move between its mold closing position (position shown in the drawing) and its mold opening position. The movable mold member 284 and the core 285 held in their mold closing positions enable the stationary and movable mold members 283 and 284 and the core 285 to form the cavity 287. If molten aluminum 239 is supplied into the cavity 287, it is possible to mold an aluminum casting in the cavity 287.

The casting apparatus proper 281 differs from the casting apparatus proper 221 according to the fifth embodiment in that it is so constructed as to allow molten aluminum 239 to flow into the cavity 287 by its own weight at the atmospheric pressure. The operation of the aluminum casting apparatus 280 (seventh embodiment) according to this invention, or the aluminum casting process will now be described in detail with reference to FIGS. 33 and 42 to 47. Step ST30 of FIG. 33 will first be explained. A drive signal is transmitted from the control portion 270 shown in FIG. 42 to the vacuum pump 242 to drive it and thereby discharge air from the cavity 287 into the atmosphere through the discharging passage 241. At the same time, an open signal is transmitted from the control portion 270 to the argon valve 248 to switch it to its open position. The argon valve 248 switched to its open position causes argon gas to be introduced from the argon gas bottle 247 into the cavity 287 through the introducing passage 246. After air has been discharged from the cavity 287, a stop signal is transmitted from the control portion 270 to the vacuum pump 242 to stop it. When the pressure of the cavity 287 as detected by the sensor 266 in the detecting portion 265 has reached a preset first pressure of 0.5 atmospheres below the atmospheric pressure, a close signal is transmitted from the control portion 270 to the argon valve 248 to turn it to its closed position. This makes it possible to purge the cavity 287 with an argon gas atmosphere. Air is discharged from the cavity 287 when the cavity 287 is purged with an argon gas atmosphere. This makes it possible to replace the air in the cavity 287 with an argon gas atmosphere within a short time. Moreover, the regulation of the cavity 287 to a first pressure makes it possible to prevent any invasion of air from the open atmosphere into the cavity 287 and thereby purge the cavity 287 with an argon gas atmosphere still more efficiently.

Figure 43:
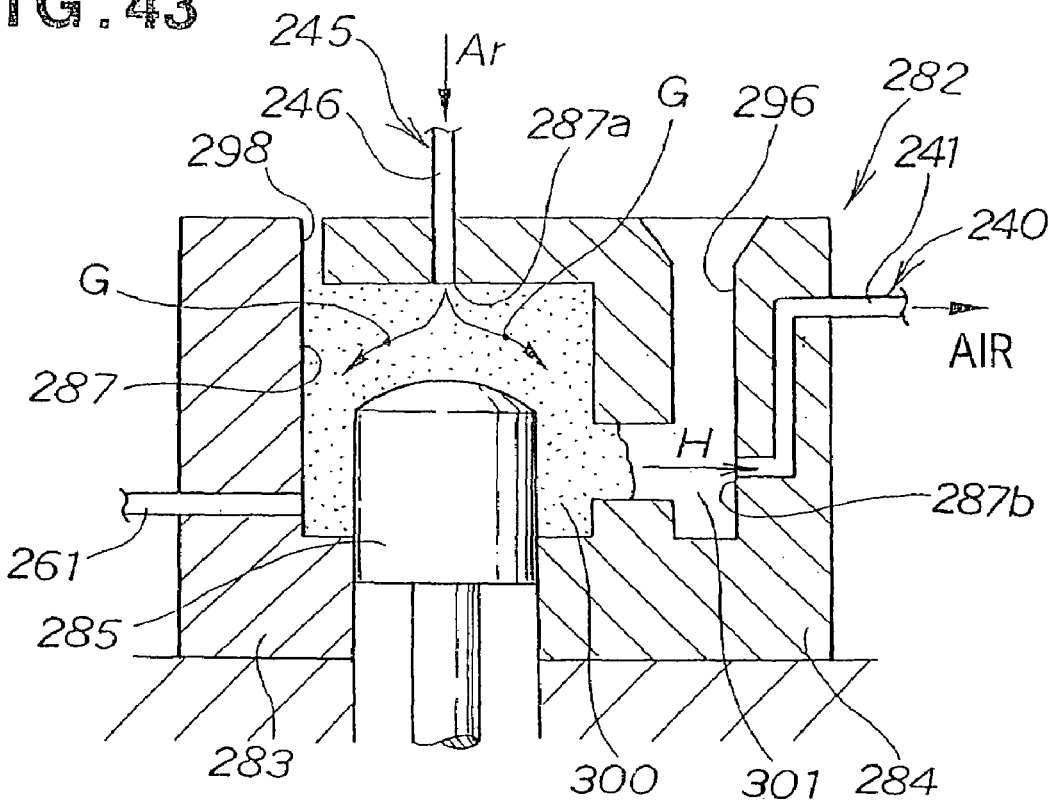
FIG. 43 is a diagram explaining an example in which air is discharged from the cavity in the apparatus according to the seventh embodiment of this invention.

FIG. 43 is a diagram for explaining an example in which air is discharged from the cavity in the apparatus according to the seventh embodiment of this invention. The position 287*a* where the introducing passage 246 in the inert gas introducing portion 245 (see FIG. 42, too) meets the cavity 287 is shown as being situated apart from the position 287*b* where the discharging passage 241 in the air discharging portion 240 (see FIG. 42, too) meets the cavity 287. The situation of the argon gas introducing passage 246 apart from the air discharging passage 241 makes it possible to urge an air zone 301 in the cavity 287 toward the discharging passage 241 efficiently, as an argon gas zone 300 expands when argon gas (shown in dots) is introduced into the cavity 287 as shown by arrows G through the argon gas introducing passage 246. This makes it possible to discharge air from the cavity 287 efficiently through the discharging passage 241 as shown by an arrow H. Accordingly, it is possible to discharge air from the cavity 287 and purge it with an argon gas atmosphere within a still shorter time.

Step ST31 of FIG. 33 will now be explained. Returning to FIG. 42, the sublimating heater 255 in the sublimating portion 253 is placed in its heating position in accordance with a signal from the control portion 270 to heat the inside of the holding case 254 to a specific temperature (for example, at least 400° C.). Heating the inside of the holding case 54 causes the magnesium ingot 58 to be sublimated into a gaseous form. An open signal is transmitted from the control portion 270 to the magnesium valve 257 to switch it to its open position. The magnesium valve 257 switched to its open position causes argon gas to be introduced from the argon gas bottle 247 into the holding case 254 through the first magnesium introducing passage 251. The introduced argon gas causes gaseous magnesium to be introduced into the cavity 287 through the second magnesium introducing passage 252 and the introducing passage 246. On that occasion, the cavity 287 has a second pressure regulated to a sub-atmospheric level (0.5 to 0.7 atmospheres). The first pressure (0.5 atmospheres) regulated like the second pressure (0.5 to 0.7 atmospheres) to a sub-atmospheric level makes it possible to change from the first to the second pressure within a short time. Accordingly, it is possible to suppress any time lag caused by a change from the first to the second pressure. The second magnesium introducing passage 252 and the introducing passage 246 are preferably heated when gaseous magnesium is introduced into the cavity 287, so that no magnesium may be deposited in the second magnesium introducing passage 252 or the introducing passage 246.

Figure 44:
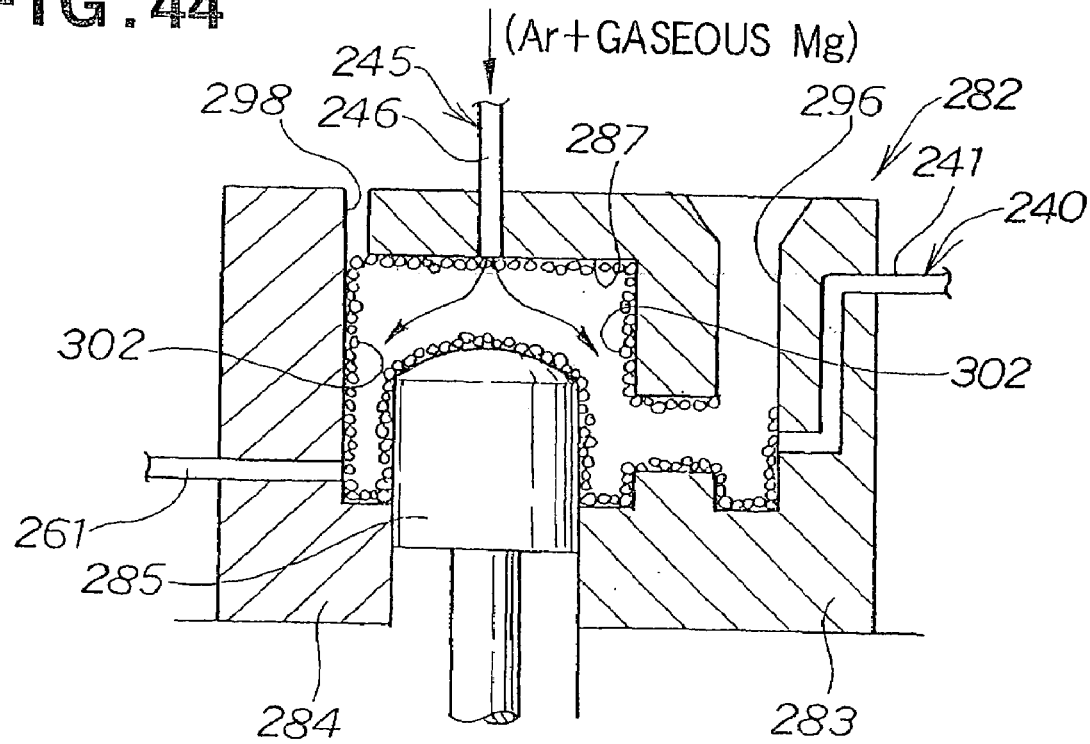
FIG. 44 is a diagram explaining an example in which magnesium is deposited on the cavity wall in the apparatus according to the seventh embodiment of this invention.

FIG. 44 is a diagram for explaining an example in which magnesium is deposited on the cavity wall in the apparatus according to the seventh embodiment of this invention. The gaseous magnesium introduced into the cavity 287 as shown by arrows has its temperature lowered to 150 to 250° C. by contacting the wall of the cavity 287. Its drop in temperature to 150 to 250° C. causes gaseous magnesium to be deposited on the wall of the cavity 287. The deposited magnesium is called a magnesium layer 302. The second pressure of the cavity 287 regulated to a sub-atmospheric level makes it possible to establish the condition facilitating the deposition of magnesium (i.e. the wall temperature of the cavity 287 in the range of 150 to 250° C.) easily in the cavity 287 and thereby have magnesium deposited efficiently. Returning to FIG. 42, a close signal is transmitted from the control portion 270 to the magnesium valve 257 to turn it to its closed position when the pressure of the cavity 287 as detected by the sensor 266 in the detecting portion 265 has reached the preset second pressure (0.5 to 0.7 atmospheres).

Step ST32 of FIG. 33 will now be explained. The heater 264 in the nitrogen gas introducing portion 260 is placed in its heating position in accordance with a signal from the control portion 270. An open signal is transmitted from the control portion 270 to the nitrogen valve 263 to switch it to its open position. The nitrogen valve 263 switched to its open position causes nitrogen gas to flow from the nitrogen gas bottle 62 into the nitrogen introducing passage 261. The nitrogen gas in the nitrogen introducing passage 261 is heated by the heater 264 and the heated nitrogen gas is introduced into the cavity 287 through the nitrogen introducing passage 261. At the same time, a drive signal is transmitted from the control portion 270 to the vacuum pump 242 to discharge gas from the cavity 287 into the open atmosphere through the discharging passage 241. This causes the pressure of the cavity 287 to be regulated to a third pressure P at a sub-atmospheric level of, for example, 0.7 to 0.8 atmospheres. The independent heating of nitrogen gas by the heater 264 makes it possible to heat nitrogen gas flowing in the nitrogen introducing passage 261 to a specific temperature (for example, at least 400° C.) efficiently.

Figure 45:
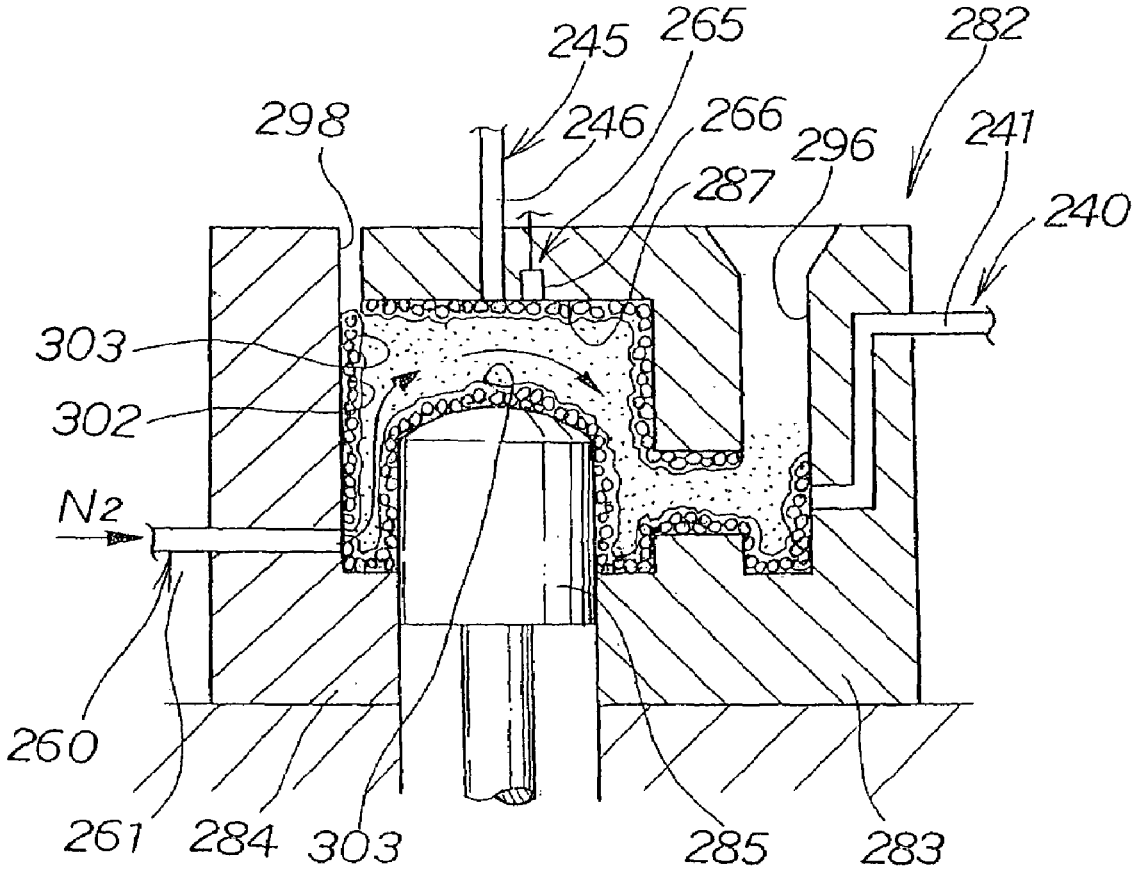
FIG. 45 is a diagram explaining an example in which magnesium nitride is formed in the apparatus according to the seventh embodiment of this invention.

FIG. 45 is a diagram for explaining an example in which magnesium nitride is formed in the apparatus according to the seventh embodiment of this invention. The third pressure P (atmosphere) of the cavity 287 and the temperature T (° C.) of nitrogen gas (shown in dots) in the cavity 287 are so selected as to maintain their relationship $P \leqq (T-270)/130$. If this condition is met, it is possible to have magnesium nitride 303 formed on the surface of the magnesium layer 302 by the reaction of the magnesium layer 302 deposited on the wall of the cavity 287 and the nitrogen gas. More specifically, their relationship $P \leqq (T-270)/130$ teaches that when the third pressure P of the cavity 287 as detected by the sensor 266 in the detecting portion 265 is, for example, 0.7 atmospheres, the temperature T of nitrogen gas in the cavity 287 may be regulated to 361° C. for forming magnesium nitride 303 on the surface of the magnesium layer 302, and also that when the third pressure P of the cavity 287 is 1 atmosphere, the temperature T of nitrogen gas in the cavity 287 may be regulated to 400° C. for forming magnesium nitride 103 on the surface of the magnesium layer 302. As the third pressure P and the temperature T of nitrogen gas in the cavity 287 are relatively easy to determine based on their relationship $P \leqq (T-270)/130$, it is possible to perform the adjustment of equipment within a short time. Moreover, nitrogen gas is heated and heated nitrogen gas is used for forming magnesium nitride 303. This makes it possible to form magnesium nitride 303 efficiently, as it is possible to heat nitrogen gas to a temperature at which magnesium nitride 303 is easy to form. The regulation of the third pressure P of the cavity 287 makes it possible to establish the conditions facilitating the deposition of magnesium nitride 303 (i.e. the third pressure P of 0.7 atmospheres and the gas temperature of 361° C. in the cavity 287) in the cavity 287 and thereby form magnesium nitride 303 efficiently. The third pressure P of the cavity 287 regulated to a sub-atmospheric level makes it possible to regulate the temperature of nitrogen gas in the cavity 287 to a temperature at which magnesium nitride 303 is easy to form.

For the formation of magnesium nitride 303, the magnesium layer 302 is first formed by magnesium deposited on the wall of the cavity 287 and then, nitrogen gas is introduced into the cavity 287 to form magnesium nitride 303 on the surface of the magnesium layer 302, as shown in FIGS. 44 and 45. Accordingly, it is possible to form magnesium nitride 303 on only the surface of the magnesium layer 302 and thereby shorten the time required for forming magnesium nitride 303. Moreover, it is possible to reduce the amount of nitrogen gas as required, since it is sufficient to form magnesium nitride 303 on only the surface of the magnesium layer 302.

Figure 46A:
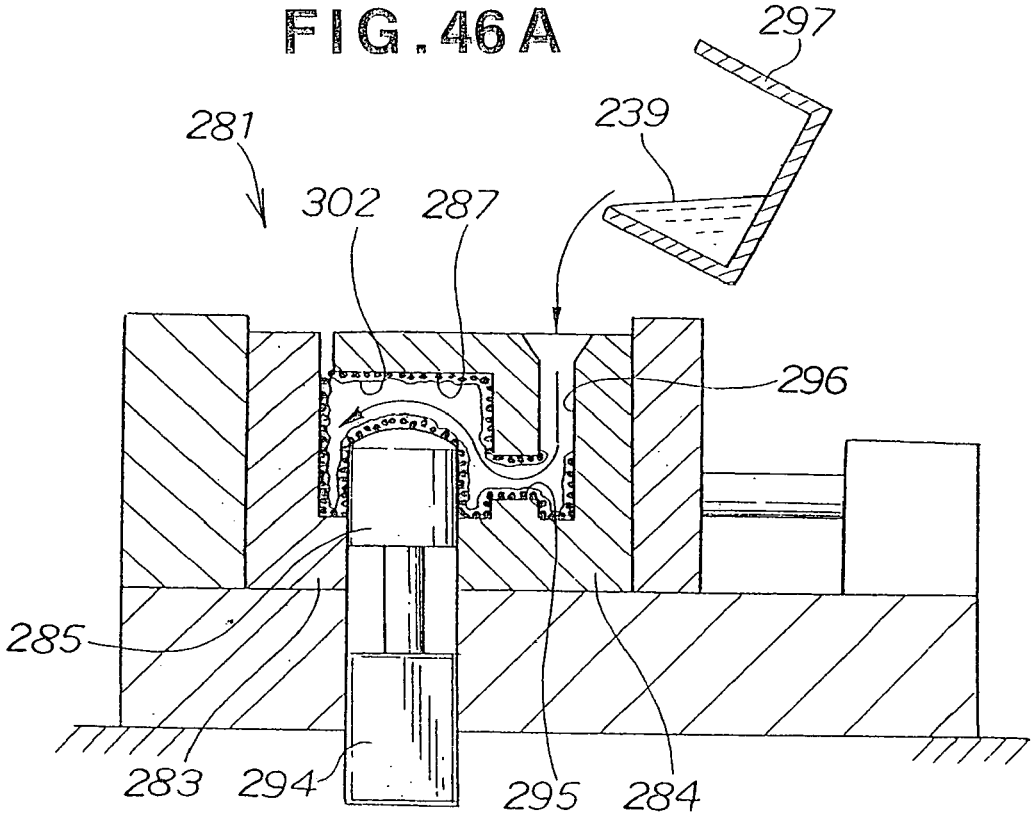
FIGS. 46A and 46B are diagrams explaining an example in which molten aluminum is supplied into the cavity in the apparatus according to the seventh embodiment of this invention.
Figure 46B:
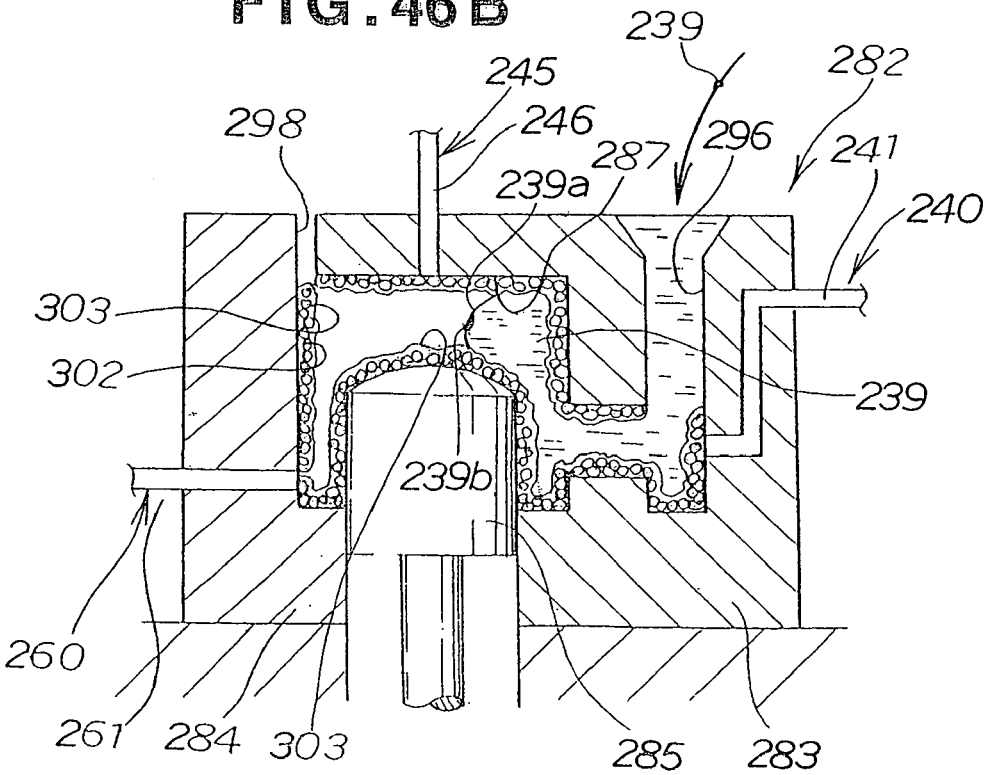

Step ST33 of FIG. 33 will now be explained. FIGS. 46A and 46B are diagrams for explaining an example in which molten aluminum is supplied into the cavity in the apparatus according to the seventh embodiment of this invention. Referring to FIG. 46A, the pouring tank 297 in the casting apparatus proper 281 is tilted to supply molten aluminum 239 from the pouring tank 297 into the cavity 287 through the sprue 296 and the runner 295 as shown by arrows. It is possible to fill the cavity 287 with molten aluminum 239 smoothly, since the cavity 287 has its third pressure P regulated to a sub-atmospheric level. Referring to FIG. 46B, the molten aluminum 239 supplied into the cavity 287 has its surface 239*a* contact magnesium nitride 303. It is likely that any oxide 239*b* may have been formed on the surface 239*a* of molten aluminum 239, and if any oxide 239*b* has been formed, its reaction with magnesium nitride 303 enables the removal of oxygen from the oxide 239*b*. This makes it possible to prevent the formation of any oxide film on the surface 239*a* of molten aluminum 239 and thereby suppress any increase in surface tension of molten aluminum 239. Accordingly, it is possible to maintain a good distribution of molten aluminum 239 in the cavity 287.

Figure 47A:
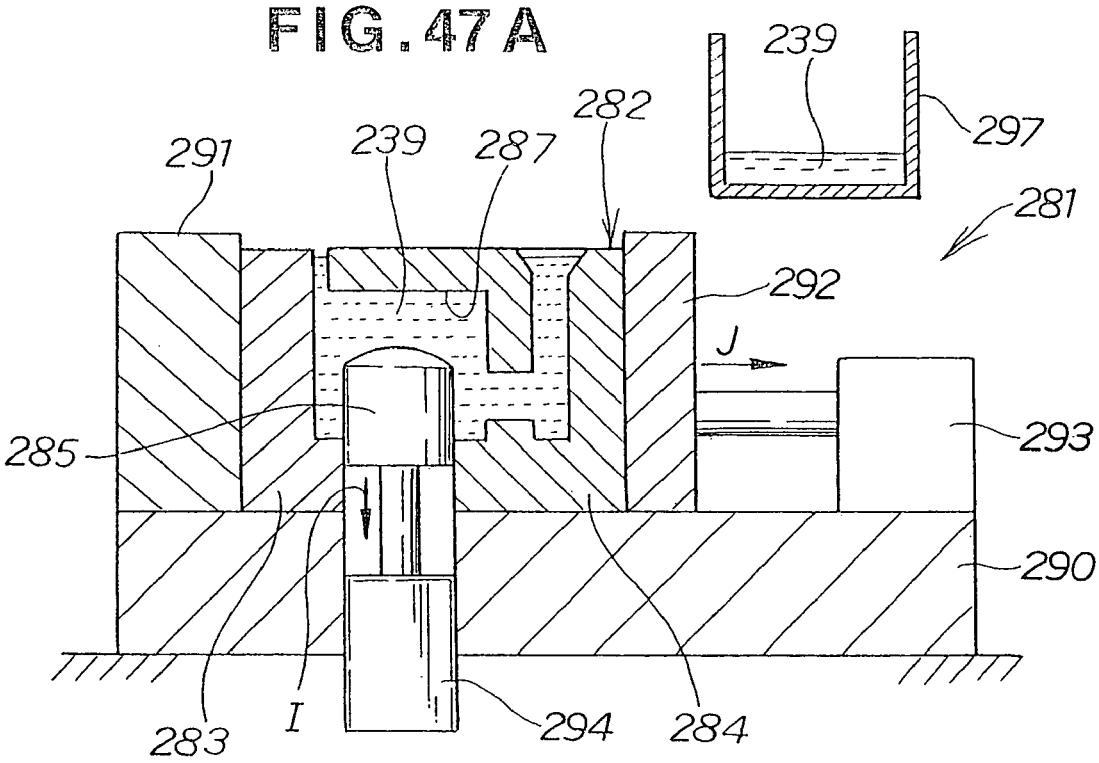
FIGS. 47A and 47B are diagrams explaining an example in which an aluminum casting is molded in the apparatus according to the seventh embodiment of this invention.
Figure 47B:
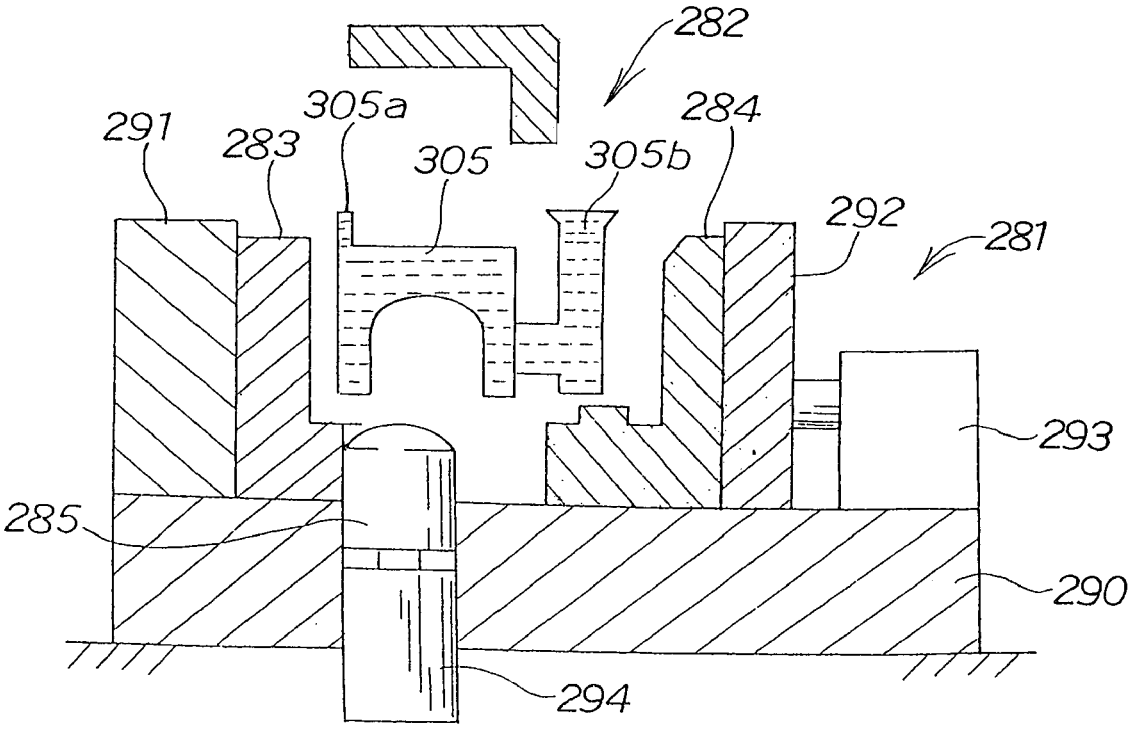

FIGS. 47A and 47B are diagrams for explaining an example in which an aluminum casting is molded in the apparatus according to the seventh embodiment of this invention. Referring to FIG. 47A, the pouring tank 297 is returned to its horizontal position after a specific amount of molten aluminum 239 has been supplied from the pouring tank 297 into the cavity 287. After molten aluminum 239 has solidified, the core 285 is lowered by the raising and lowering device 294 as shown by an arrow I and the movable mold member 284 is moved by the moving device 293 as shown by an arrow J, so that the casting mold 282 may be opened. Referring to FIG. 47B, the casting mold 282 is opened for the removal of an aluminum casting 305 obtained by the solidification of molten aluminum 239 (FIG. 47A). The aluminum casting 305 is a product of higher quality owing to a good distribution of molten metal as poured. The aluminum casting 305 has its non-product portions 305*a* and 305*b* removed and has its product portion worked on to give an engine cylinder block.

According to the seventh embodiment, the aluminum casting apparatus 280 includes the air discharging portion 240, inert gas introducing portion 245, magnesium introducing portion 250 and nitrogen gas introducing portion 260 and the control portion 270 controls the portions 240, 245, 250 and 260 to regulate the cavity 287 to a specific pressure, as described above. The regulation of the cavity 287 to a specific pressure by the control portion 270 makes it possible to deposit the magnesium layer 302 efficiently on the wall of the cavity 287 and form magnesium nitride 303 efficiently on the surface of the deposited magnesium layer 302. Therefore, it is possible to carry out the formation of the magnesium nitride 303 within a short time. Moreover, the formation of magnesium nitride 303 on only the surface of the magnesium layer 302 makes it possible to reduce the amount of nitrogen gas as required. According to the seventh embodiment, moreover, the control portion 270 is adapted to control the air discharging, inert gas introducing, magnesium introducing and nitrogen gas introducing portions 240, 245, 250 and 260 individually. This facilitates the regulation of the environment in the cavity 287 in accordance with the conditions for the deposition of the magnesium layer 302 and the conditions for the formation of magnesium nitride 303. The easy setting of the conditions for the deposition of the magnesium layer 302 and the conditions for the formation of magnesium nitride 303 makes it possible to carry out the formation of magnesium nitride 303 within a short time. According to the seventh embodiment, moreover, the control of the sublimating and heating devices 253 and 264 by the control portion 270 enables the sublimating device 253 to sublimate magnesium into a gaseous form efficiently and suitably and the heating device 264 to heat nitrogen gas efficiently and suitably. This makes it possible to deposit the magnesium layer 302 efficiently and form magnesium nitride 303 efficiently. Moreover, it is possible to carry out the deposition of the magnesium layer 302 and the formation of magnesium nitride 303 within a short time.

Eighth Embodiment:

Description will now be made of the eighth embodiment of this invention in which a cylinder block is molded by the aluminum casting apparatus 280 shown in FIG. 42. The eighth embodiment is characterized in that the cavity 287 has its first and second pressures set both at the atmospheric level and its third pressure P set at a sub-atmospheric or negative level. Incidentally, the first and second pressures and the third pressure P are all set at a sub-atmospheric level in the case of the aluminum casting process according to the seventh embodiment. As the first pressure set at the atmospheric level enables the pressure of the cavity 287 to be equal to that of the open atmosphere, it is possible to prevent still more reliably any invasion of air from the open atmosphere into the cavity 287 when the cavity 287 is purged with an argon gas atmosphere. The second pressure of the cavity 287 is also set at the atmospheric level. While the deposition of magnesium on the wall of the cavity 287 requires it to have a wall temperature lowered to a level of, say, 150 to 250° C. as explained in connection with the seventh embodiment, it is relatively easy to regulate the temperature to a level of say, 150 to 250° C. even if the second pressure of the cavity 287 may not be lowered to a sub-atmospheric level.

Magnesium is deposited at a temperature of 300° C. when the second pressure of the cavity 225 is set at the atmospheric level. It is sufficient to set the wall temperature of the cavity 287 at a level of, say, 150 to 250° C. for the satisfactory deposition of magnesium. The second pressure set at the atmospheric level enables the pressure of the cavity 287 to be equal to that of the open atmosphere. This makes it possible to prevent still more reliably any invasion of air from the open atmosphere into the cavity 287 when magnesium is deposited on the wall of the cavity 287. Thus, the first and second pressures set both at the atmospheric level make it possible to have magnesium nitride 303 formed on the wall of the cavity 287 still more efficiently, since it is possible to prevent any invasion of air into the cavity 287 still more reliably. It is also possible to suppress the formation of any oxide 239*b* on the surface 239*a* of molten aluminum 239 when the molten aluminum 239 is supplied into the cavity 287. Moreover, the third pressure P set at a sub-atmospheric or negative pressure makes it possible to charge the cavity 287 with molten aluminum 239 still more smoothly. For the regulation of the pressure of the cavity 287 from the second pressure (atmospheric) to the third pressure P (sub-atmospheric), a drive signal is transmitted from the control portion 270 to the vacuum pump 242 to drive it to discharge gas from the cavity 287 into the open atmosphere through the discharging passage 241 as in the case of the seventh embodiment. According to the eighth embodiment, therefore, the first and second pressures set both at the atmospheric level and the third pressure P set at a sub-atmospheric or negative level make it possible to carry out aluminum casting treatment still more efficiently and thereby achieve a still higher level of productivity.

The values of the first, second and third pressures as stated in the description of the fifth to eighth embodiments are merely illustrative, and not limitative. While the fifth to eighth embodiments have been described by reference to the example in which the pressure of the cavity 225 or 287 is detected by the sensor 266 in the detecting portion 265 and is regulated to a desired level based on pressure information as detected, it is alternatively possible to regulate the pressure of the cavity 225 or 287 to a desired level without employing any detecting portion 265. For example, it is possible to regulate the pressure of the cavity 225 or 287 to a desired level by controlling the control portion 270 in accordance with the previously taught conditions in the event that no detecting portion 265 is employed.

Figure 48:
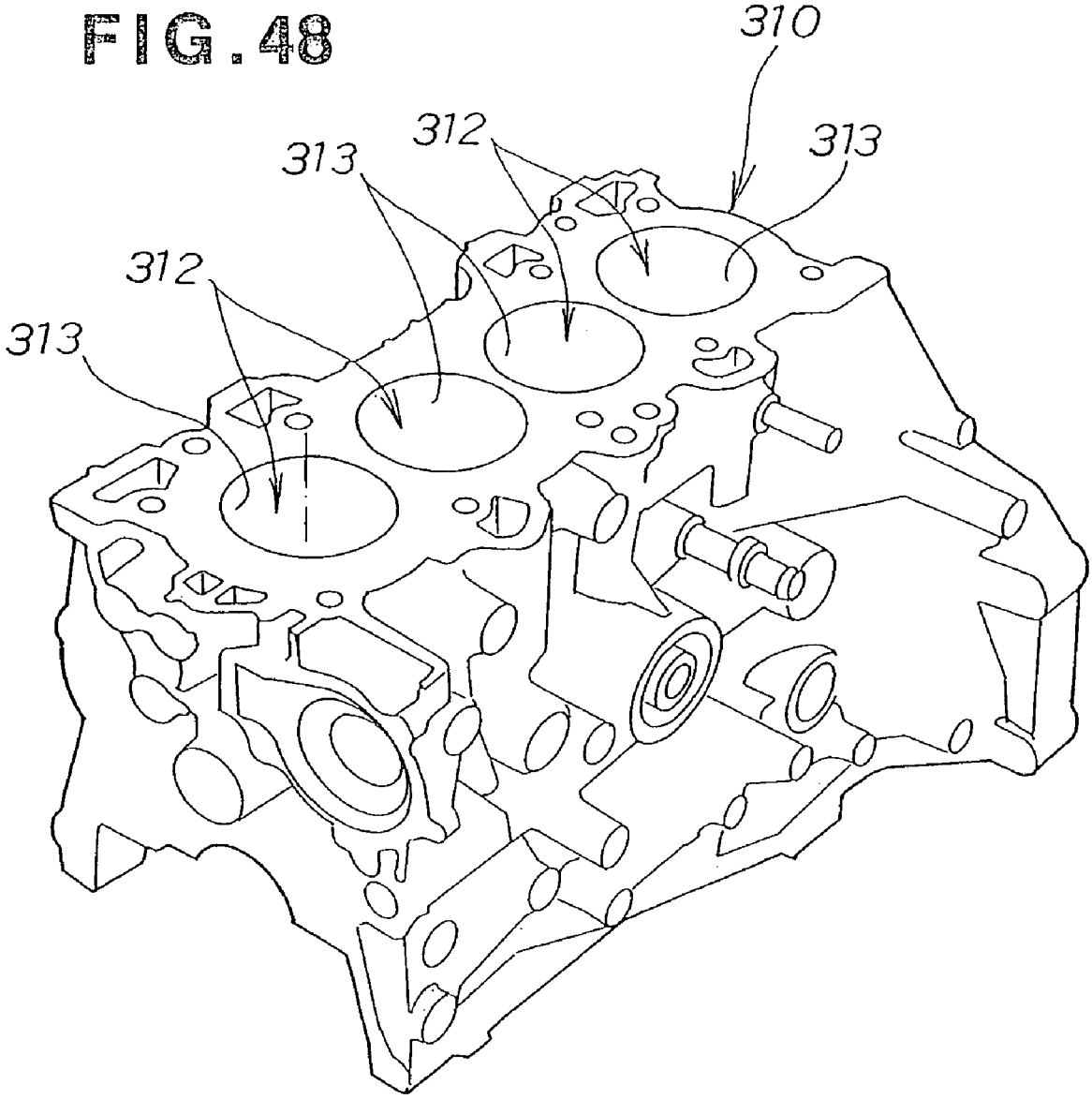
FIG. 48 is a perspective view of a cylinder block as molded by an aluminum casting process (ninth embodiment) using a casting mold and embodying this invention.

Ninth Embodiment:

The ninth embodiment will now be described with reference to FIGS. 48 to 56. FIG. 48 is a perspective view showing a cylinder block as molded by the aluminum casting process (ninth embodiment) using a casting mold and embodying this invention. The cylinder block 310 for an internal combustion engine is a cylinder block used for a four-cylinder engine, and is obtained by forming the inner peripheral surface 313 of each cylinder 312 and every other part on an aluminum casting as molded in a casting mold. Description will now be made of a process for molding an aluminum casting from which the cylinder block 310 for an internal combustion engine can be formed.

Figure 49:
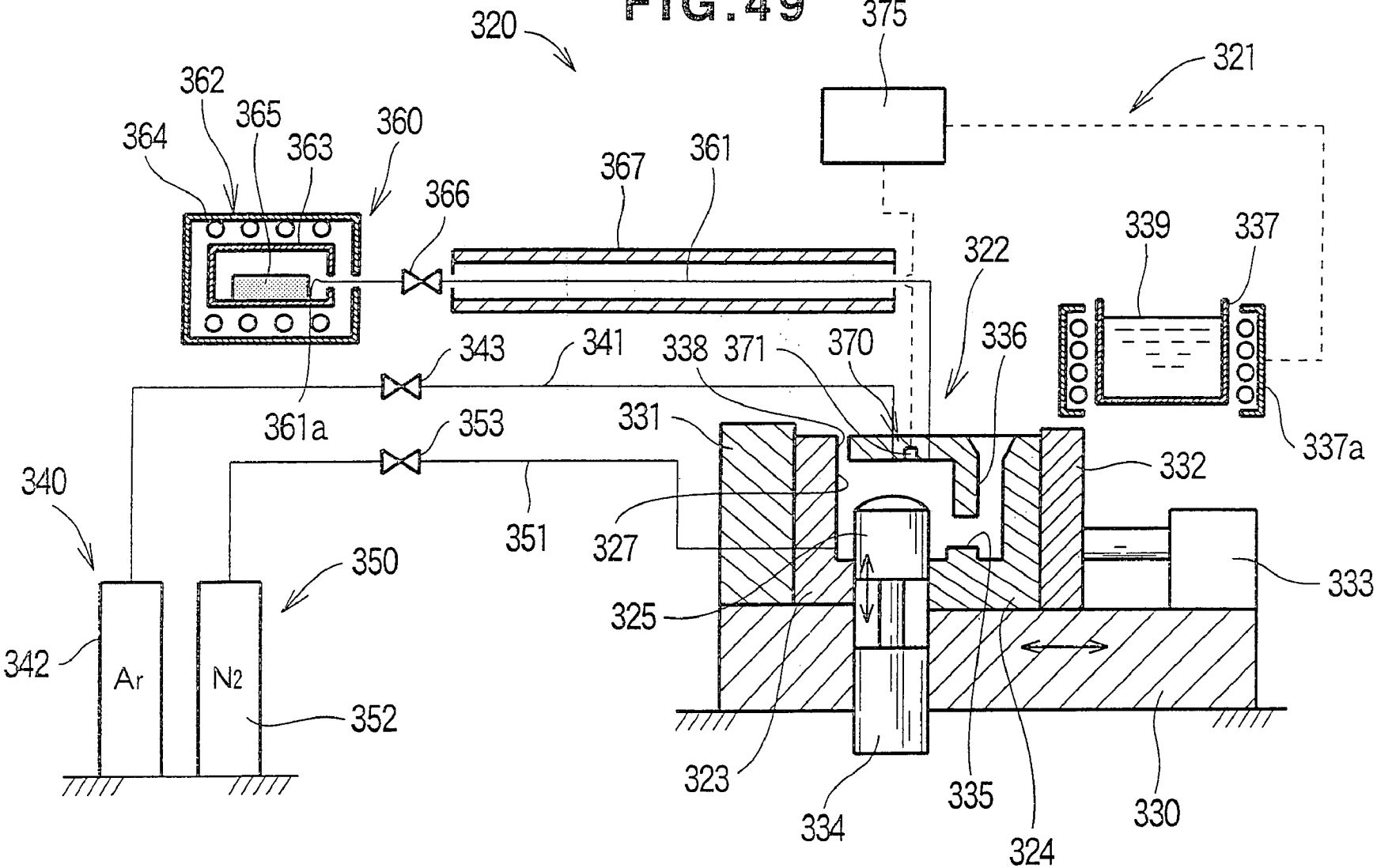
FIG. 49 is an overall diagram showing an aluminum casting apparatus for carrying out the aluminum casting process (ninth embodiment) using a casting mold and embodying this invention.

FIG. 49 is an overall diagram showing an aluminum casting apparatus for carrying out the aluminum casting process (ninth embodiment) using a casting mold and embodying this invention. The aluminum casting apparatus 320 has a casting apparatus proper 321 having a casting mold 322, an inert gas introducing portion 340 for introducing argon (Ar) gas (inert (rare) gas) into the cavity 327 formed in the casting mold 322, a nitrogen gas introducing portion 350 for introducing nitrogen ($N_2$) gas into the cavity 327 and a magnesium introducing portion 360 for introducing gaseous magnesium (Mg) gas into the cavity 327. The casting apparatus proper 321 includes a fixed plate 331 secured to a base 330, a stationary mold member 323 is secured to the fixed plate 331, a movable plate 332 is movably mounted on the base 330, a movable mold member 324 is secured to the movable plate 332, a device 333 for moving the movable plate 332 is mounted on the base 330 and a core 325 for the casting mold 322 is supported by the base 330 so as to be capable of being raised and lowered by a raising and lowering device 334. A sprue runner 335 opening to the cavity 327 is formed in the movable mold member 324, a sprue 336 is formed vertically from the sprue runner 335, while a pouring tank 337 holding molten aluminum 339 is situated above the sprue 336 and surrounded by a pouring tank heater 337*a* and the casting mold 322 has an opening 338 formed at its top as a vent or feeder head. The stationary and movable mold members 323 and 324 and the core 325 constitute the casting mold 322. While FIG. 49 shows the sprue 336 and the opening 338 as being large relative to the cavity 327 to provide an easier understanding of the casting apparatus proper 321, the real sprue 336 and opening 338 are sufficiently small relative to the cavity 327 to enable the cavity 327 to keep a substantially completely closed state when the casting mold 322 is closed.

According to the aluminum casting apparatus 320, the movement of the movable plate 332 in the directions of arrows by the moving device 333 enables the movable mold member 324 to move between its mold closing position (position shown in the drawing) and its mold opening position. The movement of the core 325 in the directions of arrows by the raising and lowering device 334 enables the core 325 to move between its mold closing position (position shown in the drawing) and its mold opening position. The movable mold member 324 and the core 325 held in their mold closing positions enable the casting mold 322 (stationary and movable mold members 323 and 324 and the core 325) to form the cavity 327. If molten aluminum 339 is supplied into the cavity 327, it is possible to mold an aluminum casting in the cavity 327.

The inert gas introducing portion 340 has an argon gas bottle 342 connected to the cavity 327 by an argon introducing passage 341 provided with an argon valve 343 midway. The argon valve 343 is a valve for switching the argon introducing passage 341 between its open and closed positions. The argon valve 343 enables argon to be introduced from the argon gas bottle 342 into the cavity 327 through the argon introducing passage 341 when it is switched to its open position.

The nitrogen introducing portion 350 has a nitrogen gas bottle 352 connected with the cavity 327 through a nitrogen introducing passage 351 provided with a nitrogen valve 353. The nitrogen valve 353 is a valve for switching the nitrogen introducing passage 351 between its open and closed positions. The nitrogen valve 353 makes it possible to introduce nitrogen gas from the nitrogen gas bottle 352 into the cavity 327 through the nitrogen introducing passage 351 when it is switched to its open position.

The magnesium introducing portion 360 has a sublimating device 362 connected with the cavity 327 by a magnesium introducing passages 361 provided with a magnesium valve 366 midway. The sublimating device 362 has a holding case 363 connected with the inlet end 361*a* of the magnesium introducing passage 361 and a sublimating heater 364 surrounding the holding case 363. The sublimating heater 364 can heat the inside of the holding case 363 to a specific temperature (for example, at least 400° C.) and thereby sublimate a magnesium ingot (magnesium) 365 in the holding case 363 into a gaseous form. The magnesium valve 366 is a valve for switching the magnesium introducing passage 361 between its open and closed positions. The magnesium valve 366 makes it possible to introduce gaseous magnesium into the cavity 327 through the magnesium introducing passage 361 when it is switched to its open position.

It is likely that gaseous magnesium may be cooled and deposited in the magnesium introducing passage 361 while flowing in the magnesium introducing passage 361. A heat-insulating material 367, therefore, surrounds the magnesium introducing passage 361 to keep the temperature of the magnesium introducing passage 361 at an appropriate level. This makes it possible to prevent any gaseous magnesium from being deposited in the magnesium introducing passage 361. It is also likely that gaseous magnesium filling the cavity may be deposited on its wall if the casting mold 322 is cooled to or below a specific temperature. The cavity has, however, a temperature higher than the specific level, since the casting mold 322 is heated by molten aluminum during the casting process. Therefore, it is possible to prevent any gaseous magnesium from being deposited on the cavity wall.

A temperature detecting portion 370 includes a temperature sensor 371 situated at the top of the cavity 327 for detecting the temperature of poured molten aluminum in the cavity 327 and transmitting information as detected to a control portion 375. The control portion 375 performs the on-off control of the pouring tank heater 337*a* to maintain the temperature of poured molten aluminum at a set level in accordance with the information received from the temperature detecting portion 370 on the temperature of poured molten metal as detected. More specifically, the control portion 375 performs the on-off control of the pouring tank heater 337*a* so as to maintain the temperature of molten aluminum 339 at 600 to 750° C. The control portion 375 has the pouring tank heater 337*a* turned on to heat molten aluminum in the event that it has concluded in accordance with the information received from the temperature detecting portion 370 on the temperature of poured molten metal as detected that it is necessary to raise the temperature of molten aluminum in the pouring tank 337. On the other hand, the control portion 375 has the pouring tank heater 337*a* turned off to allow molten aluminum to cool in the event that it has concluded in accordance with the information received from the temperature detecting portion 370 on the temperature of poured molten metal as detected that it is necessary to hold or lower the temperature of molten aluminum in the pouring tank.

Figure 50:
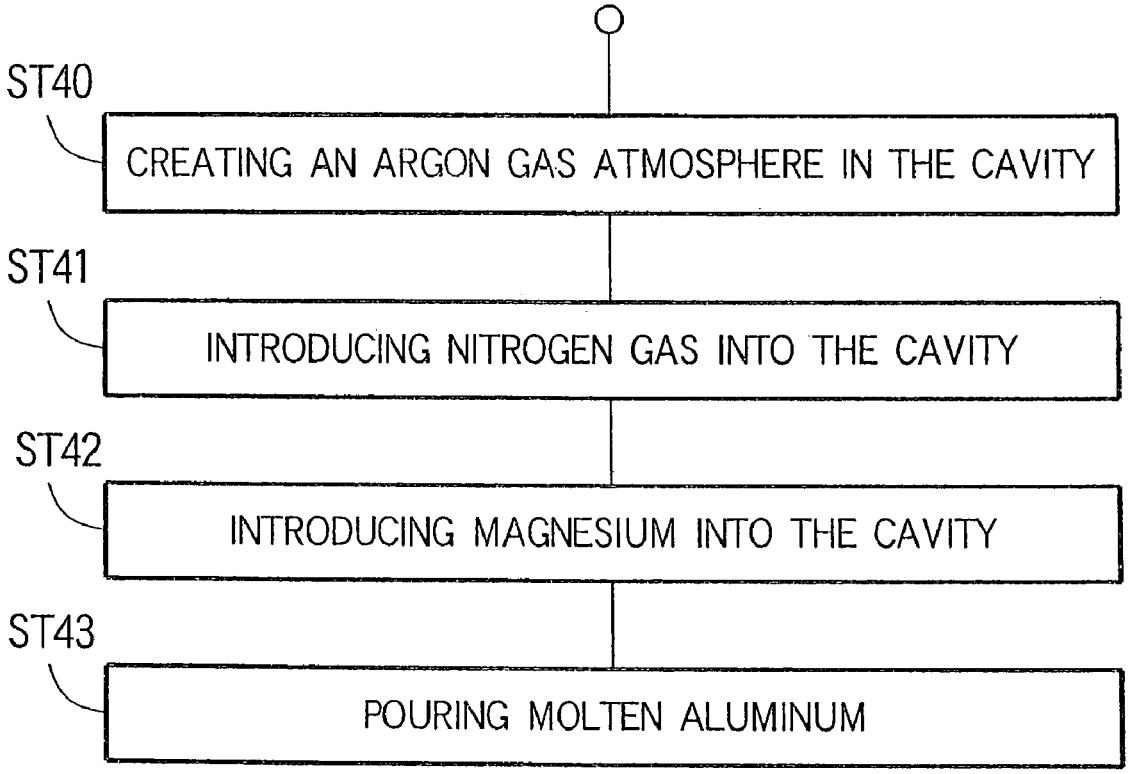
FIG. 50 is a flowchart explaining the aluminum casting process (ninth embodiment) using a casting mold and embodying this invention.

Description will now be made of an example in which the casting process according to the ninth embodiment of this invention is carried out by the aluminum casting apparatus 320. FIG. 50 is a flowchart explaining the aluminum casting process (ninth embodiment) using a casting mold and embodying this invention, and each ST-- indicates Step No.

ST40: An inert gas (argon) is charged into the cavity of a closed mold to replace the air in the cavity.

ST41: Nitrogen gas is introduced into the cavity filled with the inert gas.

ST42: Gaseous magnesium is introduced into the cavity into which nitrogen gas has been introduced.

ST43: Molten aluminum is poured into the cavity. When step ST43 is taken, the heat of poured molten aluminum causes nitrogen and magnesium gases in the cavity to react to form a solid magnesium-nitrogen compound. The formation of the magnesium-nitrogen compound creates a reduced pressure in the cavity. Moreover, the magnesium-nitrogen compound as formed removes any oxide film formed on the surface of molten aluminum.

Figure 51:
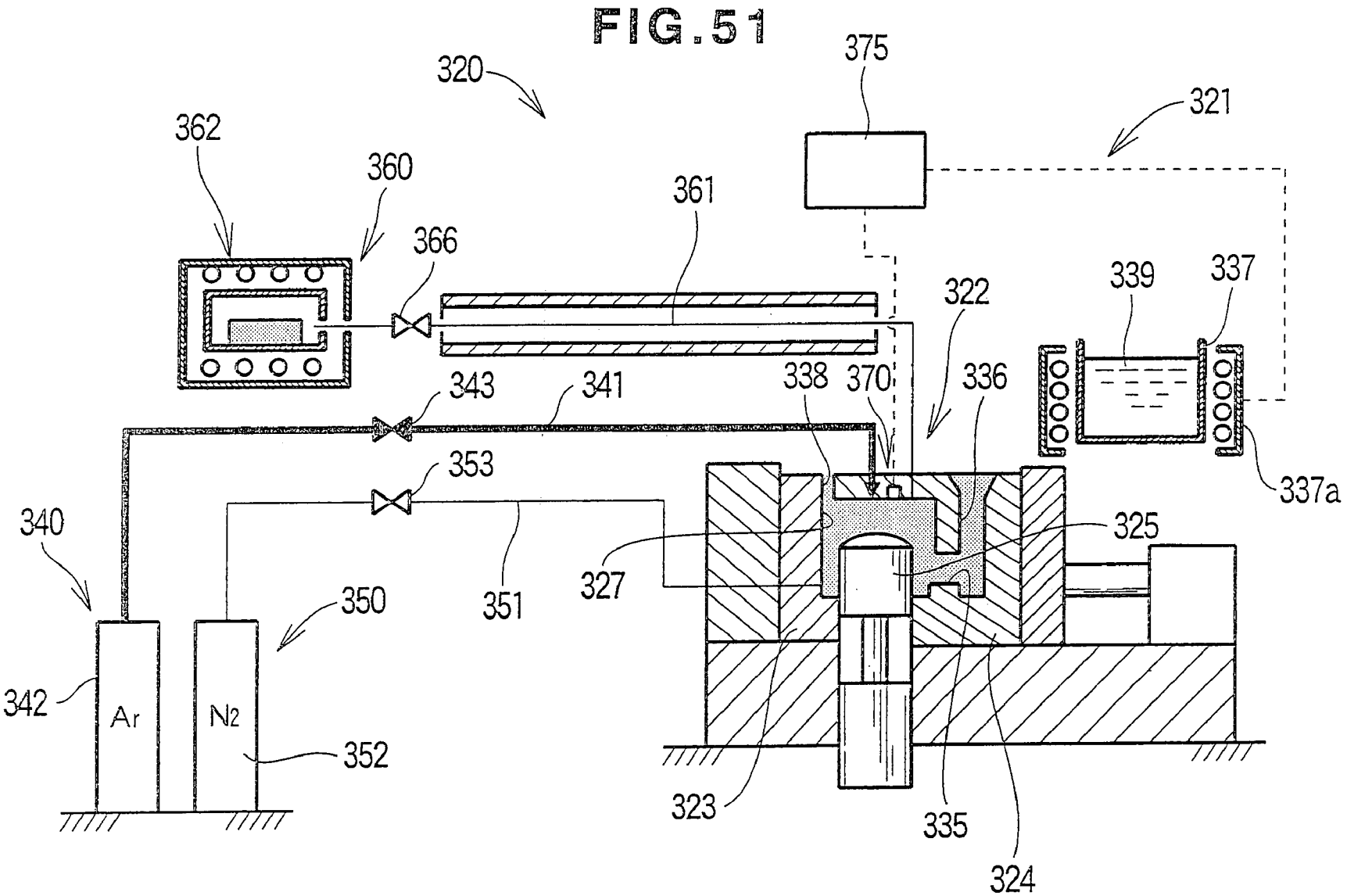
FIG. 51 is a diagram explaining an example in which an argon gas atmosphere is created in a cavity in the aluminum casting process according to the ninth embodiment of this invention.

Steps ST40 to ST43 of the aluminum casting process (ninth embodiment) using a casting mold and embodying this invention will now be described in detail with reference to FIGS. 51 to 56. FIG. 51 is a diagram for explaining an example in which an argon gas atmosphere is created in the cavity in accordance with the aluminum casting process according to the ninth embodiment of this invention, and it shows ST40. The argon valve 343 is switched to its open position to introduce argon gas from the argon gas bottle 342 into the cavity 327 through the argon introducing passage 341. The argon gas filling the cavity 327 expels air from the cavity 327 through, for example, the runner 335, sprue 336 or feeder head opening 338. As a result, an argon gas atmosphere is created in the cavity 327. After an argon gas atmosphere is created in the cavity 327, the argon valve 343 is switched to its closed position.

Figure 52:
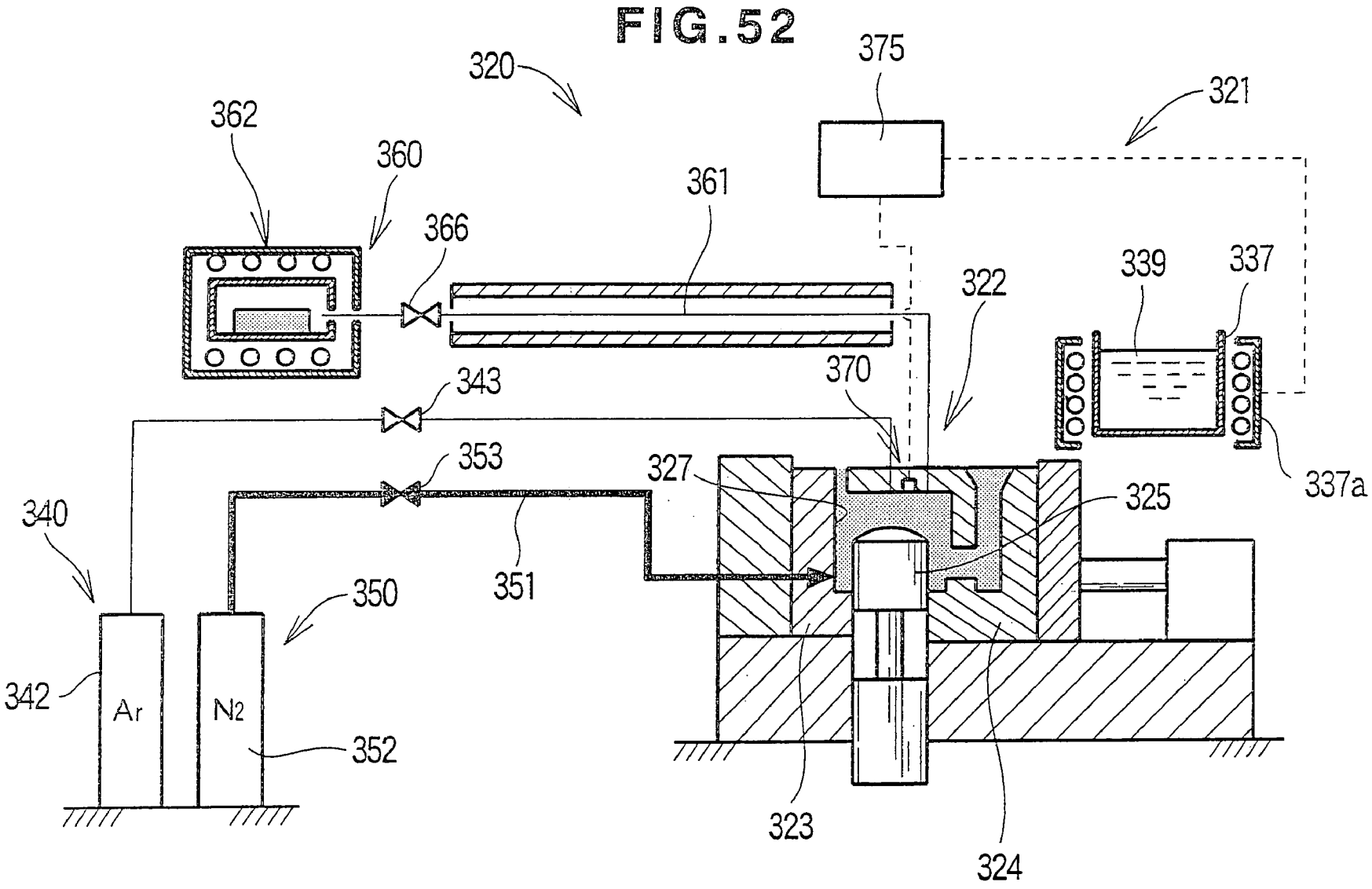
FIG. 52 is a diagram explaining an example in which nitrogen gas is introduced into the cavity in the aluminum casting process according to the ninth embodiment of this invention.

FIG. 52 is a diagram for explaining an example in which nitrogen gas is introduced into the cavity in accordance with the aluminum casting process according to the ninth embodiment of this invention, and it shows ST41. The nitrogen valve 353 is switched to its open position to introduce nitrogen gas from the nitrogen gas bottle 352 into the cavity 327 through the nitrogen introducing passage 351. The nitrogen valve 353 is switched to its closed position after nitrogen gas has been introduced into the cavity 327.

Figure 53:
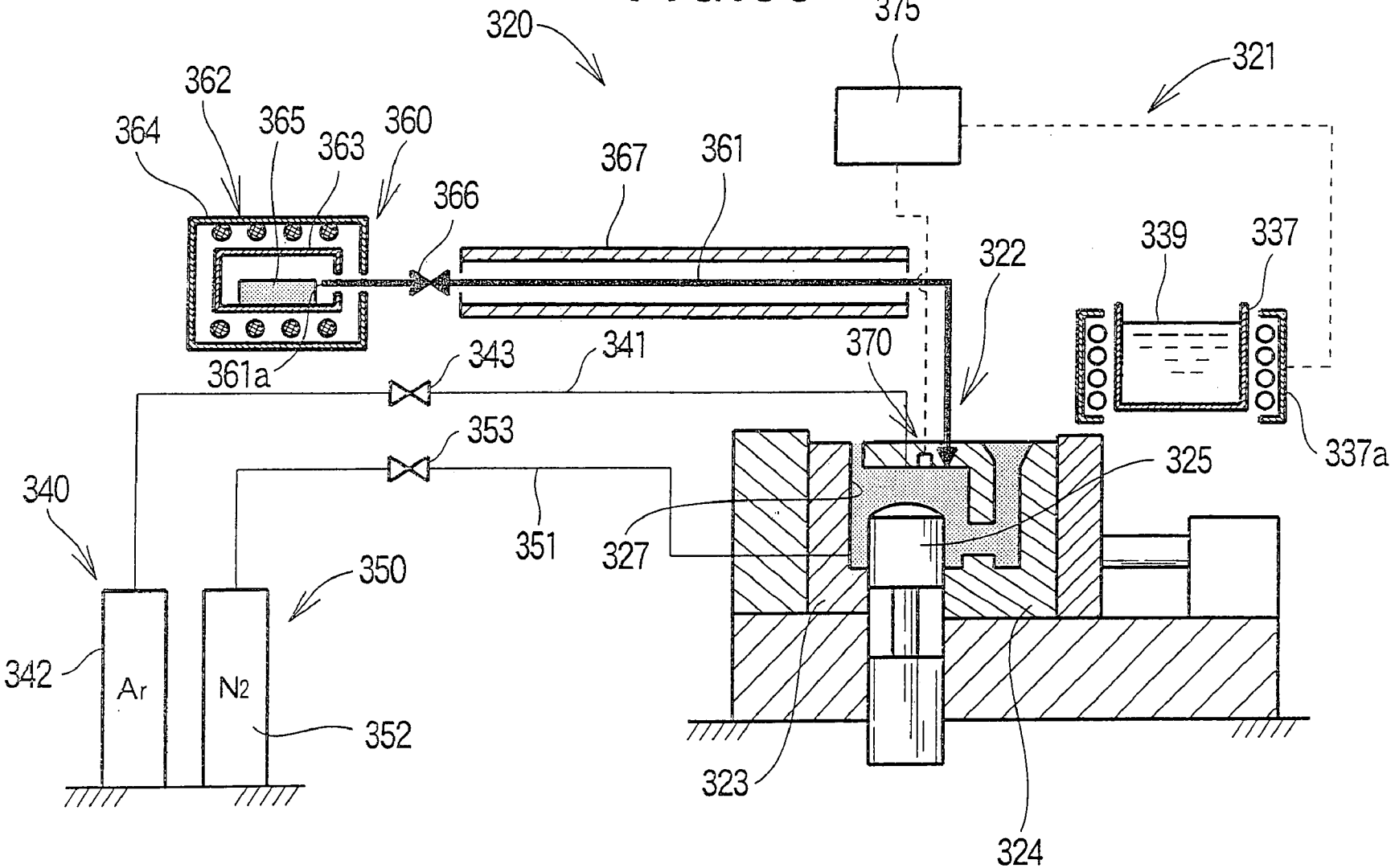
FIG. 53 is a diagram explaining an example in which gaseous magnesium is introduced into the cavity in the aluminum casting process according to the ninth embodiment of this invention.

FIG. 53 is a diagram for explaining an example in which gaseous magnesium is introduced into the cavity in accordance with the aluminum casting process according to the ninth embodiment of this invention, and it shows ST42. The sublimating heater 364 in the sublimating portion 362 is placed in its heating position to heat the inside of the holding case 363 to a specific temperature (for example, at least 400° C.). Heating the inside of the holding case 363 causes the magnesium ingot 365 to be sublimated into a gaseous form. The magnesium valve 366 is switched to its open position to allow gaseous magnesium filling the holding case 363 to be introduced into the cavity 327 through the magnesium introducing passage 361. The magnesium valve 366 is switched to its closed position after gaseous magnesium has been introduced into the cavity 327.

Figure 54A:
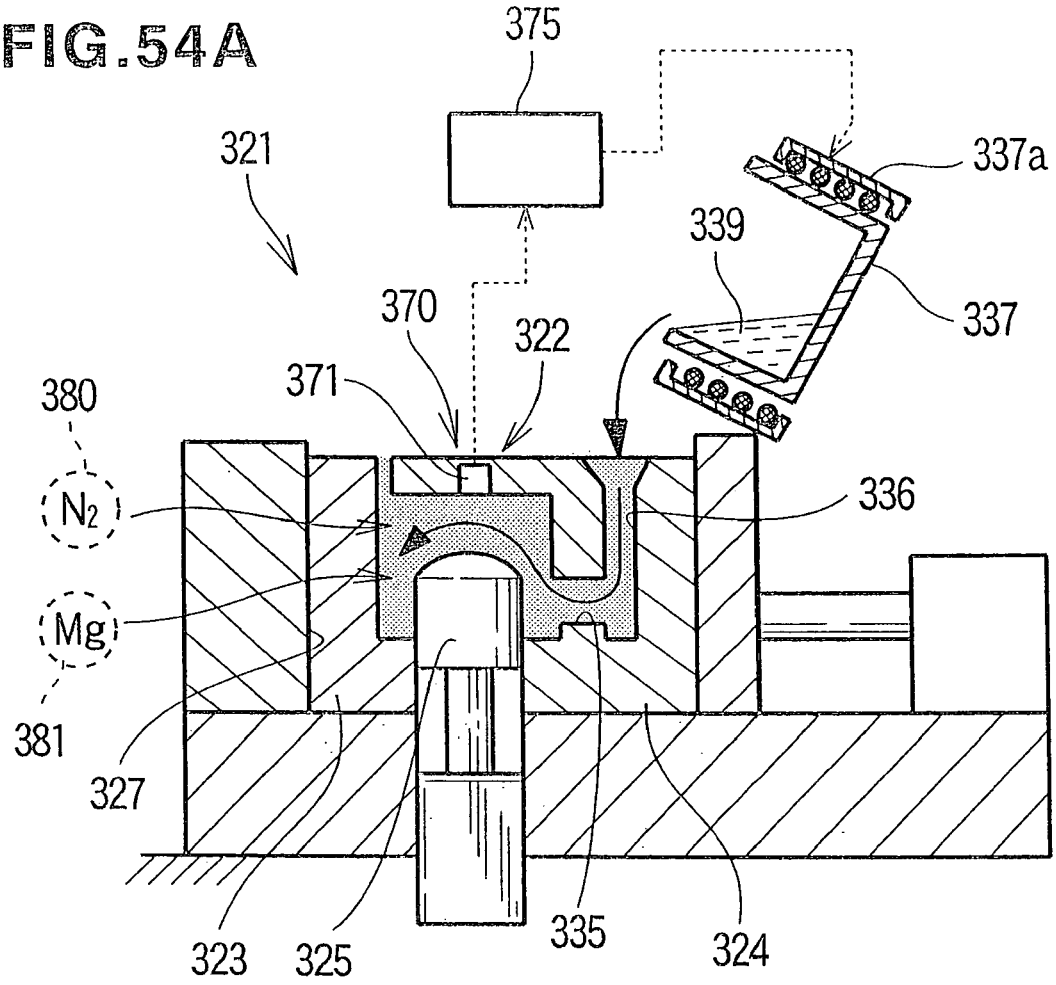
FIGS. 54A and 54B are diagrams explaining an example in which molten aluminum is supplied into the cavity in the aluminum casting process according to the ninth embodiment of this invention.
Figure 54B:
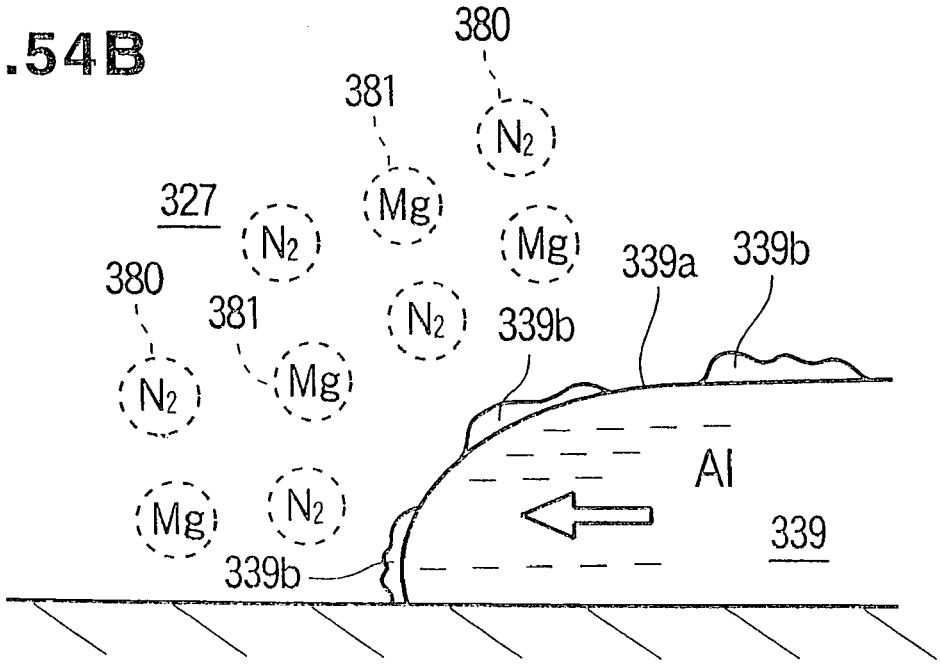

FIGS. 54A and 54B are diagrams for explaining an example in which molten aluminum is supplied into the cavity in accordance with the aluminum casting process according to the ninth embodiment of this invention, and it shows the former half of ST43. Referring to FIG. 54A, the pouring tank 337 in the casting apparatus proper 321 is tilted to supply molten aluminum 339 into the cavity 337 through the sprue 336 and the runner 335 as shown by arrows. Molten aluminum 339 has a temperature set at 600 to 750° C. Referring to FIG. 54B, the cavity 327 is filled with nitrogen gas 380 and magnesium gas 381. The cavity 327 contains also argon gas, though in a small amount. Molten aluminum 339 flows into the cavity 327 as described. It is likely that molten aluminum 339 may have a surface 339*a* exposed to air before reaching the cavity 327 from the pouring tank 337, and may have oxide ($Al_2O_3$) formed on its surface 339*a*.

Figure 55A:
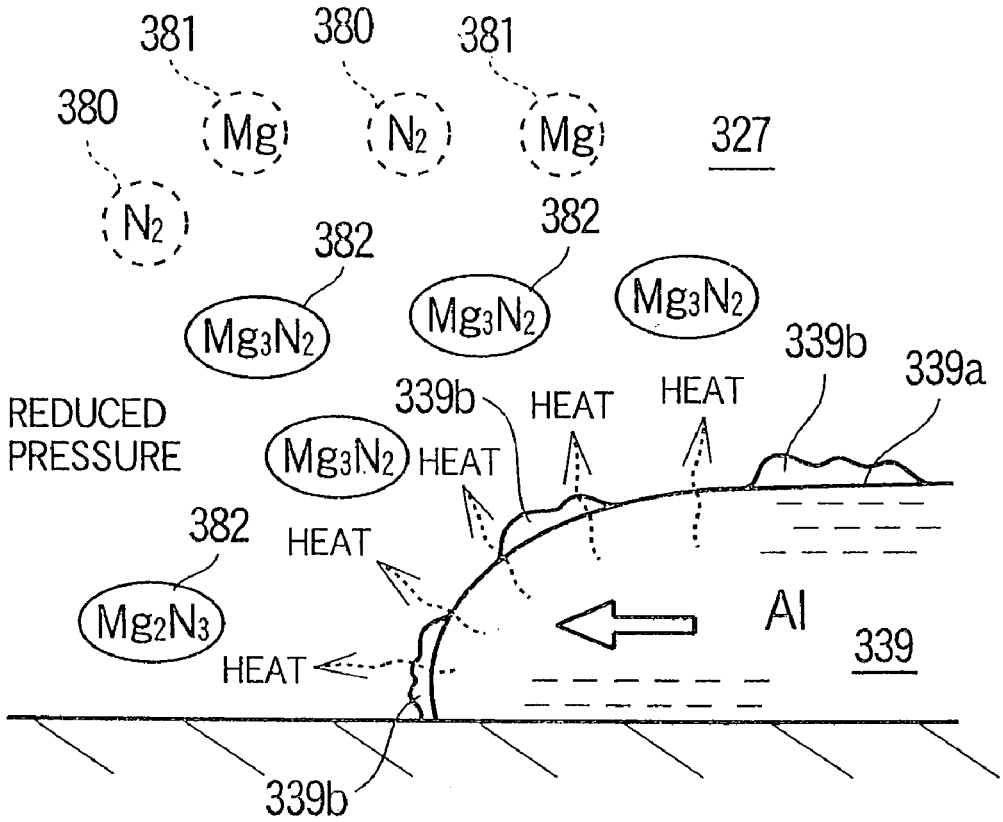
FIGS. 55A and 55B are diagrams explaining an example in which the formation of any oxide or oxide film on the surface of molten aluminum is prevented in the aluminum casting process according to the ninth embodiment of this invention.
Figure 55B:
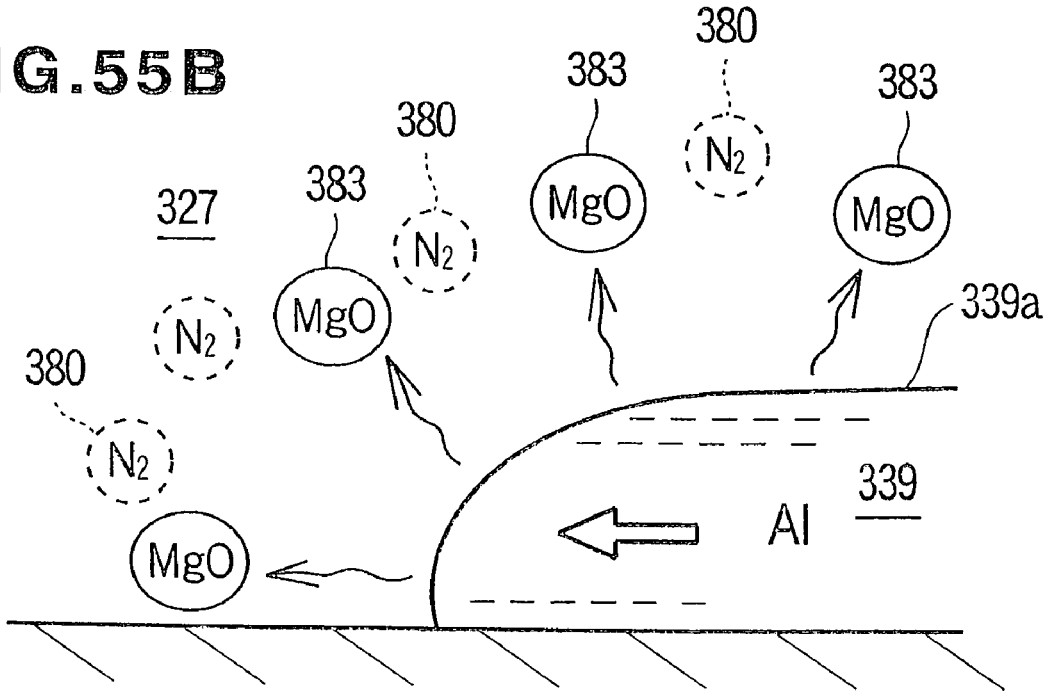

FIGS. 55A and 55B are diagrams for explaining an example in which the formation of any oxide or oxide film on the molten aluminum surface is prevented in accordance with the aluminum casting process according to the ninth embodiment of this invention, and it shows the middle half of ST43. Referring to FIG. 55A, the heat of molten aluminum 339 flowing into the cavity 327 causes the nitrogen gas 380 and magnesium gas 381 to react to form a solid magnesium-nitrogen compound ($Mg_3N_2$) 382. The solidifying reaction of the gases in the cavity 327 (nitrogen gas 380 and magnesium gas 381) as described makes it possible to reduce the gases in the cavity 327 and create a reduced pressure in the cavity 327. Accordingly, it is possible to achieve an improved distribution of molten aluminum 339 in the cavity 327. Moreover, the cavity 327 has an argon gas atmosphere created by replacing the air in the cavity 327 with argon gas before the cavity 327 is filled with nitrogen gas 380 and magnesium gas 381. This makes it possible to remove oxygen from the cavity 327 and thereby prevent the formation of any oxide or oxide film on the surface 339*a* of molten aluminum 339 when molten aluminum 339 is poured.

The following is the reason why molten aluminum 339 has a temperature set at 600 to 750° C. If the temperature of molten aluminum 339 is lower than 600° C., nitrogen and magnesium gases 380 and 381 fail to react satisfactorily. Thus, the temperature of molten aluminum 339 is set to be at least 600° C. so that nitrogen and magnesium gases 380 and 381 may react desirably. If the temperature of molten aluminum 339 exceeds 750° C., molten aluminum 339 requires a long solidifying time making it difficult to achieve high productivity, and it is also likely that the durability of the casting mold 322 may become lower. Thus, the temperature of molten aluminum 339 is so set as not to be higher than 750° C., so that no lowering of productivity may occur, while the durability of the casting mold 322 is raised.

Referring to FIG. 55B, the magnesium-nitrogen compound as formed ($Mg_3N_2$) 382 (shown in FIG. 55A) and the oxide ($Al_2O_3$) 339*b* (shown in FIG. 55A) formed on the surface 339*a* of molten aluminum 339 react to form aluminum (Al), nitrogen gas ($N_2$) 380 and magnesium oxide (MgO) 383. Thus, the magnesium-nitrogen compound 382 (shown in FIG. 55A) as formed removes the oxide 339*b* (shown in FIG. 55A) formed on the surface 339*a* of molten aluminum 339 and thereby makes it possible to prevent the formation of any oxide film on the surface 339*a* of molten aluminum 339 and suppress any increase in surface tension of molten aluminum 339. The suppressed surface tension of molten aluminum 339 makes it possible to maintain a good distribution of molten aluminum 339 in the cavity 327. The distribution of molten aluminum 339 is improved a distribution by suppressing any increase in its surface tension, while moreover creating a reduced pressure in the cavity 327, as described. Thus, it is possible to achieve a still improved distribution of molten aluminum 339. It is, therefore, possible to achieve a shortened cycle time for the casting process and thereby an improved productivity.

Figure 56A:
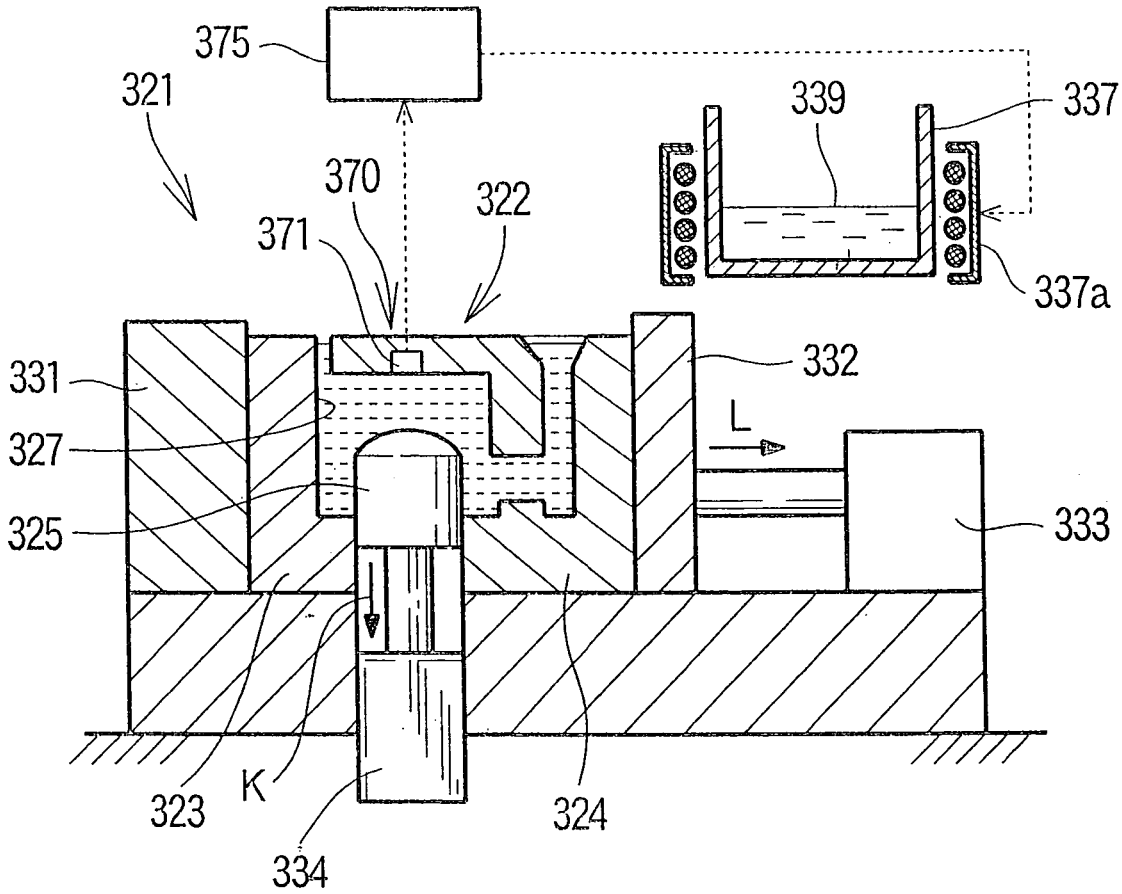
FIGS. 56A and 56B are diagrams explaining an example in which an aluminum casting is molded in the aluminum casting process according to the ninth embodiment of this invention.
Figure 56B:
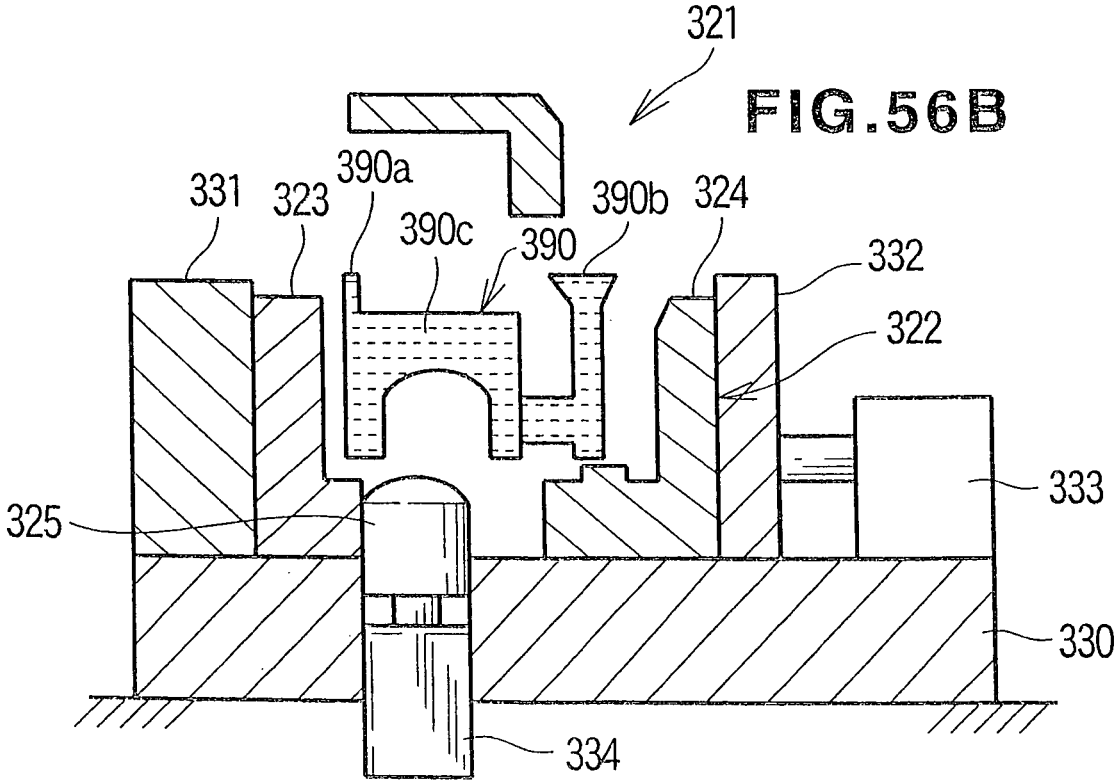
Figure 57:
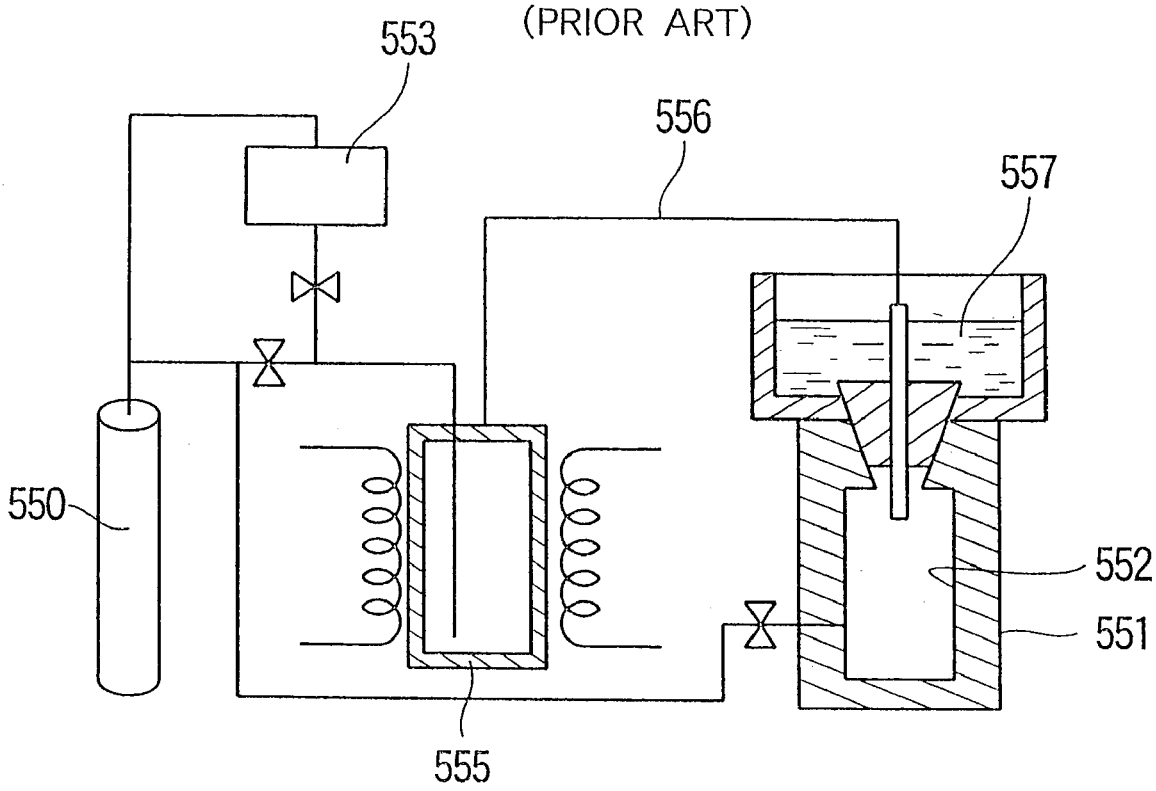
FIG.57 (PRIOR ART)
FIG. 57 is a diagram explaining a known aluminum casting process.
Figure 58:
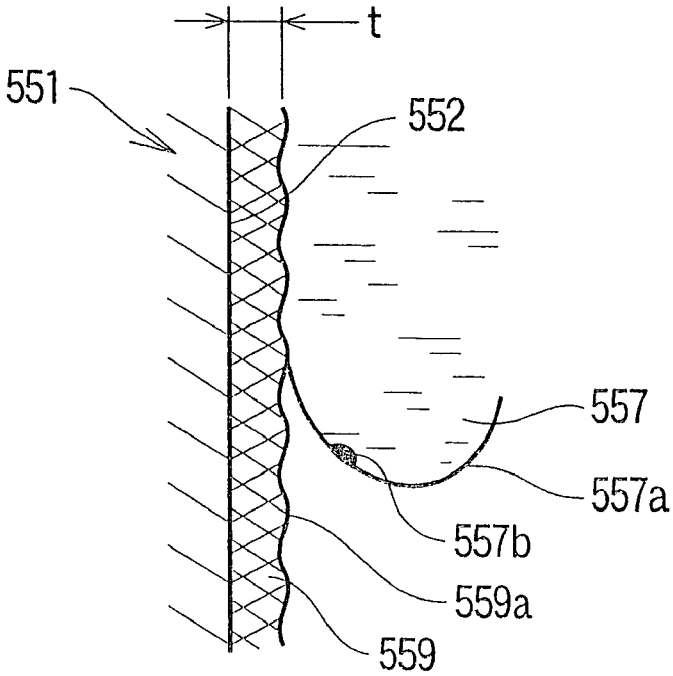
FIG.58 (PRIOR ART)
FIG. 58 is a diagram explaining an important part of the known aluminum casting process.

FIGS. 56A and 56B are diagrams for explaining an example in which an aluminum casting is molded in accordance with the aluminum casting process according to the ninth embodiment of this invention, and it shows the latter half of ST43. Referring to FIG. 56A, the pouring tank 337 is returned to its horizontal position after a specific amount of molten aluminum 339 has been supplied from the pouring tank 337 into the cavity 327. After molten aluminum 339 has solidified, the core 325 is lowered by the raising and lowering device 334 as shown by an arrow K and the movable mold member 324 is moved by the moving device 333 as shown by an arrow L, so that the casting mold 322 may be opened. The temperature of molten aluminum 339 as poured is detected by the temperature sensor 371 and the temperature of molten aluminum 339 in the pouring tank 337 is regulated by the on-off control of the pouring tank heater 337*a* in accordance with information on the temperature of poured molten metal as detected by the temperature sensor 371. Thus, it is possible to control the temperature of molten aluminum 339 as poured easily without employing a lot of time and labor. Referring to FIG. 56B, the casting mold 322 is opened for the removal of an aluminum casting 390 obtained by the solidification of molten aluminum 339 (shown in FIG. 56A). The aluminum casting 390 is a product of higher quality owing to a good distribution of molten metal as poured. The aluminum casting 390 has its non-product portions 390*a* and 390*b* removed and has its product portion 390*c* worked on to give an engine cylinder block 310 (shown in FIG. 48).

While the ninth embodiment has been described by reference to the example in which the temperature of molten aluminum 339 is detected by the temperature sensor 371 in the temperature detecting portion 370 and is automatically regulated in accordance with information as detected, it is alternatively possible to regulate the temperature of molten aluminum based on experience without employing any temperature detecting portion 370 or control portion 375.

INDUSTRIAL APPLICABILITY

According to this invention, the cavity is charged with an inert gas, magnesium is introduced into the cavity to have a magnesium layer deposited on the cavity wall and the cavity wall is heated to a specific temperature. After its heating, nitrogen gas is introduced into the cavity to form magnesium nitride on the surface of the magnesium layer. This makes it possible to form magnesium nitride within a short time and reduce the amount of nitrogen gas as required. It is, thus, possible to achieve a high productivity and a reduction of cost and thereby utilize this invention effectively by applying it to, for example, products which are manufactured in a relatively large quantity, such as aluminum brake disks and cylinder blocks forming component parts of motor vehicles.

The invention claimed is:

1. An aluminum casting process using a casting mold, comprising the steps of:

prior to introducing gaseous magnesium, filling a cavity of a closed mold with a rare gas that is unreactive with magnesium;

introducing gaseous magnesium into the rare gas-filled cavity and thereby depositing unreacted magnesium on a wall of the cavity;

heating the mold to heat the unreacted magnesium-deposited cavity wall to a specific temperature, said specific temperature being greater than or equal to 400° C.;

after heating the mold to the specified temperature, introducing nitrogen gas into the cavity, said nitrogen gas reacting with said unreacted magnesium on the cavity wall and thereby forming a magnesium nitride coating on the cavity wall; and supplying molten aluminum into the cavity in which the magnesium nitride coating has been formed, to mold an aluminum casting in the cavity, while reducing a surface of the molten aluminum with the magnesium nitride.

2. The aluminum casting process using a casting mold according to claim 1, comprising the further step of heating the cavity wall with a cartridge heater embedded in the mold.

3. The aluminum casting process using a casting mold according to claim 1, comprising the further step of detecting a temperature of the cavity wall with a thermocouple embedded in the mold.

4. The aluminum casting process using a casting mold according to claim 2, comprising the further step of detecting a temperature of the cavity wall with a thermocouple embedded in the mold.

5. The aluminum casting process using a casting mold, according to claim 1, wherein the rare gas that is unreactive with magnesium is helium.

6. The aluminum casting process using a casting mold, according to claim 2, wherein the rare gas that is unreactive with magnesium is helium.

7. The aluminum casting process using a casting mold, according to claim 3, wherein the rare gas that is unreactive with magnesium is helium.

8. The aluminum casting process using a casting mold, according to claim 1, wherein the rare gas that is unreactive with magnesium is argon.

9. The aluminum casting process using a casting mold, according to claim 2, wherein the rare gas that is unreactive with magnesium is argon.

10. The aluminum casting process using a casting mold, according to claim 3, wherein the rare gas that is unreactive with magnesium is argon.

11. An aluminum casting process using a casting mold, comprising the steps of:

prior to introducing gaseous magnesium, filling a cavity of a closed mold with a rare gas that is unreactive with magnesium, while discharging air from the cavity, to establish a first pressure in the cavity that is equal to or below an atmospheric pressure;

introducing gaseous magnesium into the cavity to deposit unreacted magnesium on a wall of the cavity and establish a second pressure in the cavity that is equal to or below the atmospheric pressure;

introducing heated nitrogen gas into the cavity, said heated nitrogen gas reacting with said unreacted magnesium deposited on said cavity wall to form a magnesium nitride coating on the wall of the cavity and establish a third pressure in the cavity that is equal to or below the atmospheric pressure; and supplying molten aluminum into the cavity to mold an aluminum casting in the cavity, while reducing a surface of the molten aluminum with the magnesium nitride.

12. The aluminum casting process using a casting mold, according to claim 11, wherein the rare gas that is unreactive with magnesium is helium.

13. The aluminum casting process using a casting mold, according to claim 11, wherein the rare gas that is unreactive with magnesium is argon.

* * * * *